US012344433B2

(12) United States Patent
Eng et al.

(10) Patent No.: US 12,344,433 B2
(45) Date of Patent: Jul. 1, 2025

(54) UTILITY TRAY

(71) Applicant: ILW LC, Sheridan, WY (US)

(72) Inventors: Christopher Eng, Newton, MA (US); Patrick Triato, Portland, OR (US)

(73) Assignee: ILW LC, Sheridan, WY (US)

( * ) Notice: Subject to any disclaimer, the term of this patent is extended or adjusted under 35 U.S.C. 154(b) by 0 days.

(21) Appl. No.: 18/653,856

(22) Filed: May 2, 2024

(65) Prior Publication Data

US 2024/0400264 A1 Dec. 5, 2024

Related U.S. Application Data

(63) Continuation-in-part of application No. 18/213,110, filed on Jun. 22, 2023, now Pat. No. 11,986,087.

(60) Provisional application No. 63/469,751, filed on May 30, 2023.

(51) Int. Cl.
*B65D 1/34* (2006.01)

(52) U.S. Cl.
CPC ..... *B65D 1/34* (2013.01)

(58) Field of Classification Search
CPC ..... A47B 5/02; A47B 23/001; A47B 23/02; A47B 5/00; A47B 5/04; A47B 5/06; B65D 1/34
USPC .... 248/229.15, 229.25, 228.6, 230.6, 231.71
See application file for complete search history.

(56) References Cited

U.S. PATENT DOCUMENTS 834,849 A * 10/1906 Rollman ..... F16M 13/02 248/231.71
3,744,645 A * 7/1973 Hochman ..... A47F 5/0068 211/186
4,575,149 A 3/1986 Forestal et al.
4,698,936 A * 10/1987 Helfman ..... A01G 9/02 47/68
5,984,249 A * 11/1999 Cohen ..... A47G 7/044 248/205.2
6,012,690 A 1/2000 Cohen
6,237,799 B1 * 5/2001 Emerson ..... A47B 23/025 220/570
11,311,103 B1 4/2022 Wilson et al.
(Continued)

OTHER PUBLICATIONS

Final Office Action for U.S. Appl. No. 18/213,110, mailed Nov. 1, 2023, 7 pages.

(Continued)

*Primary Examiner* — Matthew W Ing

(74) *Attorney, Agent, or Firm* — Elliot, Ostrander & Preston, P.C.

(57) ABSTRACT

The tray has a horizontal base and an edge. A C-clamp has a horizontally oriented side coupled to a bottom surface of the base, normal to and adjacent the edge. The C-clamp has first and second vertically oriented sides extending downward. The second vertically oriented side has a threaded hole. A screw has a shaft, a handle at a first end, and a shoe at a second end of the shaft. The second end of the screw passes through the threaded hole of the second vertically oriented side of the C-clamp and extends horizontally toward the first vertically oriented side of the C-clamp. Moving the handle causes the second end of the screw to further extend horizontally toward the first vertically oriented side of the C-clamp such that the shoe and the first vertically oriented side of the C-clamp frictionally engage the support structure when positioned therebetween.

10 Claims, 96 Drawing Sheets

(56) References Cited

U.S. PATENT DOCUMENTS

| | | | | |
|---|---|---|---|---|
| 2006/0220501 | A1 | 10/2006 | Robertson | |
| 2007/0101908 | A1 | 5/2007 | Makita | |
| 2009/0020047 | A1 * | 1/2009 | Noble | A47B 13/081 108/157.1 |

OTHER PUBLICATIONS

Non-Final Office Action for U.S. Appl. No. 18/213,110, mailed Sep. 21, 2023, 9 pages.
Notice of Allowance for U.S. Appl. No. 18/213,110, mailed Jan. 9, 2024, 7 pages.

* cited by examiner

SECTION E-E

SECTION E-E

UTILITY TRAY

CROSS-REFERENCE TO RELATED APPLICATION

This application is a continuation-in-part of U.S. Non-provisional application Ser. No. 18/213,110, filed Jun. 22, 2023, entitled "UTILITY TRAY," which claims the benefit of U.S. Provisional Application No. 63/469,751, filed May 30, 2023, the entire contents of which are hereby incorporated by reference herein.

TECHNICAL FIELD

Embodiments of the present invention relate to utility trays, and in particular a tray that can be attached to a support member.

BACKGROUND

Utility trays have previously been provided with attachment means for attaching the utility tray to a supporting structure. However, the attachment means does not work well for some support structures, for example, a bed frame.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1A:
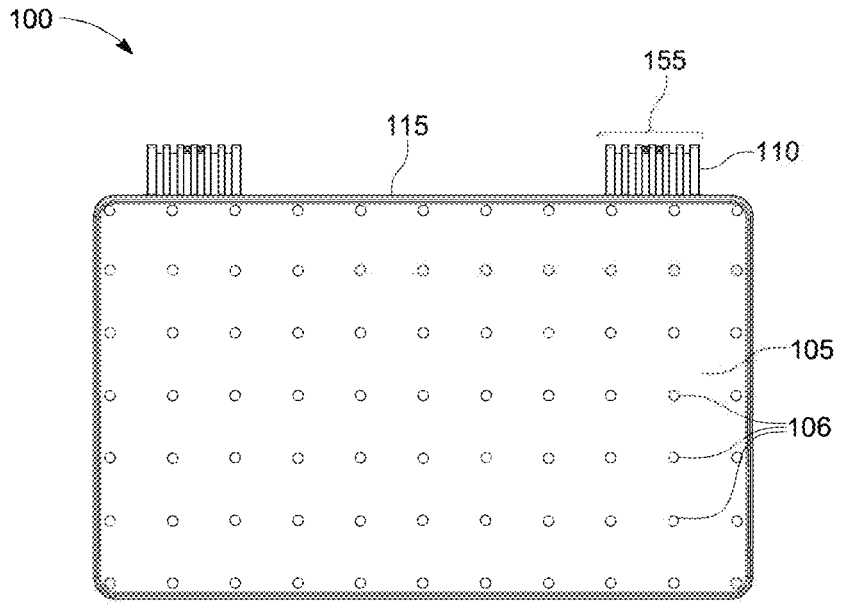
FIGS. 1A-1F illustrate a utility tray according to an embodiment of the invention.
Figure 1B:
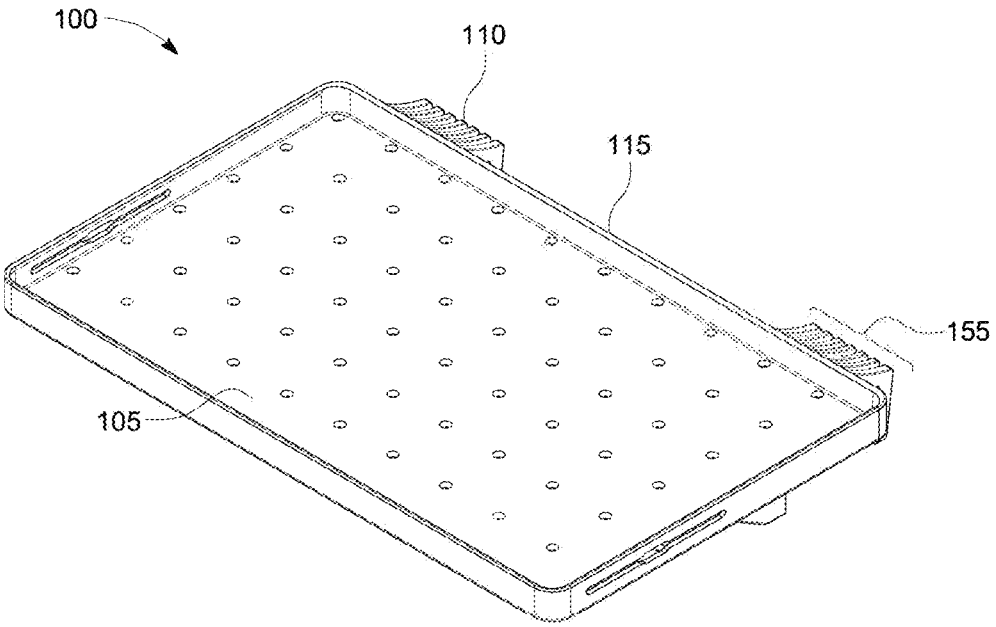
Figure 1C:
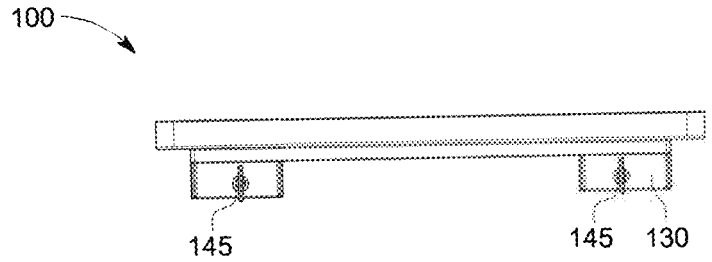

FIGS. 1A-1F illustrate several views of a utility tray (100), according to an embodiment of the invention. The tray is capable of being frictionally engaged to, or clamped onto, a support structure, as disclosed in detail below. The support structure may have a rectangular cross section, as illustrated at 340 in FIG. 3B. Such a support structure may be made of solid wood, or hollow rectangular or square metal tubing. Alternatively, the support structure may be a right-angle structure, as illustrated at 440 in FIG. 4B, such as a piece of angle iron.

The tray may be made from wood product (such as bamboo, hardboard, or an engineered wood product, such as plywood, strand board, or medium density fiberboard (MDF), or materials made from recycled paper, such as Richlite or PaperStone®), metal, plastic (e.g., Melamine), or a combination of such or other products. The tray includes a horizontally oriented planar base 105 (hereinafter "base 105"). The base has an edge 115 along which one or more brackets, such as right-angle brackets 110, may be molded or coupled. Although tray 100 is illustrated as having a rectangular-shaped planar base 105, it is appreciated that the tray base could be any shape such a polygon, circle, or oval shape. Although tray 100 is illustrated having two right-angle brackets, the lengths of which are relatively short compared to the length of edge 115, it is appreciated that a single bracket or multiple brackets may extend along much or all the length of edge 115.

Figure 1D:
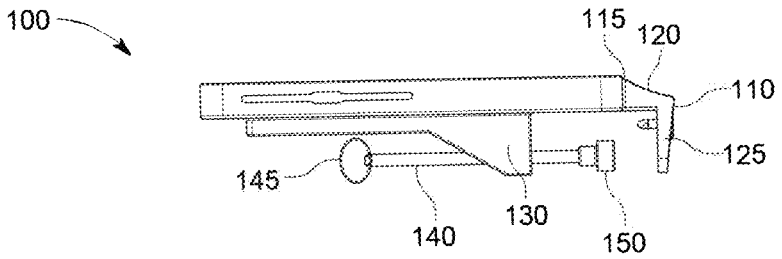
Figure 1E:
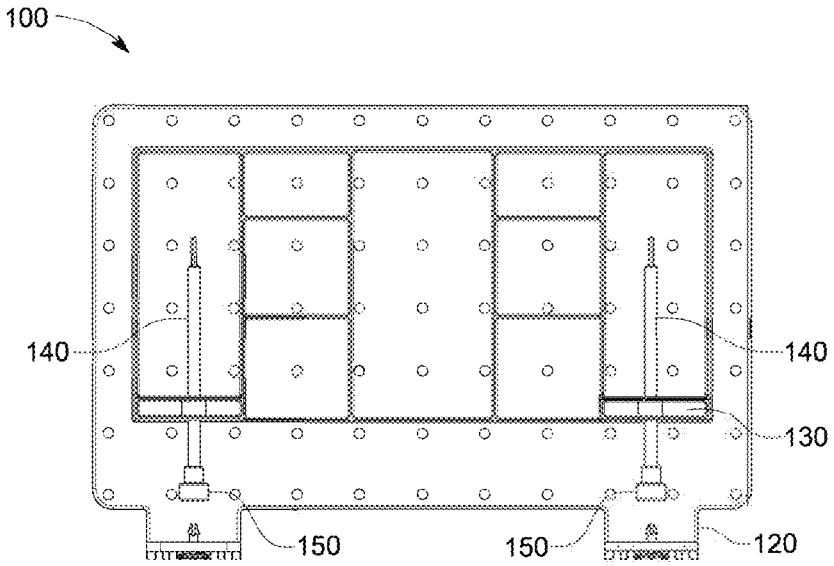
Figure 1F:
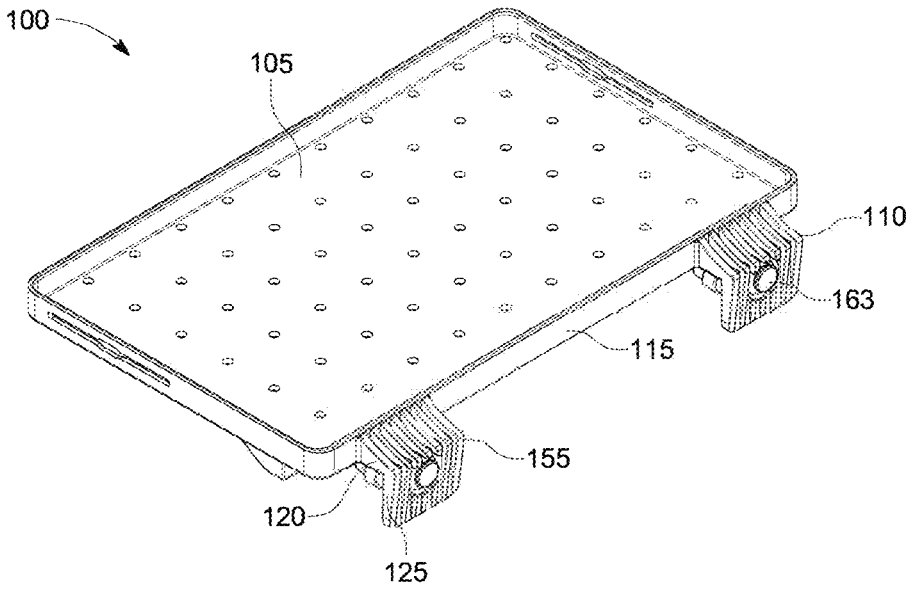
Figure 2:
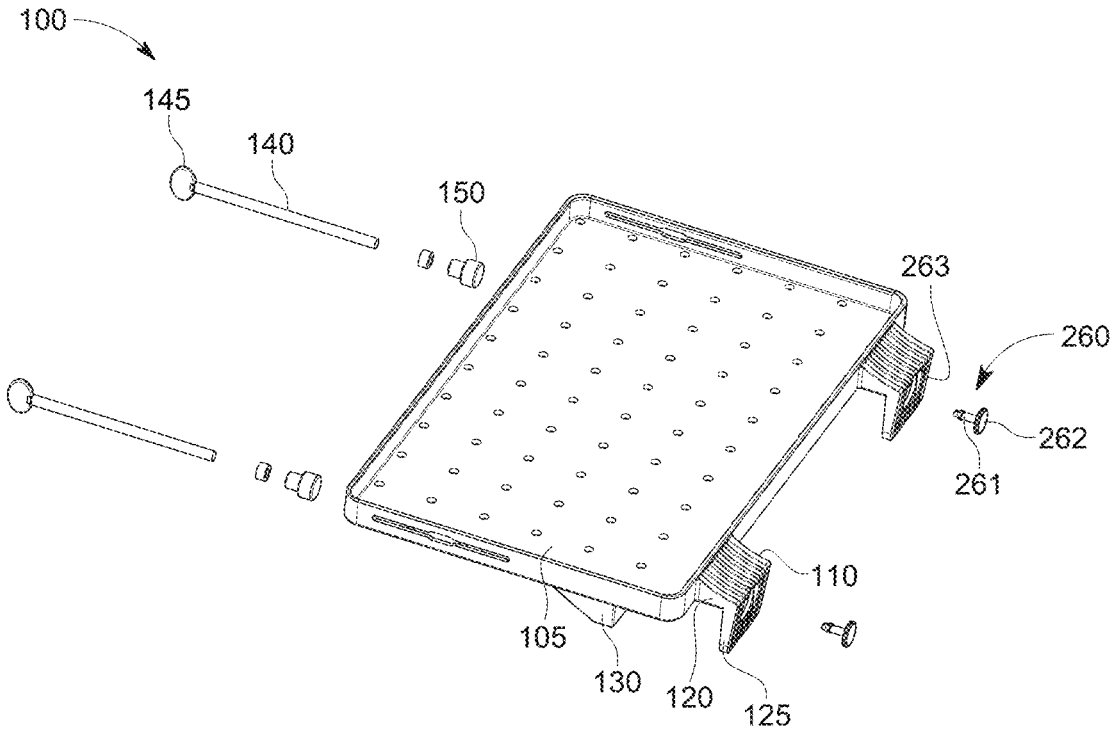
FIG. 2 illustrates a utility tray according to an embodiment of the invention.

With reference to FIG. 1D, the right-angle bracket 110 has a horizontally oriented side 120. An edge of horizontally oriented side 120 is coupled to adjacent edge 115 of base 105. The horizontally oriented side 120 extends away from base 105 in a direction parallel to a plane of the base. The right-angle bracket 110 further has a vertically oriented side 125 coupled to horizontally oriented side 120 at a corner of the right-angle bracket and extending in a downward direction from the corner. In the illustrated embodiment, horizontally oriented side 120 of right-angle bracket 110 extends in the direction parallel in the same plane as base 105. In the embodiments, the horizontally oriented side may extend in the direction of a plane parallel to, and above the base, or a plane parallel to, and below the base.

According to one embodiment, right-angle bracket 110 comprises a ribbed surface 155 which provides strength and stiffness to the right-angle bracket. Alternatively, the horizontally and/or vertically oriented sides of the right-angle bracket could be made thicker to provide additional strength and stiffness, but at the expense of additional raw material and weight.

In one embodiment, ribbed surface 155 comprises spaced apart horizontally oriented ribs attached or molded to a top surface of horizontally oriented side 120 of right-angle bracket 110 and extending in a direction normal to the edge of the horizontally oriented side of the right-angle bracket. In one embodiment, the ribbed surface comprises spaced apart vertically oriented ribs attached to an outside surface of the vertically oriented side 125 of the right-angle bracket.

The tray 100 has another one or more brackets 130 coupled to a bottom surface of the base 105 and extending downward in the direction substantially normal to the base. Each bracket 130 is positioned opposite a right-angle bracket 110 with sufficient horizontal distance between the bracket and right-angle bracket, thereby forming a channel in which to receive a support structure, such as support structure 340 or 440 illustrated in FIGS. 3B and 4B.

With reference to FIGS. 1A-1F, 2, 3B, 4B, 6C-6F, bracket 130 includes a threaded hole 335, 435, 635. A threaded fixing, for example, a bolt, or as illustrated in the figures, a screw 140 comprising a head or handle 145 at a first end of the screw and a shoe 150 at a second end of the screw is inserted through threaded hole 335, 435, 635 such that the second end of the screw passes through the threaded hole of bracket 130 and extends toward right-angle bracket 110. In alternative embodiments, the shoe may be a spinnable or movable turntable or shoe, wherein the turntable or shoe is affixed to the second end of the screw by a rivet of the like and can rotate about the long axis of the screw and/or pivot or move angularly a limited amount with respect to a plane normal to the long axis of the screw, for example, to better accommodate clamping against a support structure. Turning the head or the handle 145 of screw 140 causes the shoe 150 to move toward to engage and trap the support structure in the channel formed by the bracket and the right-angle bracket, between shoe 150 and right-angle bracket 110. As the head or handle is turned after the support structure is trapped between shoe 150 and right-angle bracket 110, the shoe and right-angle bracket frictionally engage the support structure positioned therebetween. In this manner, items (e.g., a laptop computer, a book, and various accessories, etc.) can be placed on and weigh down the tray and yet the tray is held firm in a substantially horizontal position to the support structure by virtue of shoe 150 and right-angle bracket 110 frictionally engaging the support structure.

The tray 100 illustrated in FIGS. 1A-1F includes a planar base 105 that is made of peg board. The peg board includes a one- or two-dimensional array of holes 106 that are distributed across at least a portion of base 105 to accommodate one or more accessories. Alternatively, the peg board may include one or more holes 106 that are strategically located to support the attachment of an accessory at a desired location. For example, one or more holes may be positioned only along the periphery or perimeter of base 105, or a portion thereof. Each accessory is designed to have a corresponding one or more pegs that can be inserted into a respective one or more holes in the peg board to firmly attach the accessory to tray 100. While the illustrated embodiment depicts round holes 106 in the planar base, it is appreciated that other shapes for holes may be used, including polygonal-shaped holes, oval-shaped holes, a slot-shaped hole, etc.

With reference to FIGS. 9A, 9B, 9C, 10A, 10B, 10C, 11A, 11B, 11C, 12A, 12B, 12C, 13A, 13B, 14A, 14B and 14C, several views of some of the following peg board accessories are illustrated: a vertical support post (for example, to support another tray or accessory positioned above base 105), a J-style hook, an S-style hook 900, a loop 1000, a bungee, a mobile computing device holder, a mobile phone holder 1100, a vertical dividing wall, a side or edge wall, a cup holder 1200, an LED light, a fan, a USB charging port, a DC electrical outlet, an electrical surge protector, a DC power strip, and a USB charging port device. The above examples are illustrative only; it is appreciated that many other accessories may also be similarly affixed to tray 100. As illustrated, each accessory comprises at least one peg 905 by which the accessory engages a hole in the peg board to firmly couple the accessory to the peg board. While the illustrated embodiment depicts round pegs that insert into a corresponding round hole 106 in the planar base, it is appreciated that other shapes for pegs that correspond to other shapes of holes may be used, including polygonal-shaped pegs, oval-shaped pegs, and blade or tab shaped pegs that insert into a slot-shaped hole, etc.

Figure 4A:
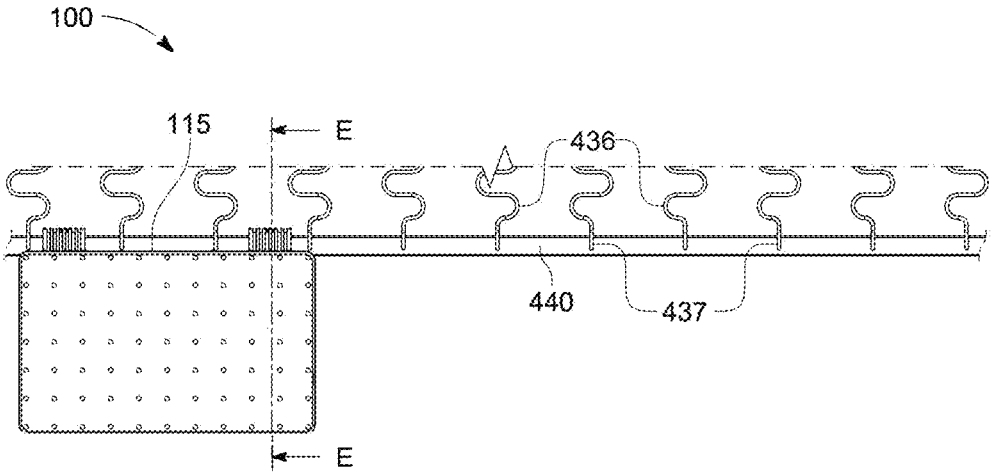
FIGS. 4A, 4B and 4C illustrate aspects of a utility tray according to an embodiment of the invention.
Figure 4B:
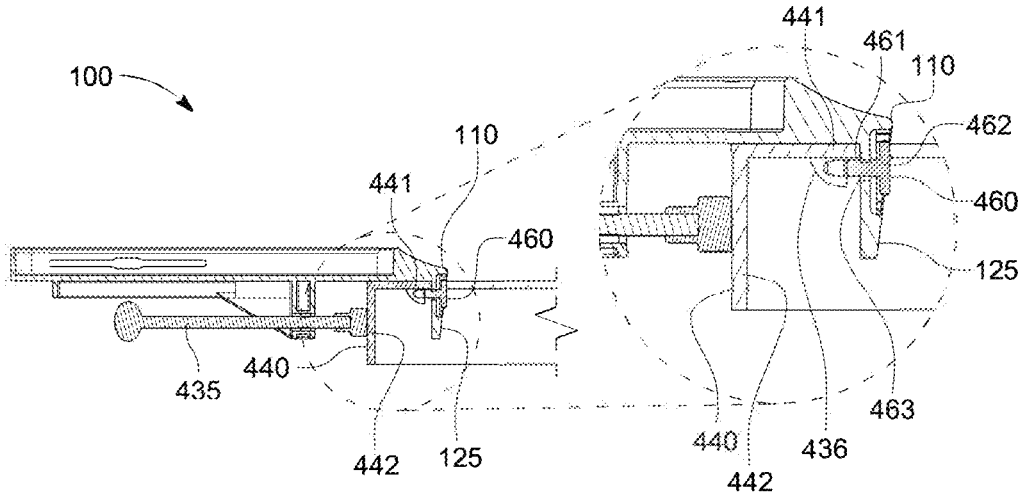
Figure 4C:
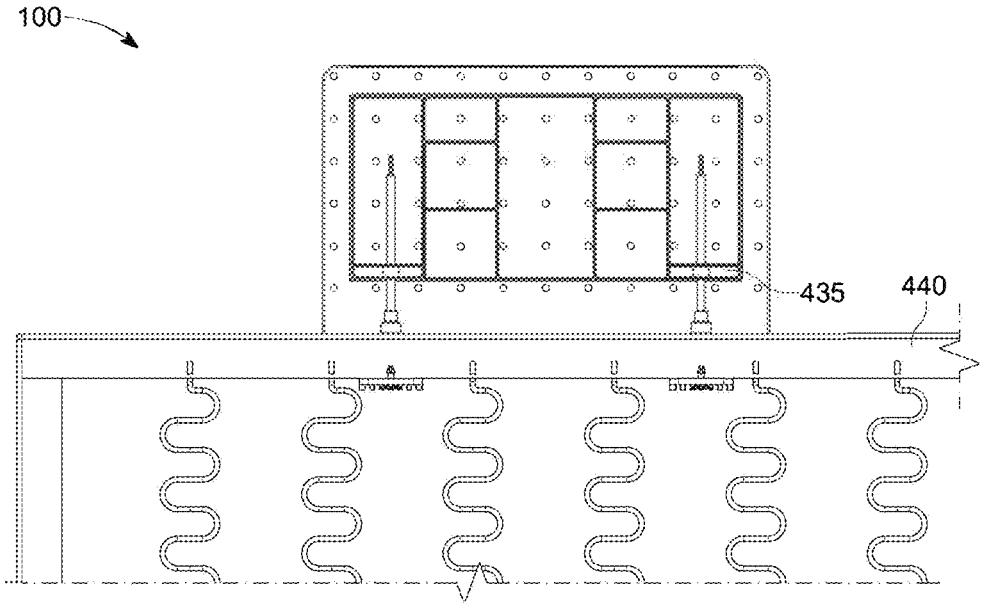
Figure 5A:
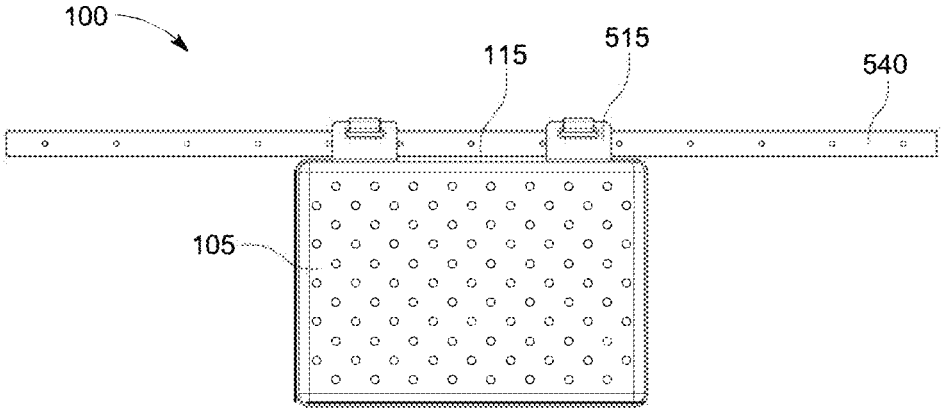
FIGS. 5A-5F illustrate a utility tray according to an embodiment of the invention.
Figure 5B:
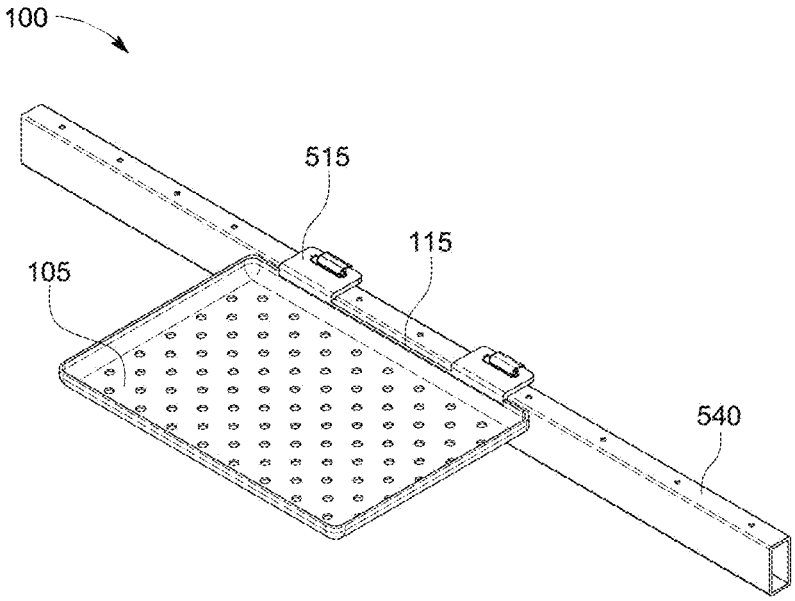
Figure 5C:
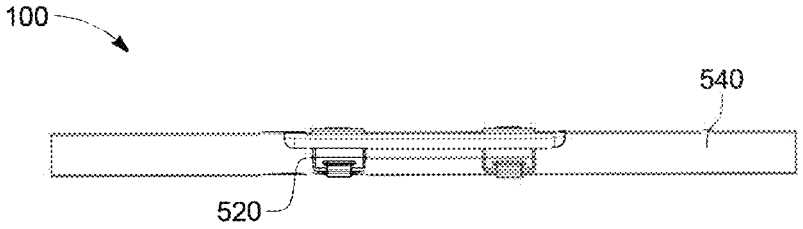
Figure 5D:
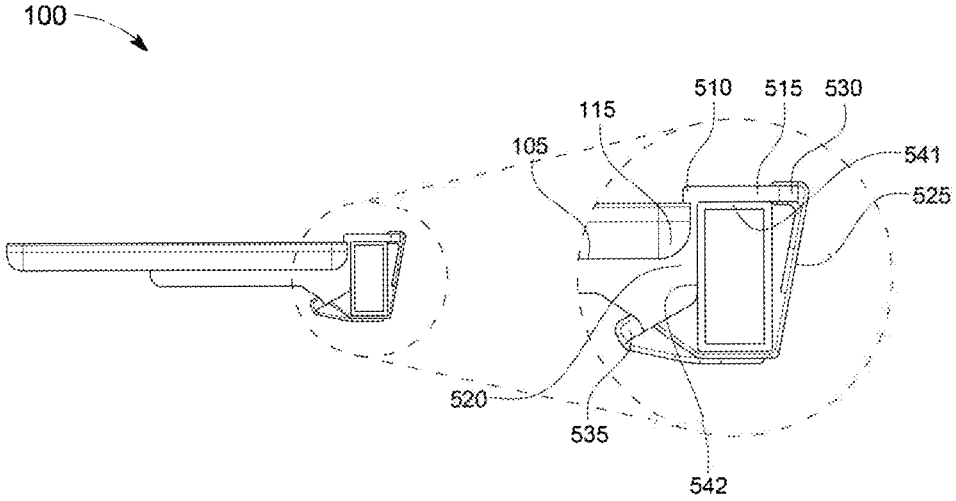
Figure 5E:
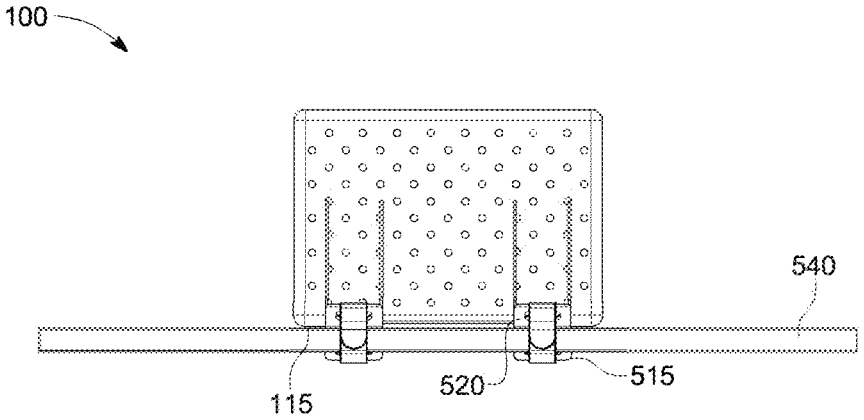
Figure 5F:
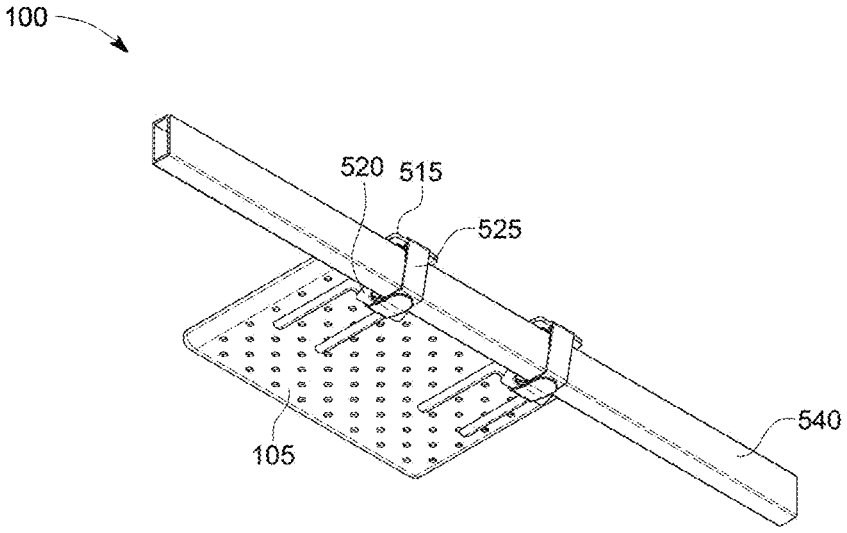
Figure 6A:
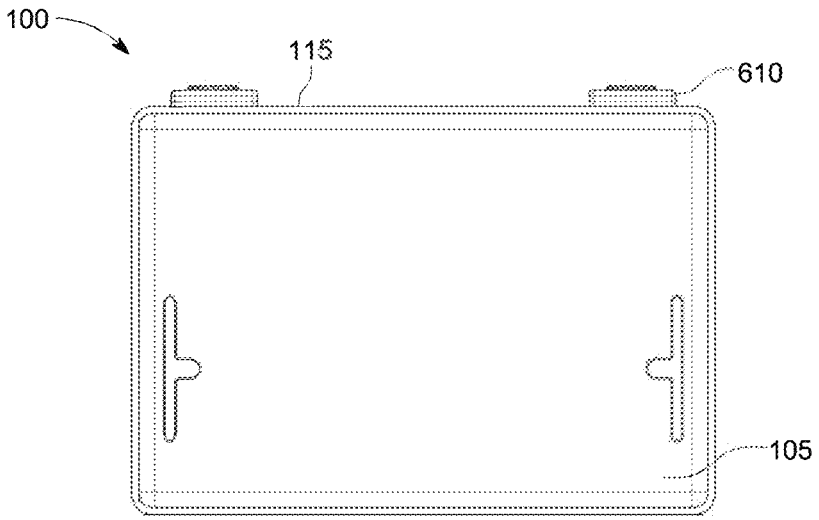
FIGS. 6A-6F illustrate a utility tray according to an embodiment of the invention.
Figure 6B:
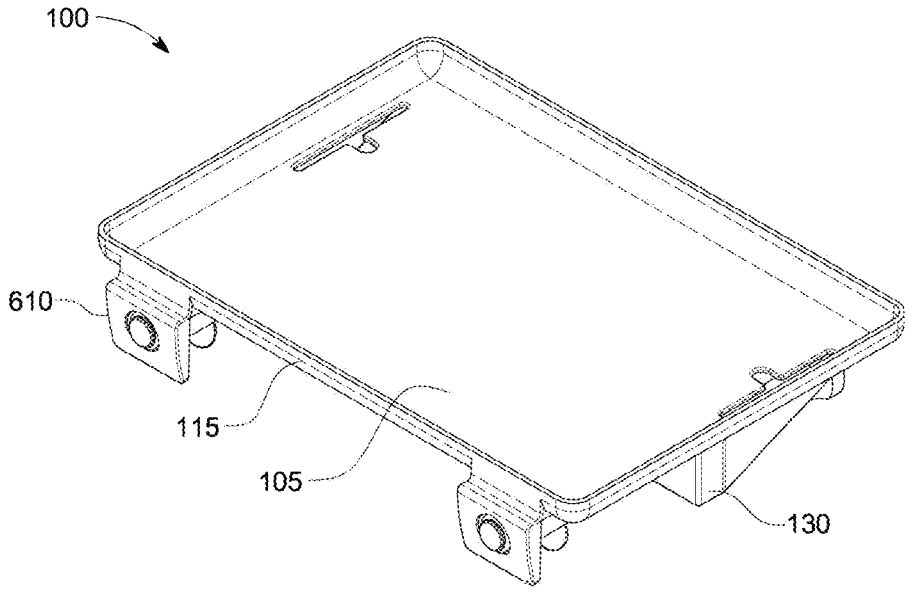
Figure 6C:
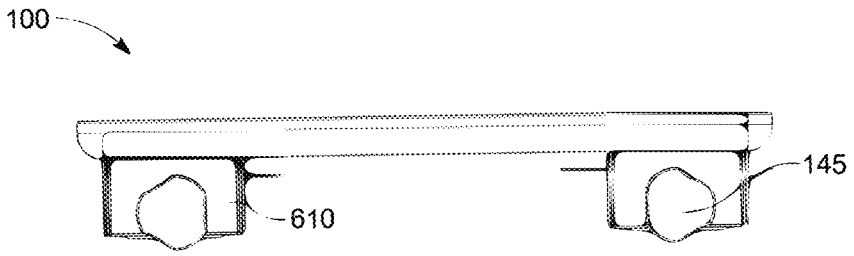
Figure 6D:
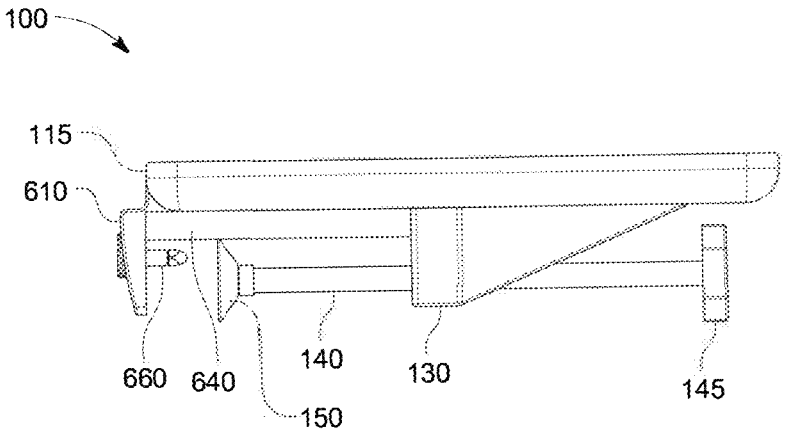
Figure 6E:
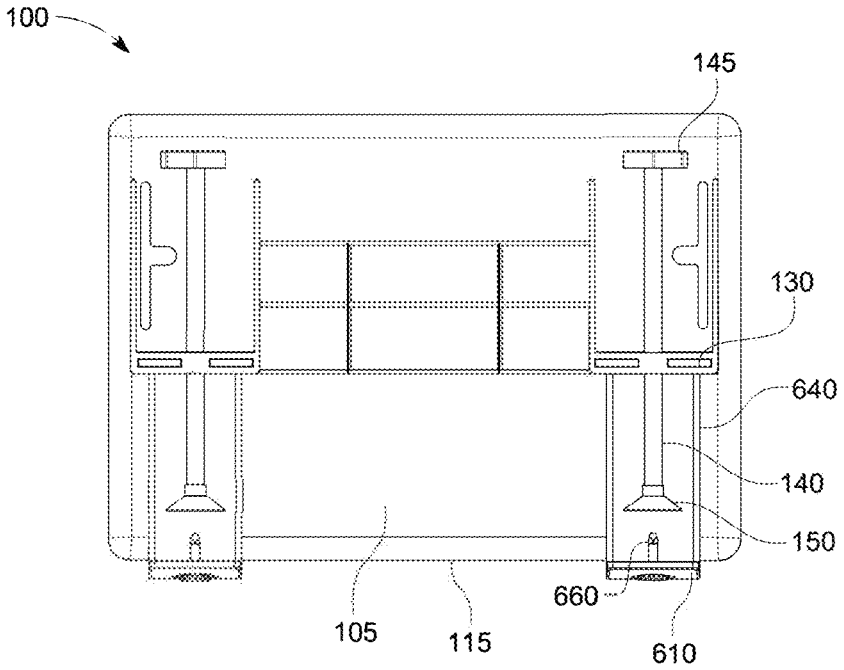
Figure 6F:
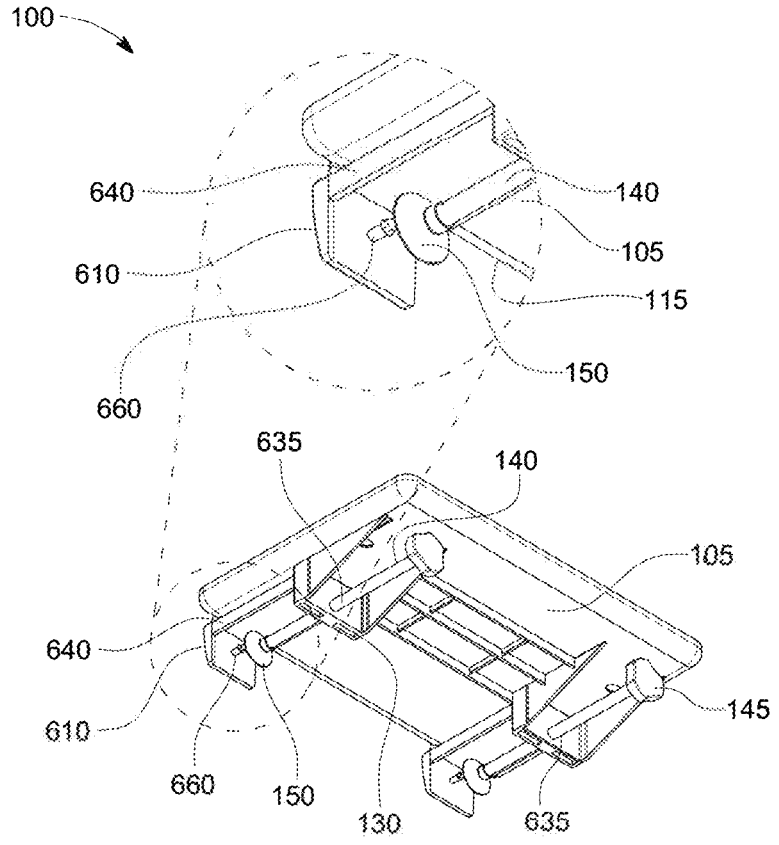
Figure 7A:
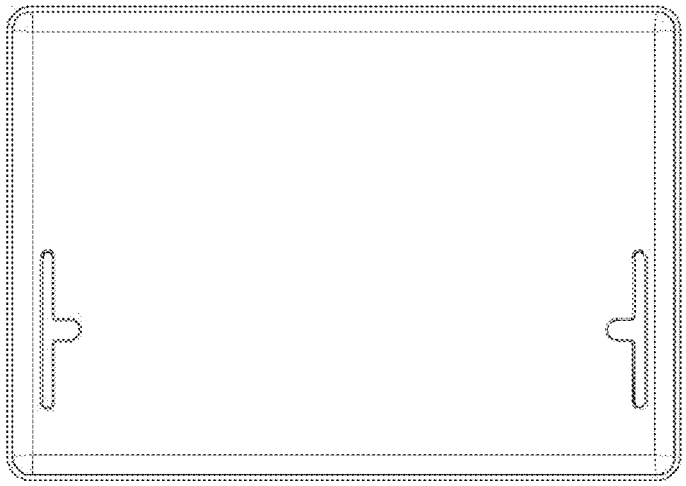
FIGS. 7A-7F illustrate a utility tray according to an embodiment of the invention.
Figure 7B:
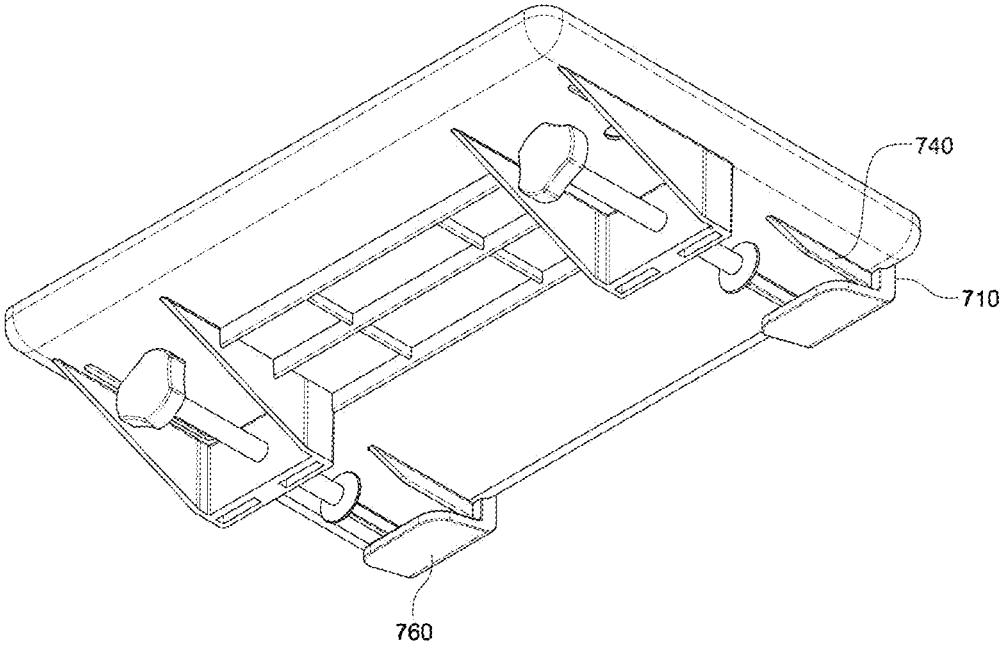
Figure 7C:
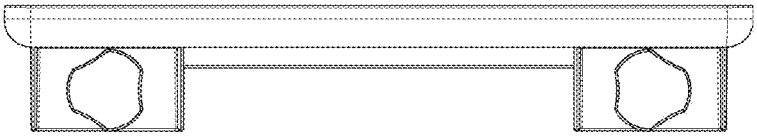
Figure 7D:
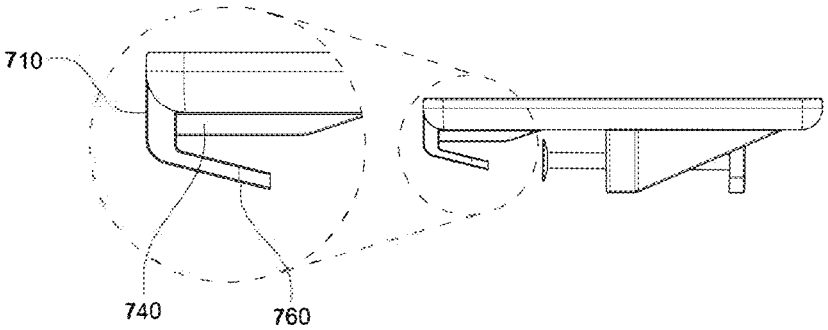
Figure 7E:
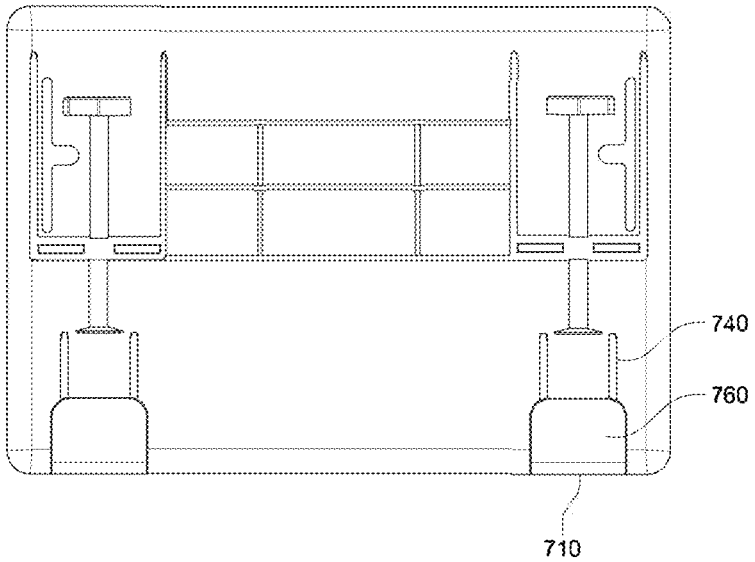
Figure 7F:
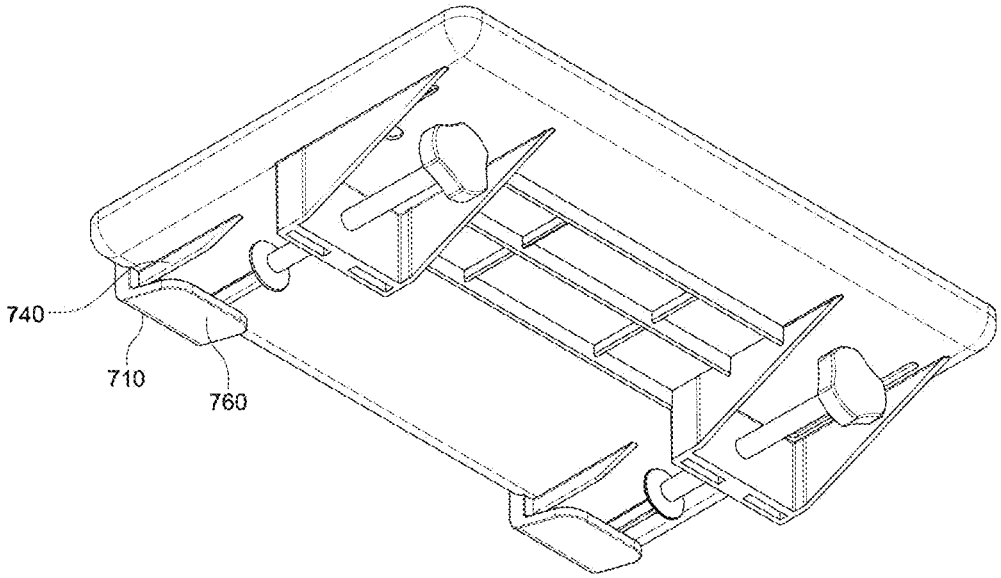
Figure 8A:
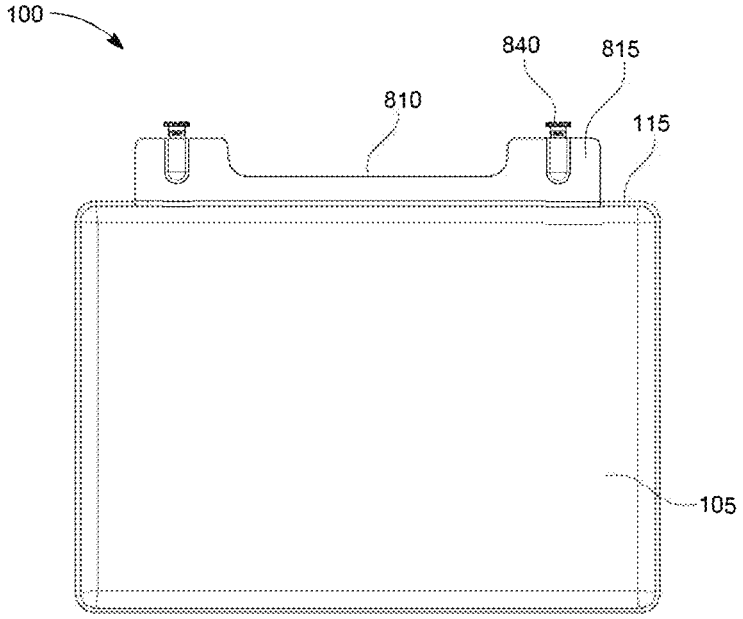
FIGS. 8A-8F illustrate a utility tray according to an embodiment of the invention.
Figure 8B:
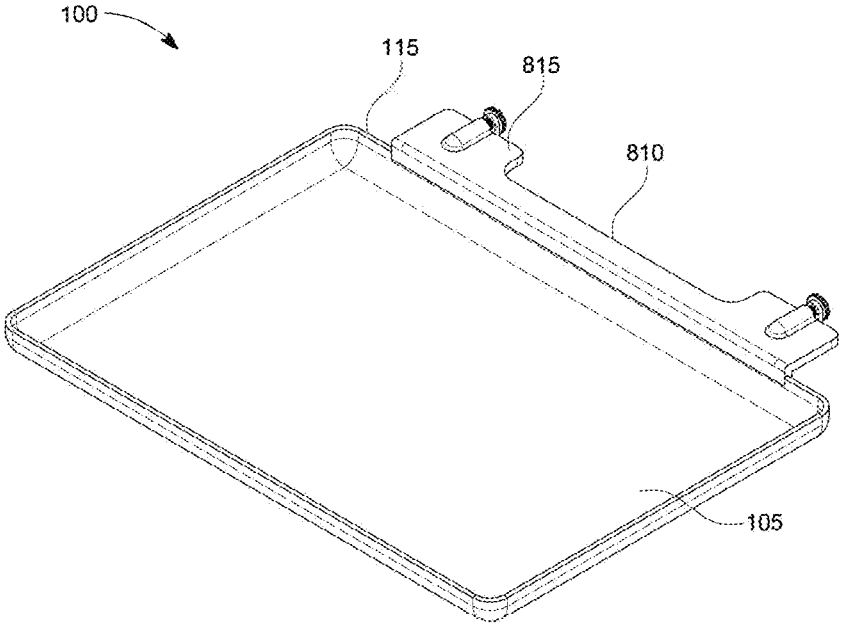
Figure 8C:
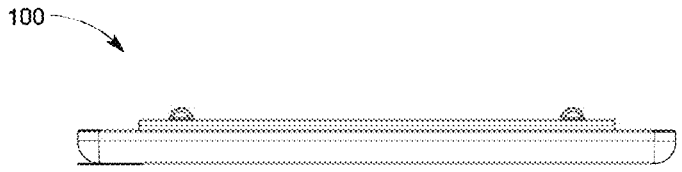
Figure 8D:
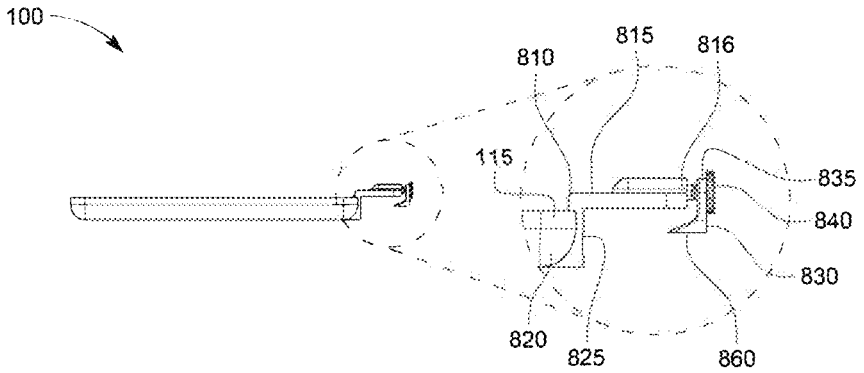
Figure 8E:
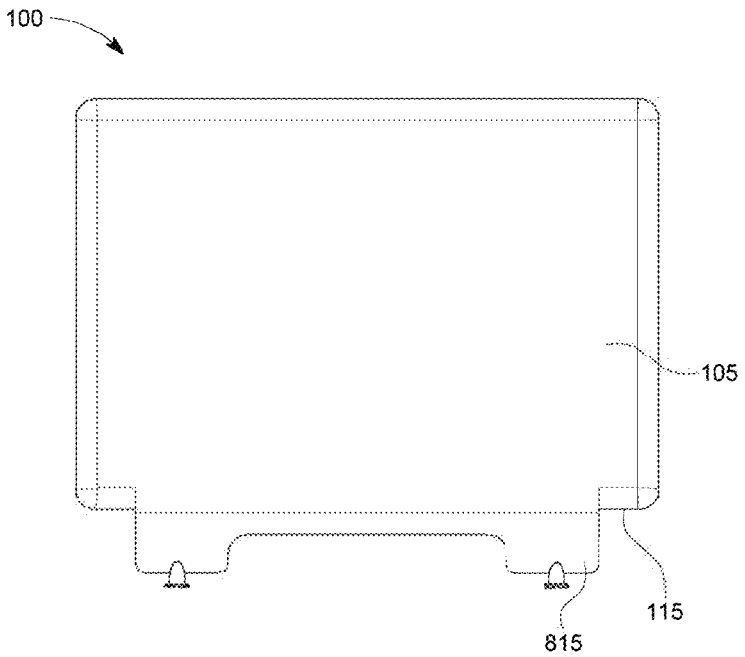
Figure 8F:
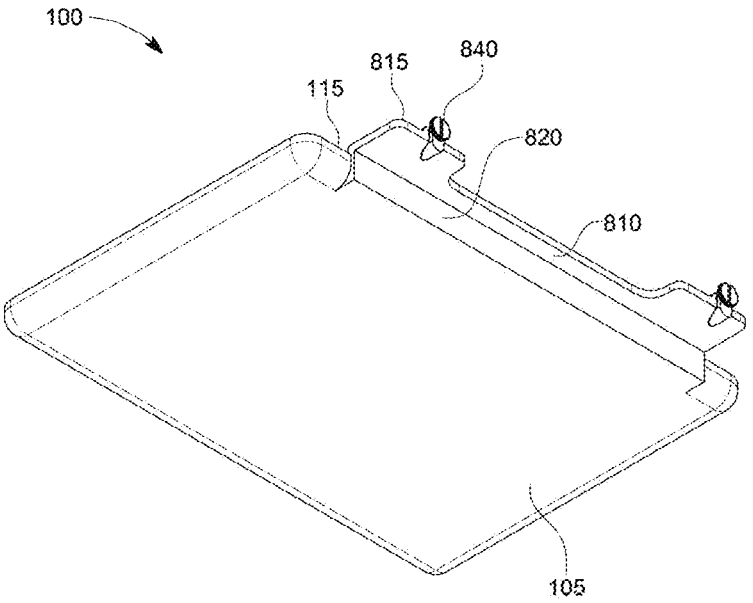
Figure 9A:
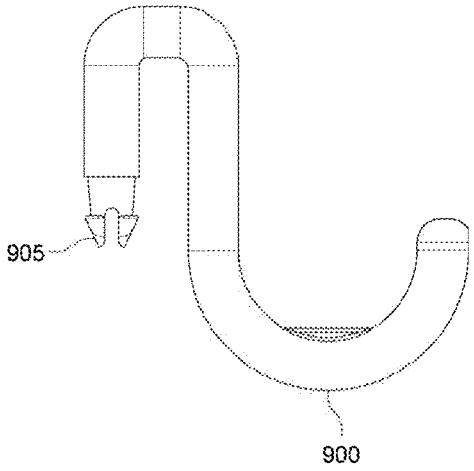
FIGS. 9A, 9B and 9C illustrate an accessory for a utility tray according to an embodiment of the invention.
Figure 9B:
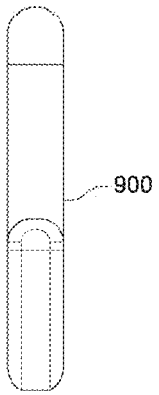
Figure 9C:
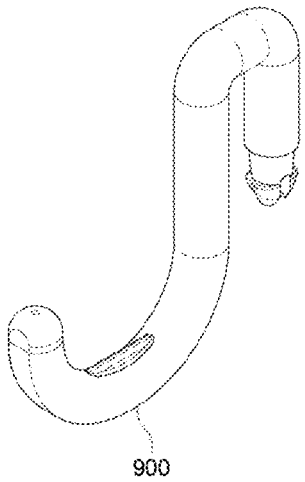
Figure 10A:
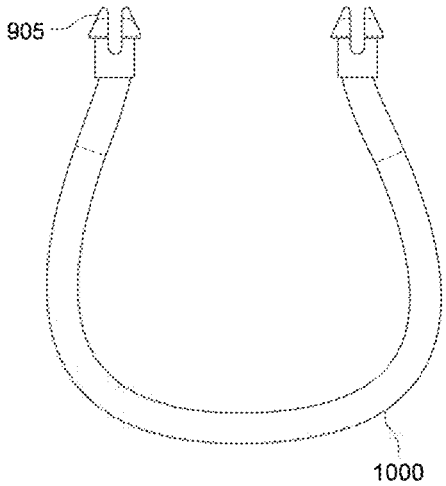
FIGS. 10A, 10B and 10C illustrate an accessory for a utility tray according to an embodiment of the invention.
Figure 10B:
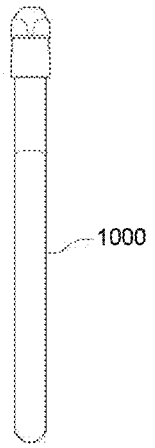
Figure 10C:
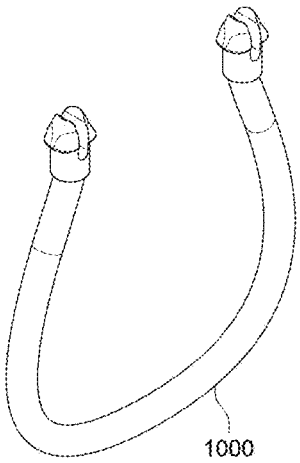
Figure 11A:
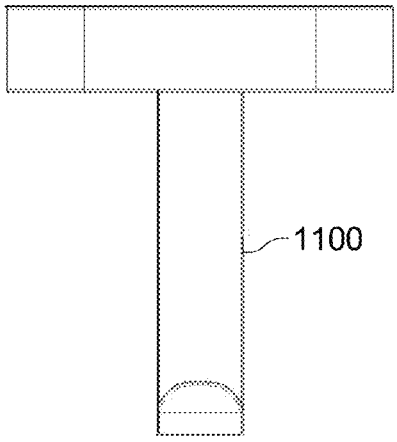
FIGS. 11A, 11B and 11C illustrate an accessory for a utility tray according to an embodiment of the invention.
Figure 11B:
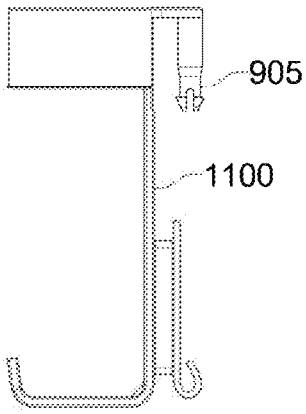
Figure 11C:
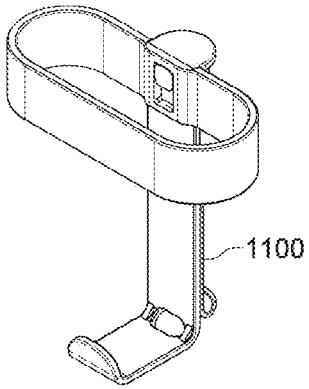
Figure 12A:
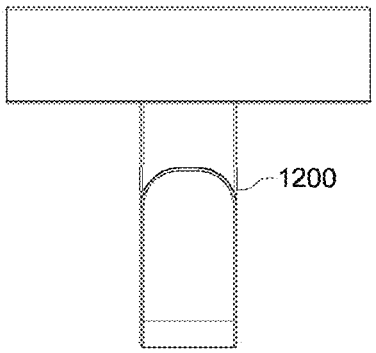
FIGS. 12A, 12B and 12C illustrate an accessory for a utility tray according to an embodiment of the invention.
Figure 12B:
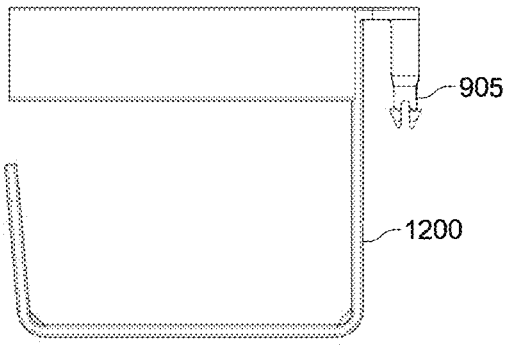
Figure 12C:
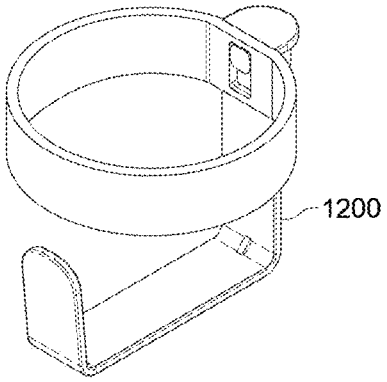
Figure 13A:
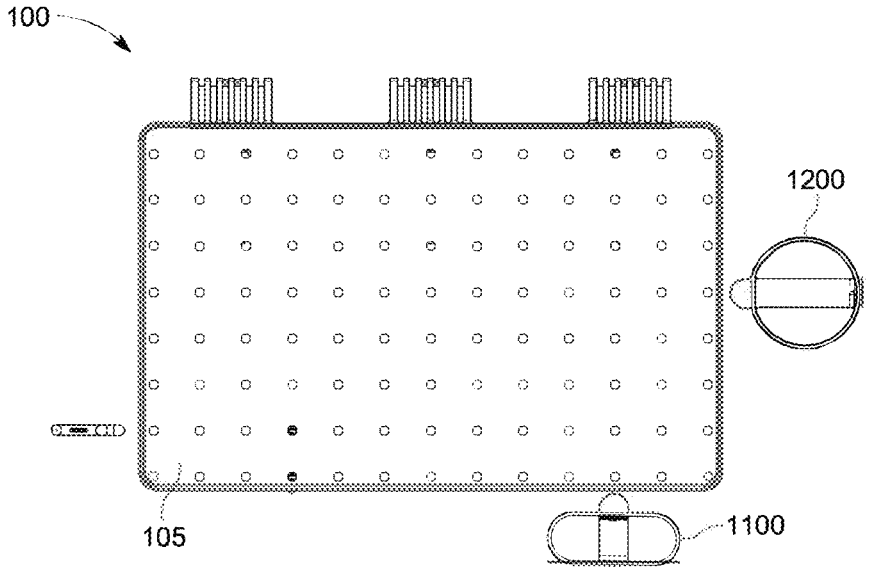
FIGS. 13A and 13B illustrate example positions of accessories for a utility tray according to an embodiment of the invention.
Figure 13B:
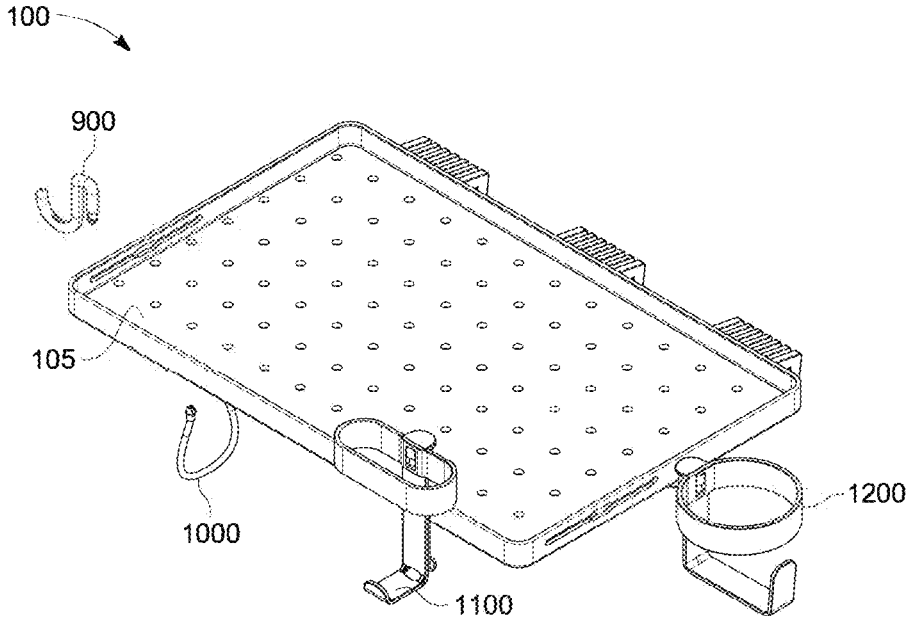
Figure 14A:
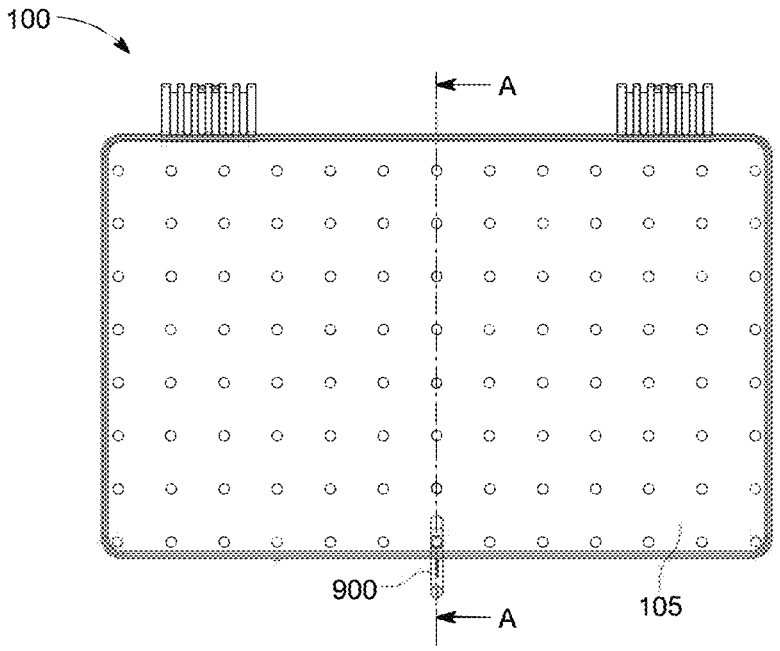
FIGS. 14A, 14B and 14C illustrate an attachment of an accessory to a utility tray according to an embodiment of the invention.
Figure 14B:
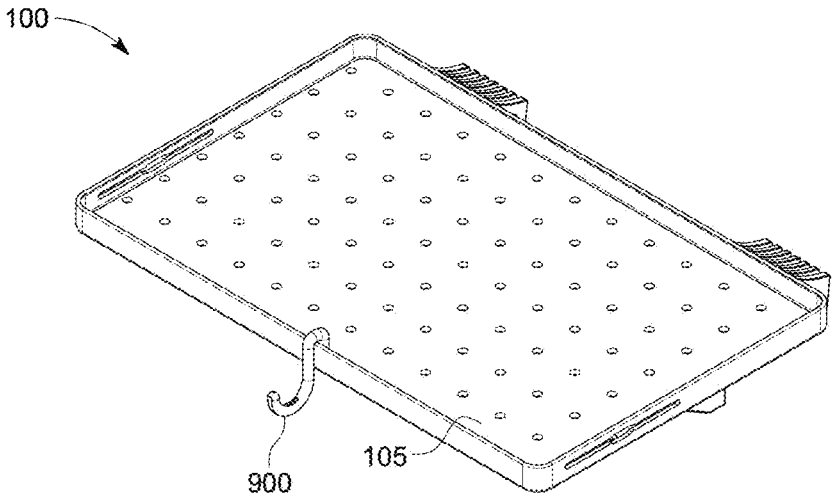
Figure 14C:
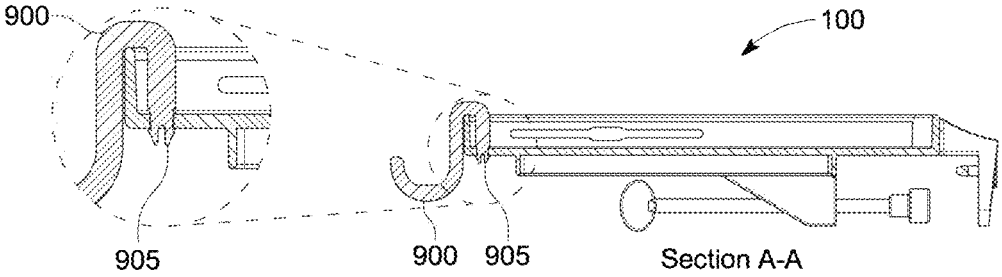
Figure 15A:
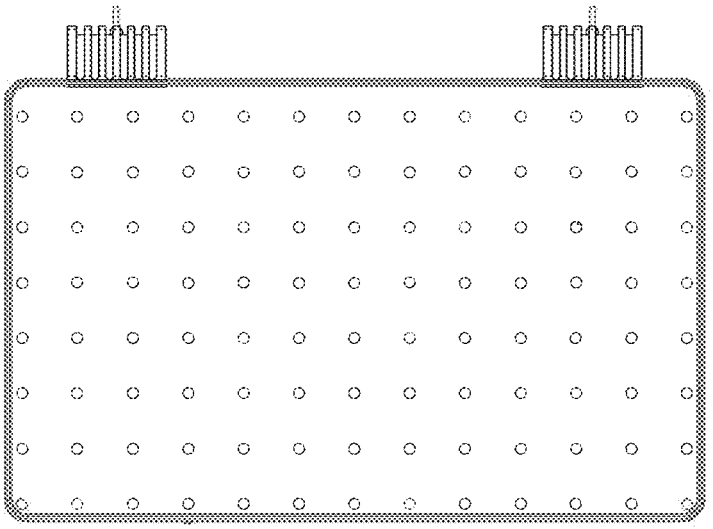
FIGS. 15A-15K illustrate aspects of a utility tray according to an embodiment of the invention.
Figure 15B:
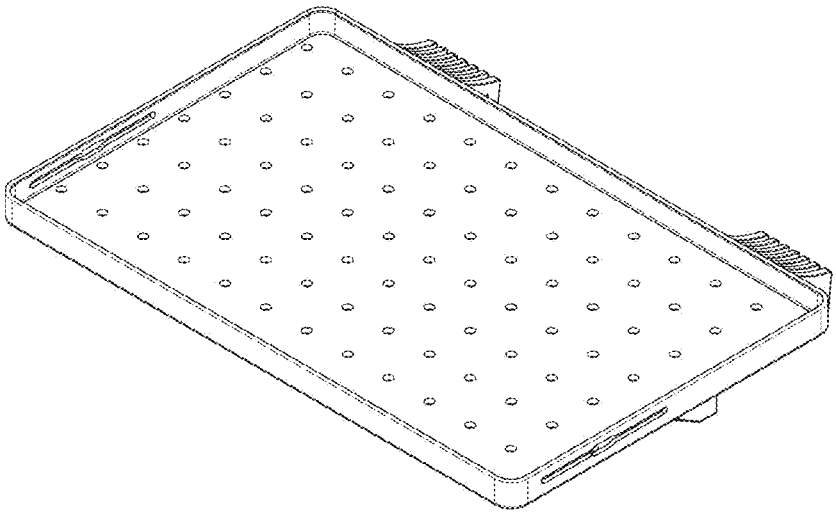
Figure 15C:
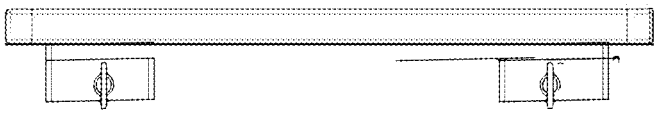
Figure 15D:
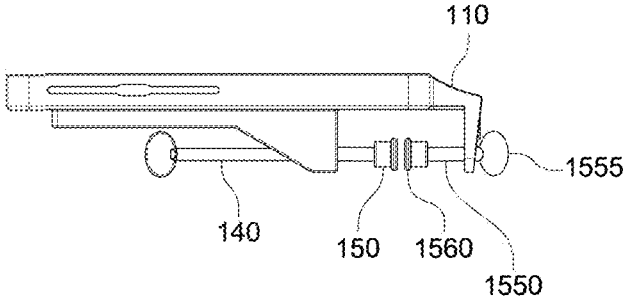
Figure 15E:
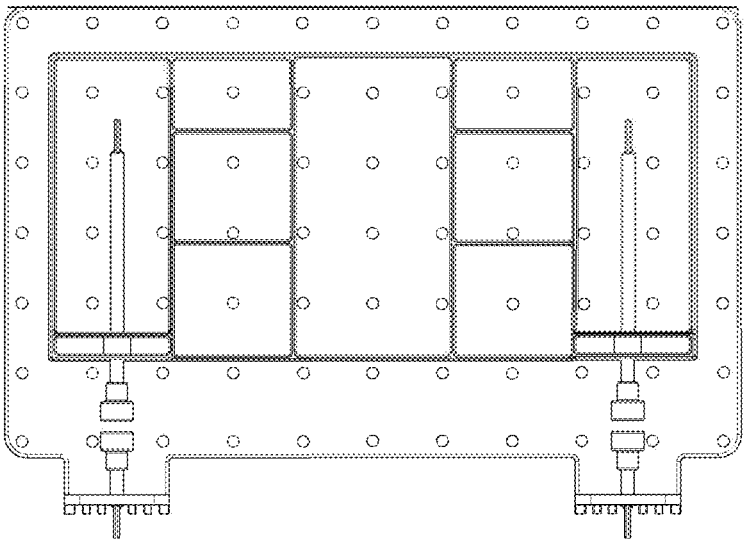
Figure 15F:
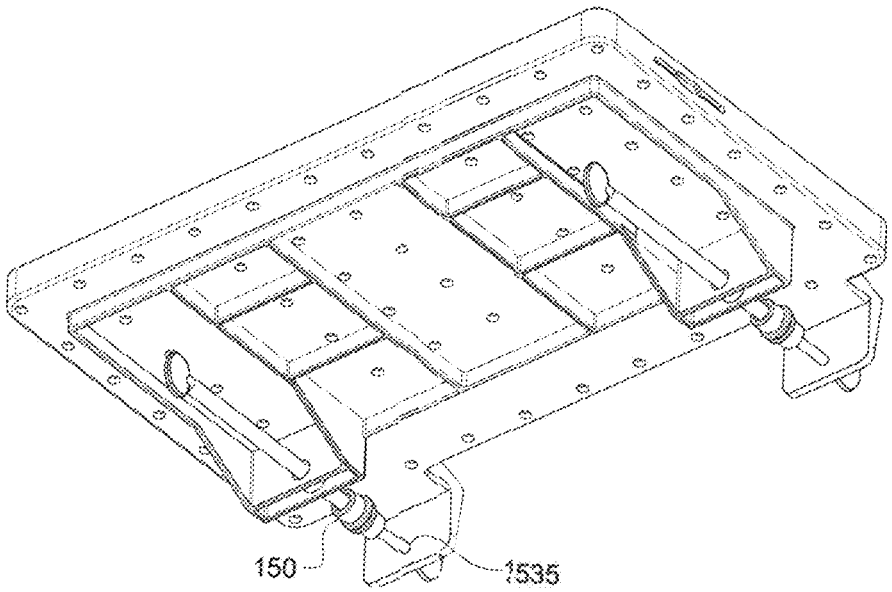
Figure 15G:
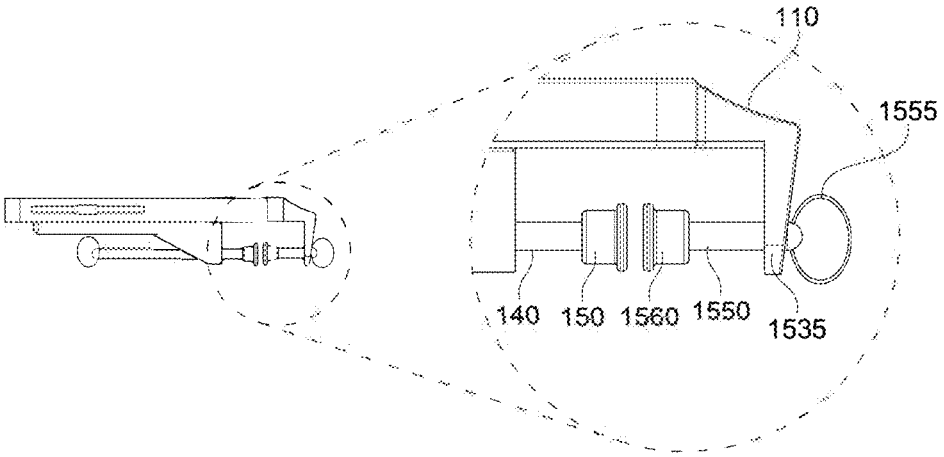
Figure 15H:
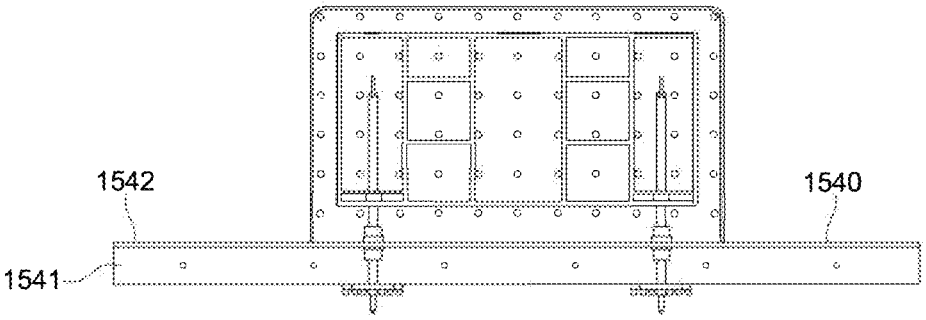
Figure 15I:
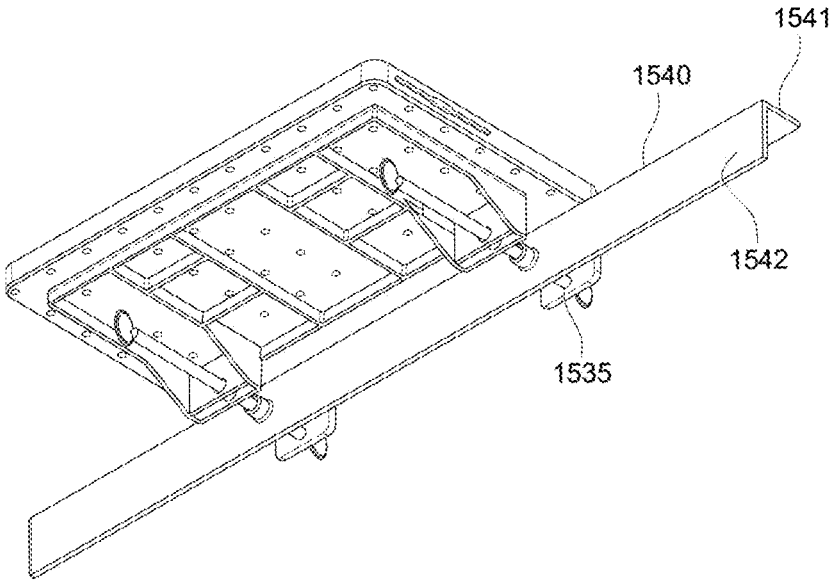
Figure 15J:
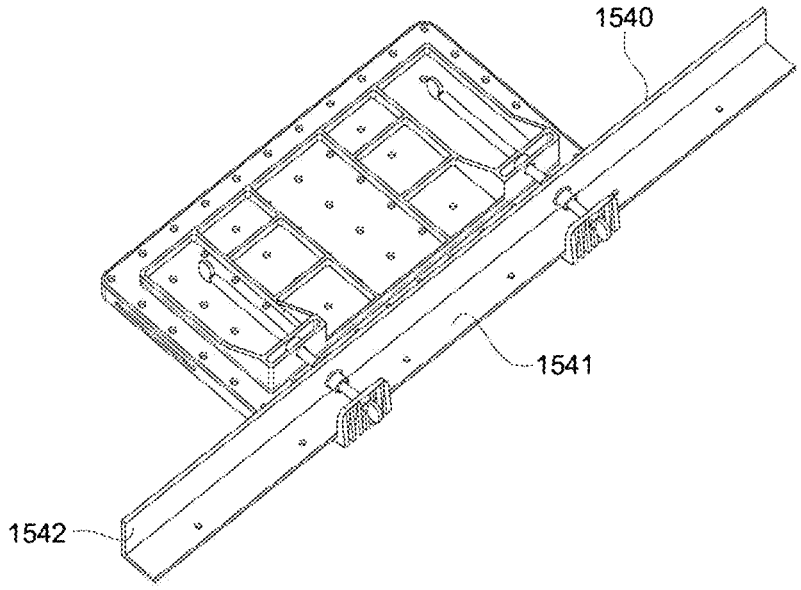
Figure 15K:
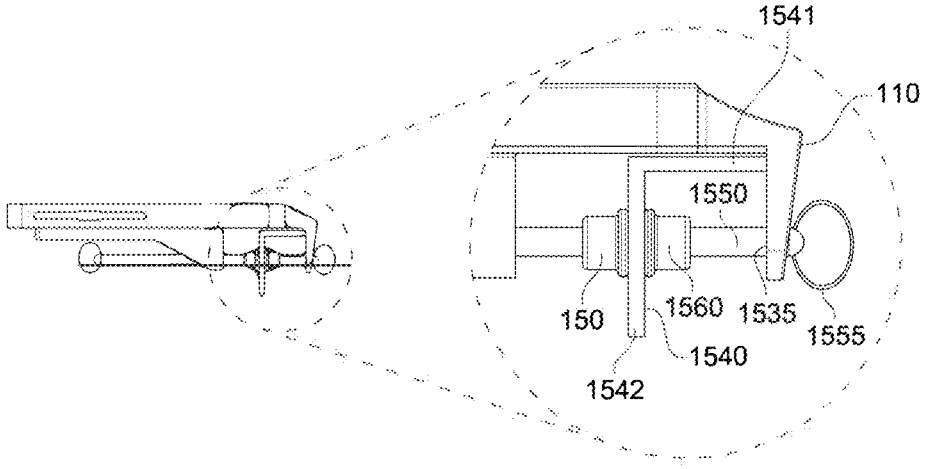

In one embodiment, with reference to FIGS. 6D, 6F, 7B, 7D, 7F, a vertical spacer (640, 740) is coupled to the bottom surface of base 105 next to edge 115 of the base to provide a vertical distance between the bottom surface of the base and a top surface of the support structure. Such spacing may be needed depending on other components coupled to the support structure. For example, as illustrated in FIGS. 4A and 4B, bed springs 436 are coupled at locations 437 to support structure 440 with sufficient horizontal clearance between the locations 437 and edge 115 of tray 100. However, if such horizontal clearance is not possible, then providing for vertical clearance with the use of vertical spacers, allows tray 100 to be firmly mounted to support structure 440 without contacting springs 436.

Figure 3A:
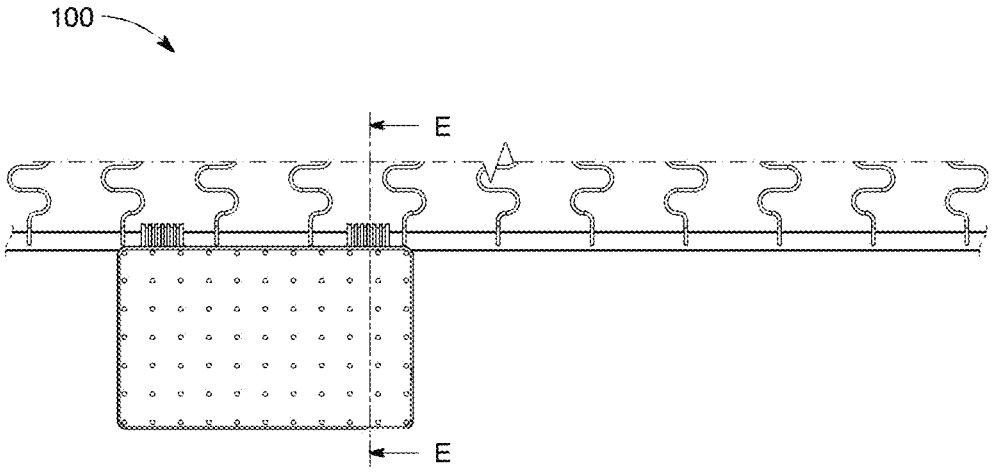
FIGS. 3A and 3B illustrate aspects of a utility tray according to an embodiment of the invention.
Figure 3B:
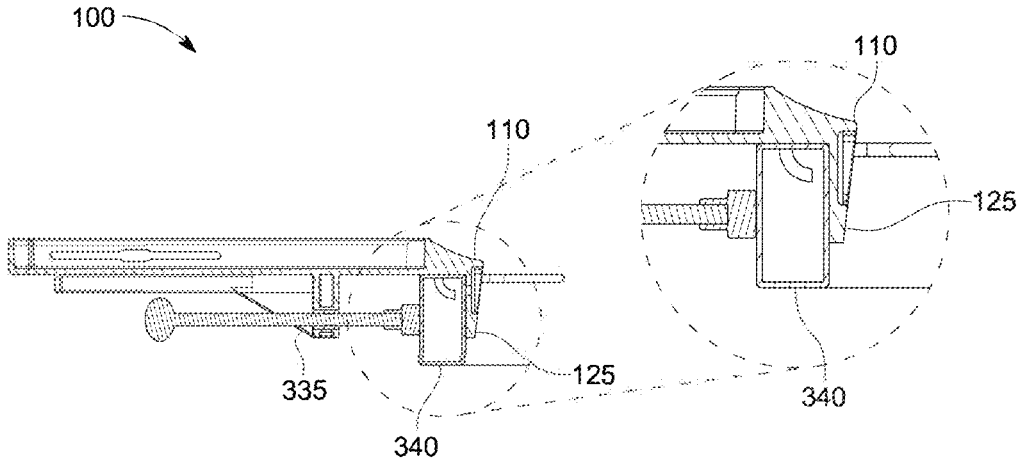

Quite commonly, with reference to FIGS. 3A and 3B, support structure 340 is a square or rectangular structure, for example, a hollow square or rectangular metal tube. In such a situation, vertically oriented side 125 of right-angle bracket 110 abuts a corresponding vertical side of support structure 340. However, with reference to FIGS. 1F, 2, 4A and 4B, it is contemplated that in some situations support structure 440 may be a right-angle support structure that has a horizontally oriented side 441 and a vertically oriented side 442 that extends downward from the horizontally oriented side 441. In such a situation, right-angle bracket 110 of tray 100 comprises a protruding member 260, 460 coupled to and extending from vertically oriented side 125 of right-angle bracket 110 of tray 100 in a substantially horizontal direction under at least a portion of the horizontally oriented side 441 of right-angle support structure 440. The protruding member 260, 460 in one embodiment comprises a pin or peg or nibble section 261, 461 that can pass through a corresponding hole 163, 263, 463 in right-angle bracket 110, and a head 262, 462. Once the tray with right-angle bracket 110 is positioned on support structure 440, protruding member 260, 460 may be installed by inserting peg 261, 461 into hole 163, 263, 463 and pushing on head 262, 462 until the head contacts vertically oriented surface 125.

The protruding member is positioned underneath the bottom surface of horizontally oriented side 441 of right-angle support structure 440 such that when downward pressure is applied to tray 100, the protruding member contacts the bottom surface of horizontally oriented side 441 of right-angle support structure 440 and prevents right-angle bracket 110 from rotating about or slipping on right-angle support structure 440, thereby preventing tray 100 from declining from its substantially horizontal orientation when weight or downward force is applied to tray 100.

While the embodiment illustrated herein shows the protruding member 260, 460 in the form of a peg, it is appreciated that the protruding member may be other shapes and sizes, such as a tab or lip extending in a horizontal direction from vertically oriented side 125 of right-angle bracket 110. For example, with reference to FIGS. 7B, 7D, 7E and 7F, protruding member 760 forms a tab or lip that declines from a horizontal plane as it extends from the vertically oriented side of bracket 710. In this embodiment, a portion of the protruding member 760 contacts at least a portion of the horizontally oriented side of a right-angle support structure.

In one embodiment of the invention illustrated in FIGS. 5A-5F, tray 100 is capable of being frictionally engaged to a support structure 540. The tray includes a horizontally oriented planar base 105 having an edge 115, and a right-angle bracket 510 molded or coupled proximate the edge of the base. The right-angle bracket has a horizontally oriented side 515 extending in a direction parallel to a plane of the base and capable of abutting a top horizontally oriented surface 541 of support structure 540, and a vertically oriented side 520 coupled to the horizontally oriented side of the right-angle bracket at a corner of the right-angle bracket and extending downward. The inside surface of the vertically oriented side can abut a vertical surface 542 of support structure 540. A strap 525 is capable of being coupled to an end or edge 530 of the horizontally oriented side of the right-angle bracket and extended around the support structure and to an end or edge 535 of the vertically oriented side of the right-angle bracket. The strap can be tightened to frictionally engage the right-angle bracket with the support structure.

Thus, this embodiment describes a tray, capable of being frictionally engaged to a support structure. The tray comprises a horizontally oriented planar base having an edge, a right-angle bracket coupled proximate the edge of the base, the right-angle bracket having: a horizontally oriented side extending in a direction parallel to a plane of the base and capable of abutting a top horizontally oriented surface of the support structure, and a vertically oriented side coupled to the horizontally oriented side of the right-angle bracket at a corner of the right-angle bracket and extending downward, an inside surface of which is capable of abutting a vertical surface of the support structure. The embodiment further comprises a strap that can be coupled to an edge of the horizontally oriented side of the right-angle bracket, extended around the support structure and to an edge of the vertically oriented side of the right-angle bracket, and tightened to frictionally engage the right-angle bracket with the support structure.

In one embodiment of the invention illustrated in FIGS. 6A-6F, rather than the right-angle bracket 110 in the embodiments discussed above, this embodiment uses only a vertical bracket 610, that is, a bracket that extends downward in a vertical direction from edge 115 of tray 100. This embodiment includes a protruding member 660 which serves the same purpose as described above. Thus, in this embodiment, tray 100 is capable of being frictionally engaged to a right-angle support structure that has a horizontally oriented side and a vertically oriented side that extends downward from the horizontally oriented side. As in the previously described embodiments, the tray includes a horizontally oriented planar base 105 having an edge 115. The vertical bracket 610 is molded or coupled adjacent the edge of base 105 and extends downward in a direction substantially normal to the base. The protruding member 660 is coupled to and extends from the vertical bracket 610 in a substantially horizontal direction under at least a portion of the horizontally oriented side of the right-angle support structure. Another bracket 130 is coupled to a bottom surface of the base and extends downward in the direction substantially normal to the base. Bracket 130 is positioned opposite bracket 610 a sufficient horizontal distance to form a channel in which to receive the support structure positioned therebetween. A screw 140 comprises a head or handle 145 at a first end of the screw and a shoe 150 at a second end of the screw. The second end of the screw passes through a threaded hole 635 of bracket 130 and extends toward bracket 610, wherein movement of (e.g., turning) the handle causes shoe 150 and bracket 610 to frictionally engage the support structure positioned therebetween. While this embodiment illustrates a vertical spacer 640, it is appreciated that the vertical spacer is an optional feature.

Thus, this embodiment describes a tray, capable of being frictionally engaged to a right-angle support structure that has a horizontally oriented side and a vertically oriented side that extends downward from the horizontally oriented side. The tray comprises a horizontally oriented planar base having an edge, a first bracket coupled adjacent the edge of the base and extending downward in a direction substantially normal to the base, a protruding member coupled to and extending from the first bracket in a substantially horizontal direction under at least a portion of the horizontally oriented side of the right-angle support structure, a second bracket, having a threaded hole, coupled to a bottom surface of the base and extending downward in the direction substantially normal to the base, the second bracket positioned opposite the first bracket a horizontal distance sufficient to form a channel in which to receive the support structure positioned therebetween, and a screw comprising a handle at a first end of the screw and a shoe at a second end of the screw, the second end of the screw passing through the threaded hole of the second bracket and extending toward the first bracket, wherein movement of the handle causes the shoe and the first bracket to frictionally engage the support structure positioned therebetween.

Finally, another embodiment is illustrated in FIGS. 8A-8F. This embodiment involves a tray 100 capable of being frictionally engaged to a support structure (not shown in the figures) as well. The tray includes a horizontally oriented planar base 105 having an edge 115, and a right-angle bracket 810 coupled proximate the edge of the base. The right-angle bracket has a horizontally oriented side 815 extending in a direction parallel to a plane of the base that is capable of abutting a top, horizontally oriented, surface of the support structure. The right-angle bracket further has a vertically oriented side 820 coupled to the horizontally oriented side of the right-angle bracket at a corner of the right-angle bracket and extending downward. An inside surface 825 of the vertically oriented side 820 can abut a vertical surface of the support structure.

This embodiment further includes a bracket 830, having a threaded hole 835, the bracket extending downward in a direction substantially normal to the base and positioned opposite the right-angle bracket a sufficient horizontal distance to form a channel in which to receive the support structure positioned therebetween. A screw 840 passes through threaded hole 835 of bracket 830 and can engage a threaded hole 816 of right-angle bracket 810, wherein turning the screw while the screw is engaged with threaded hole 816 of right-angle bracket 810 shortens the horizontal distance between bracket 830 and right-angle bracket 810, thereby causing bracket 830 and right-angle bracket 810 to frictionally engage the support structure positioned therebetween. In some situations, the support structure is a right-angle support structure that has a horizontally oriented side and a vertically oriented side that extends downward from the horizontally oriented side. In such situations, the bracket 830 comprises a protruding member 860 coupled to and extending from bracket 830 in a substantially horizontal direction under at least a portion of the horizontally oriented side of the right-angle support structure.

It is contemplated that at least a portion of the protruding member 860 coupled to bracket 830 extends in the substantially horizontal direction under at least the portion of the horizontally oriented side of the right-angle support structure and may abut the portion of the horizontally oriented side of the right-angle support structure.

Thus, this embodiment describes a tray, capable of being frictionally engaged to a support structure. The tray comprises a horizontally oriented planar base having an edge, a right-angle bracket coupled proximate to the edge of the base, the right-angle bracket having: a horizontally oriented side extending in a direction parallel to a plane of the base, having a threaded hole, and capable of abutting a top, horizontally oriented, surface of the support structure, and a vertically oriented side coupled to the horizontally oriented side of the right-angle bracket at a corner of the right-angle bracket and extending downward, an inside surface of which is capable of abutting a vertical surface of the support structure. This embodiment further comprises a bracket, having a threaded hole, the bracket extending downward in a direction substantially normal to the base and positioned opposite the right-angle bracket a horizontal distance sufficient to form a channel in which to receive the support structure positioned therebetween, a screw passing through the threaded hole of the bracket and capable of engaging the threaded hole of the right-angle bracket, wherein turning the screw while the screw is engaged with the threaded hole of the right-angle bracket shortens the horizontal distance between the bracket and the right-angle bracket, thereby causing the bracket and right-angle bracket to frictionally engage the support structure positioned therebetween.

In this embodiment, the support structure may be a right-angle support structure that has a horizontally oriented side and a vertically oriented side that extends downward from the horizontally oriented side, and the bracket may be a protruding member coupled to and extending from the bracket in a substantially horizontal direction under at least a portion of the horizontally oriented side of the right-angle support structure.

In this embodiment, at least a portion of the protruding member coupled to and extending from the bracket in the substantially horizontal direction under at least the portion of the horizontally oriented side of the right-angle support structure abuts the portion of the horizontally oriented side of the right-angle support structure.

With reference to FIGS. 15A-15K, it is contemplated that in some situations support structure 1540 may be a right-angle support structure that has a horizontally oriented side 1541 and a vertically oriented side 1542 that extends downward from the horizontally oriented side 1541. In such a situation, right-angle bracket 110 of tray 100 includes a threaded hole 1535. A threaded fixing, for example, a bolt, or a screw, 1550 comprising a head or handle 1555 at a first end of the screw and a shoe 1560 at a second end of the screw is inserted through threaded hole 1535 such that the second end of the screw passes through the threaded hole of right-angle bracket 110 and extends toward the vertically oriented side 1542 of right-angle support structure 1540. Turning the head or the handle 1555 of screw 1550 causes the shoe 1560 to move toward, engage and trap the vertically oriented side of right-angle support structure between shoe 1560 and the opposing shoe 150 of screw or bolt 140. As the head or handle 1555 is turned after the support structure is trapped between shoes 150 and 1560, the shoes frictionally engage the vertically oriented side of the support structure positioned therebetween. In this manner, items (e.g., a laptop computer, a book, and various accessories, etc.) can be placed on and weigh down the tray, or an upward force could be applied to the tray, for example, someone pulling up on the tray, and yet the tray is held firm in a substantially horizontal position to the right-angle support structure. While the embodiments illustrated in FIGS. 15A-15K and 16A, 16B contemplate use of a right-angle bracket, it is appreciated that this embodiment may be adapted to use a vertical bracket, such as described in the embodiment of the invention illustrated in FIGS. 6A-6F, which uses only a vertical bracket 610, that is, a bracket that extends downward in a vertical direction from edge 115 of tray 100. This embodiment may also optionally make use of a vertical spacer 640, as described in the embodiment of the invention illustrated in FIGS. 6A-6F.

Figure 16A:
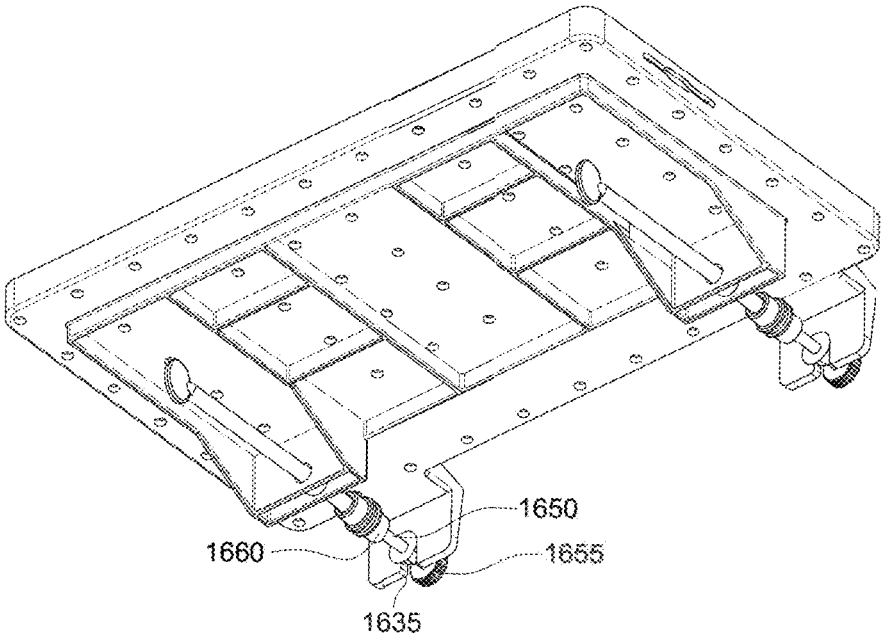
FIGS. 16A and 16B illustrate aspects of a utility tray according to an embodiment of the invention.
Figure 16B:
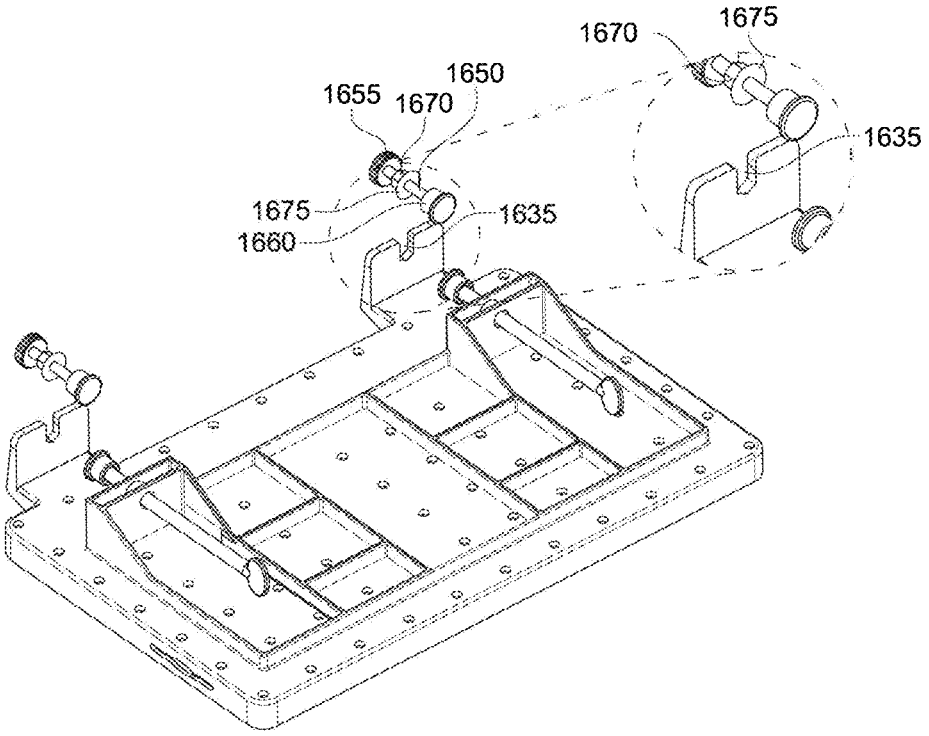
Figure 17A:
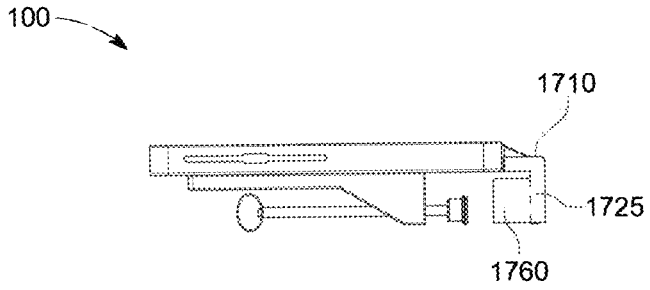
FIGS. 17A-17H illustrate aspects of a utility tray according to an embodiment of the invention.
Figure 17B:
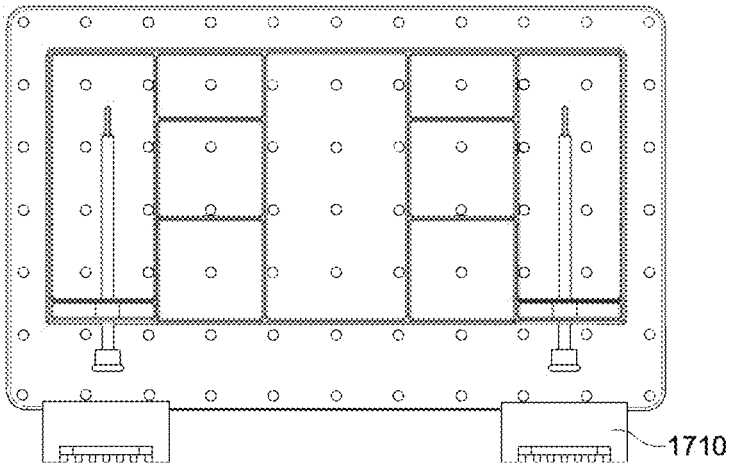
Figure 17C:
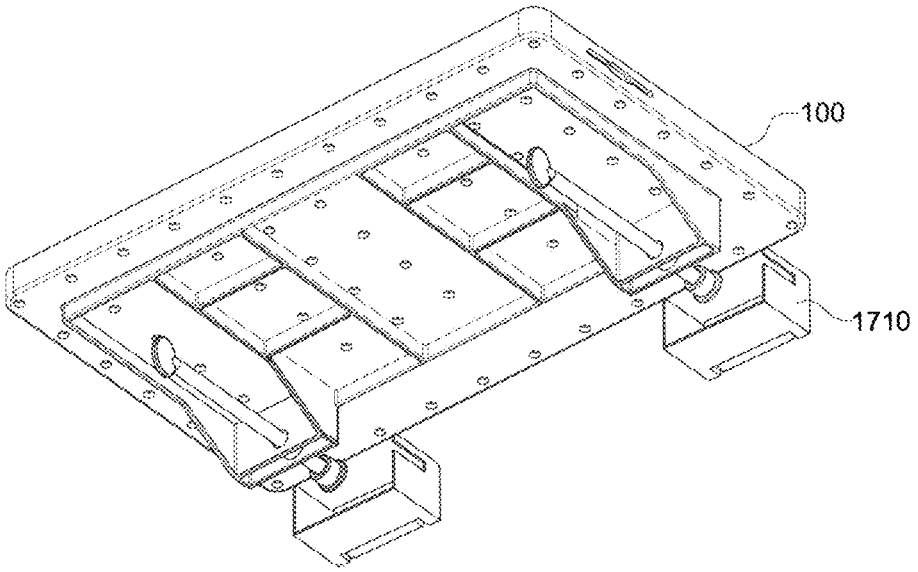
Figure 17D:
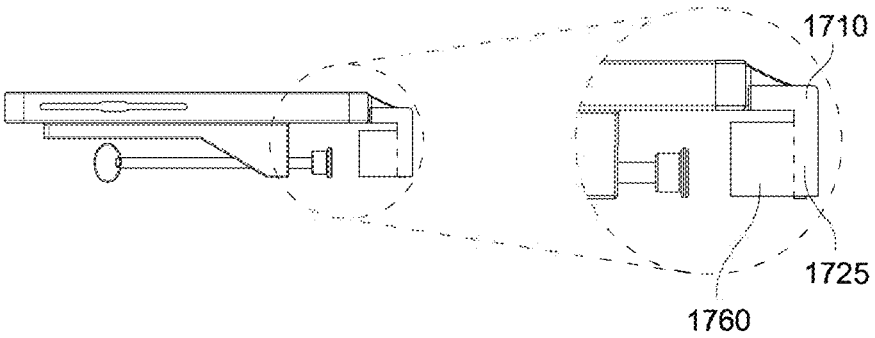
Figure 17E:
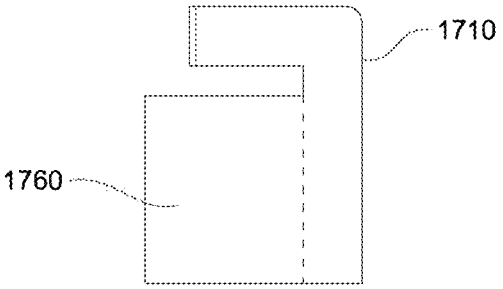
Figure 17F:
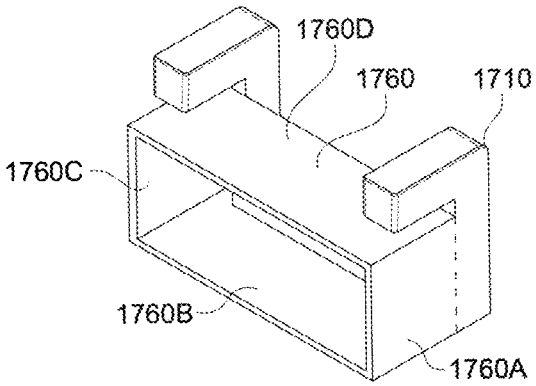
Figure 17G:
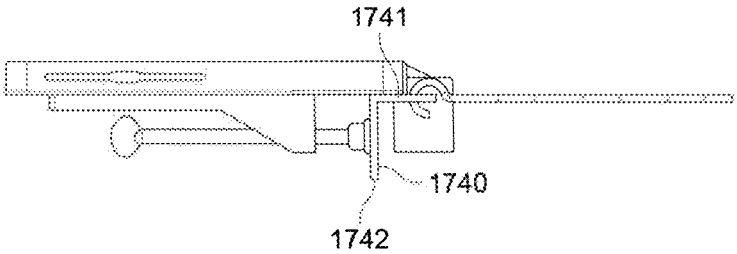
Figure 17H:
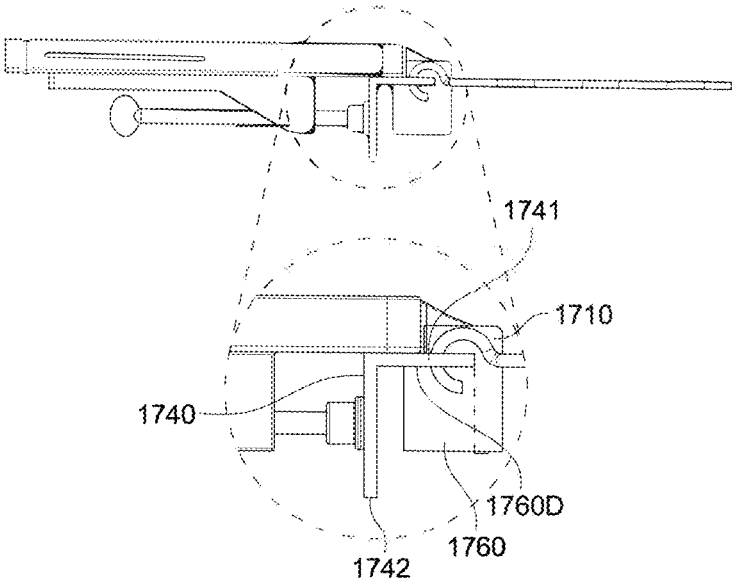

In an alternative embodiment illustrated in FIGS. 16A and 16B, right-angle bracket 110 of tray 100 includes a polygonal shaped slot 1635 instead of a threaded hole. A threaded fixing, for example, a bolt, or a screw 1650 comprising a head or handle 1655 at a first end of the screw, a shoe 1660 at a second end of the screw, and a similarly sized and shaped polygonal shaped nut threaded onto a midsection of the screw 1650, is inserted through slot 1635 such that the second end of the screw passes through the slot of right-bracket 110 and extends toward the vertically oriented side of right-angle support structure. In particular, polygonal shaped nut 1670, appropriately dimensioned and positioned, is inserted into slot 1635. Turning the head or the handle 1655 of screw 1650 causes the screw to turn, while nut 1670 is held in place by slot 1635 and does not rotate as the screw is turned. Turning the head causes shoe 1660 to move toward, engage and trap the vertically oriented side of right-angle support structure between shoe 1660 and the opposing shoe 150 of screw or bolt 140. A washer 1675 prevents nut 1670 from leaving slot 1635 as the shoe 1660 is moved toward and engages the vertically oriented side of right-angle support structure. As the head or handle 1655 is turned after the support structure is trapped between shoes 150 and 1660, the shoes frictionally engage the vertically oriented side of the support structure positioned therebetween. In this manner, items (e.g., a laptop computer, a book, and various accessories, etc.) can be placed on and weight down the tray, or an upward force could be applied to the tray, for example, someone pulling up on the tray, and yet the tray is held firm in a substantially horizontal position to the right-angle support structure.

As noted above, and with reference to FIGS. 17A-17H, it is contemplated that in some situations support structure 1740 may be a right-angle support structure that has a horizontally oriented side 1741 and a vertically oriented side 1742 that extends downward from the horizontally oriented side 1741. In such a situation, a right-angle bracket 1710 of tray 100 comprises a protruding member in the form of block 1760 integrated with (e.g., molded as part of) and extending from vertically oriented side 1725 of right-angle bracket 1710 of tray 100 in a substantially horizontal direction under at least a portion of the horizontally oriented side 1741 of right-angle support structure 1740. The block 1760 in one embodiment is hollow, defined by four walls, including a first side wall 1760A, a bottom wall 1760B, a second side wall 1760C and top wall 1760D. In another embodiment, the block may be a solid block. Once the tray with right-angle bracket 1710 is positioned on support structure 1740, the top surface of top wall 1760D is positioned just underneath the bottom surface of horizontally oriented side 1741 of right-angle support structure 1740 such that when downward or upward pressure is applied to tray 100, the block 1760 contacts the bottom surface of horizontally oriented side 1741 of right-angle support structure 1740 and prevents right-angle bracket 1710 from rotating about or slipping on right-angle support structure 1740, thereby preventing tray 100 from declining or inclining from its substantially horizontal orientation when downward or upward force is applied to tray 100.

Figure 18A:
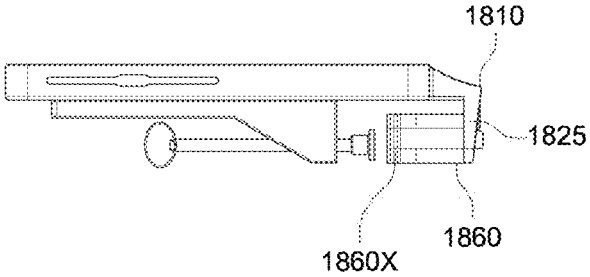
FIGS. 18A-18I illustrate aspects of a utility tray according to an embodiment of the invention.
Figure 18B:
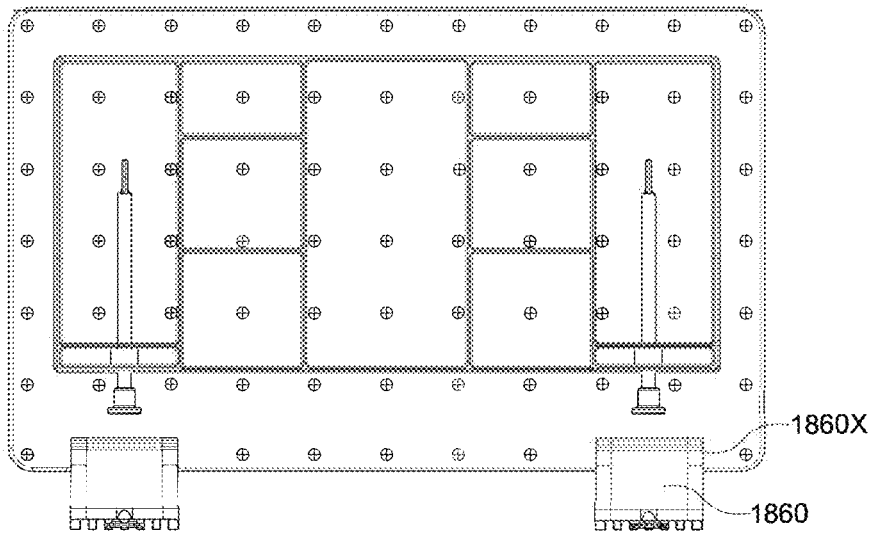
Figure 18C:
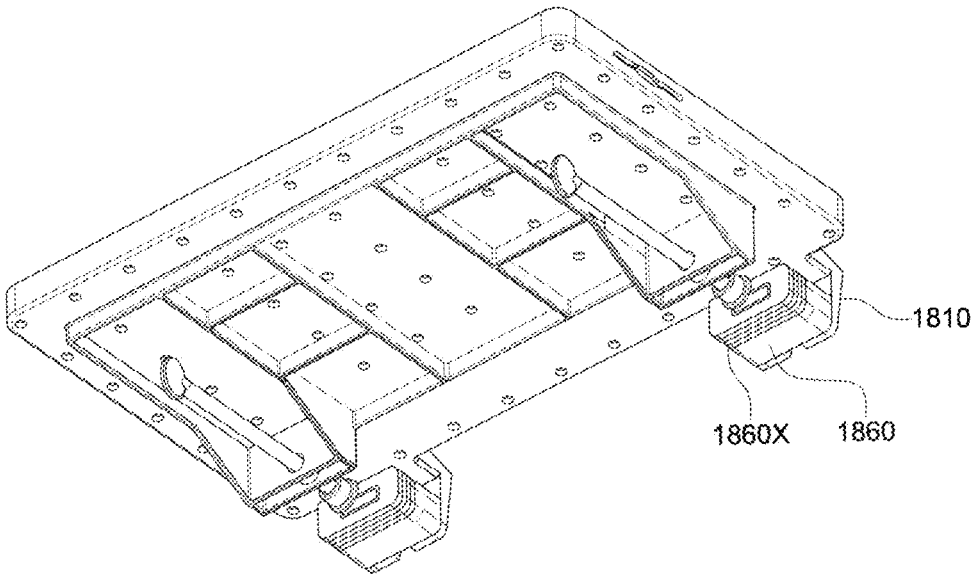
Figure 18D:
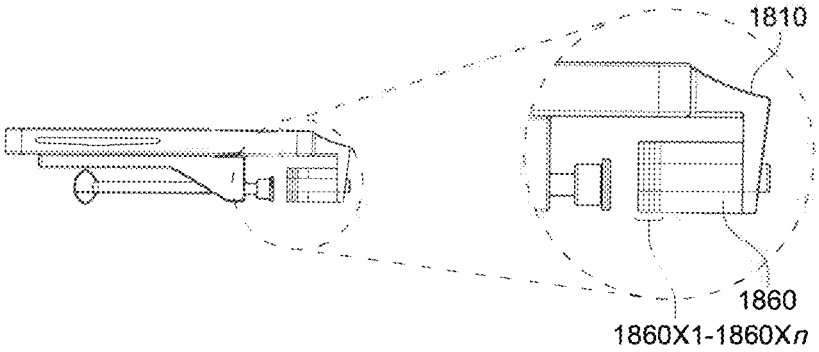
Figure 18E:
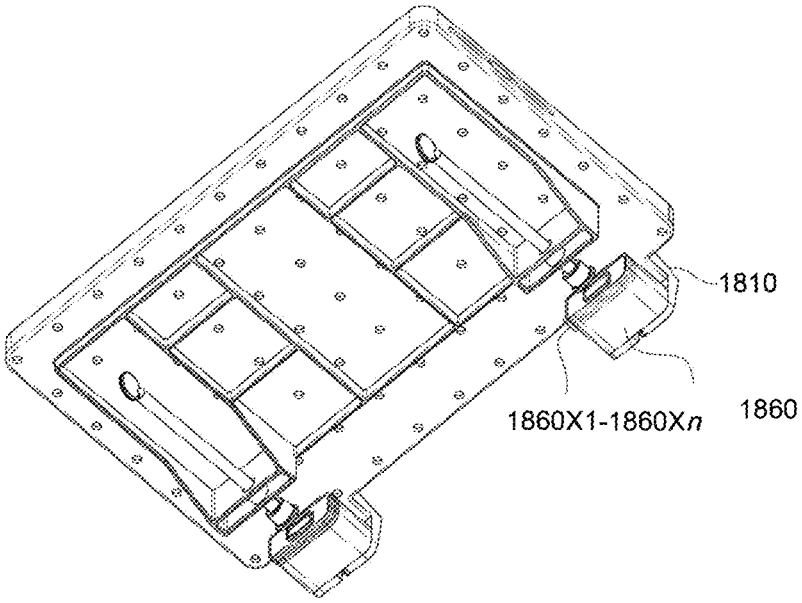
Figure 18F:
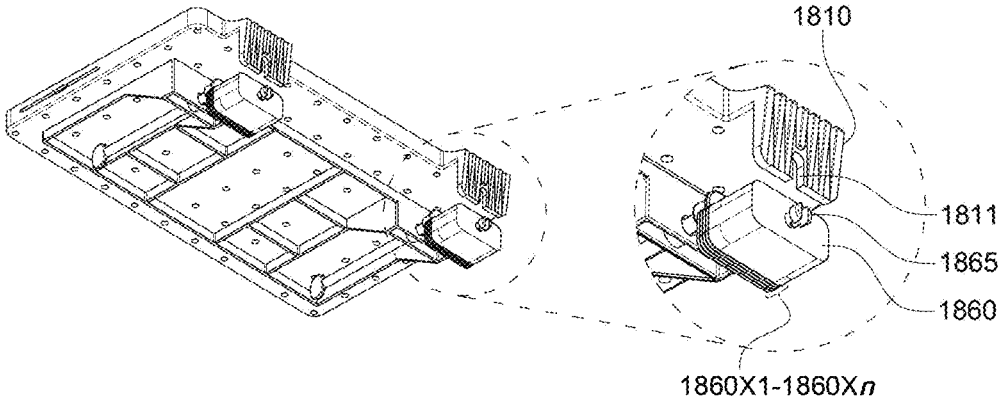
Figure 18G:
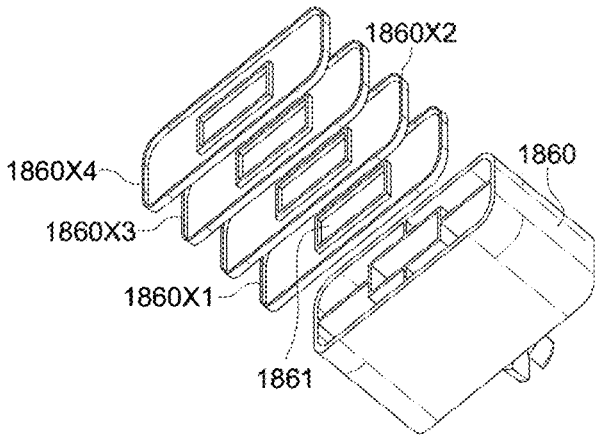
Figure 18H:
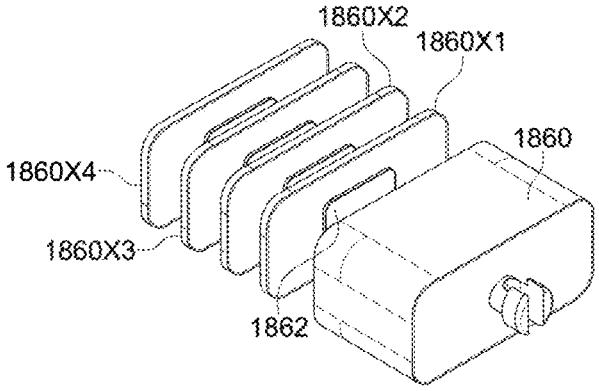
Figure 18I:
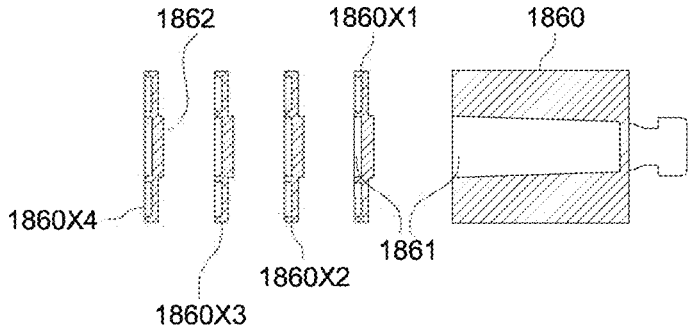

With reference to FIGS. 17H and 18A-18I, it is contemplated that in some situations support structure 1740 may be a right-angle support structure that has a horizontally oriented side 1741 and a vertically oriented side 1742 that extends downward from the horizontally oriented side 1741. In such a situation, a right-angle bracket 1810 of tray 100 comprises a protruding member in the form of block 1860 coupled to and extending from vertically oriented side 1825 of right-angle bracket 1810 of tray 100 in a substantially horizontal direction under at least a portion of the horizontally oriented side 1741 of right-angle support structure 1740. The coupling, for example, is accomplished with a peg 1865 on block 1860 inserted through a hole or slot 1811 as illustrated in FIG. 18F. Once the tray with right-angle bracket 1810 is positioned on support structure 1740, the top surface of block 1860 is positioned underneath the bottom surface of horizontally oriented side 1741 of right-angle support structure 1740 such that when downward or upward pressure is applied to tray 100, the block 1860 contacts the bottom surface of horizontally oriented side 1741 of right-angle support structure 1740 and prevents right-angle bracket 1810 from rotating about or slipping on right-angle support structure 1740, thereby preventing tray 100 from declining or inclining from its substantially horizontal orientation when downward or upward force is applied to tray 100. Additionally, one or more horizontally extending members 1860X1-1860Xn may be snapped into place to horizontally lengthen the block 1860 so that the block contacts vertically oriented side 1742 of right-angle support structure 1740 when the tray is positioned on support structure 1740. For example, FIGS. 18G, 18H, and 18I illustrate four horizontally extending members 1860X1, 1860X2, 1860X3 and 1860X4 are snapped into place essentially to horizontally extend, or lengthen, block 1860 such that the block contacts vertically oriented side 1742 of right-angle support structure 1740 when the tray is positioned on support structure 1740. As illustrated in FIGS. 18G, 18H, and 18I, the block 1860 and the horizontally extending members 1860X1-1860Xn each have a recessed or frame portion 1861. Each horizontally extending member 1860X1-1860Xn further includes a corresponding protruding portion 1862 that snaps into the recessed or framed portion of an adjacent block 1860 or other horizontally extending member 1860X1-1860Xn.

Figure 19A:
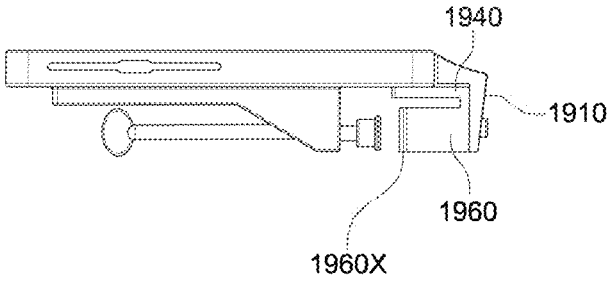
FIGS. 19A-19F illustrate aspects of a utility tray according to an embodiment of the invention.
Figure 19B:
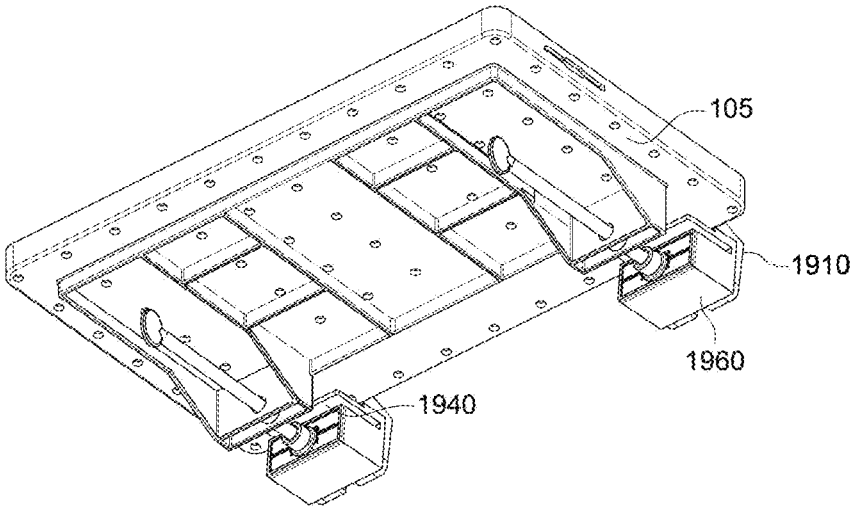
Figure 19C:
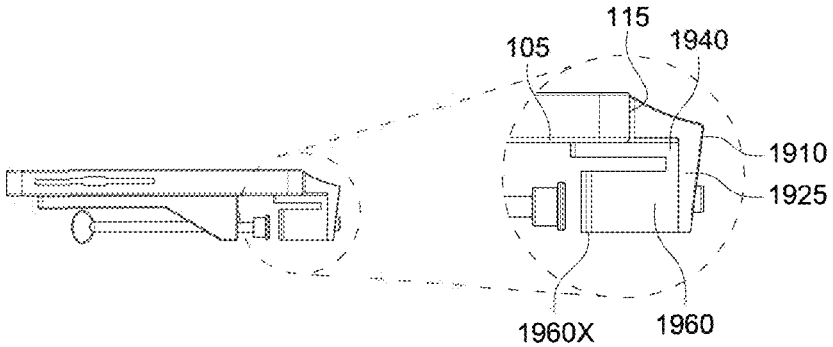
Figure 19D:
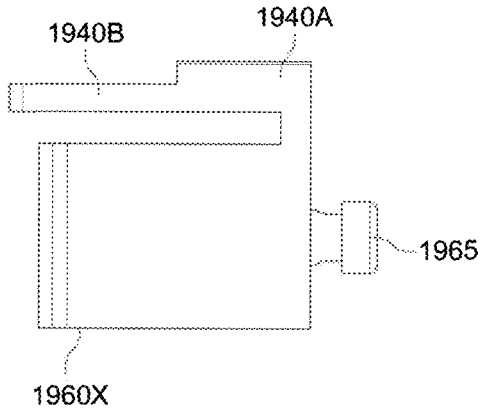
Figure 19E:
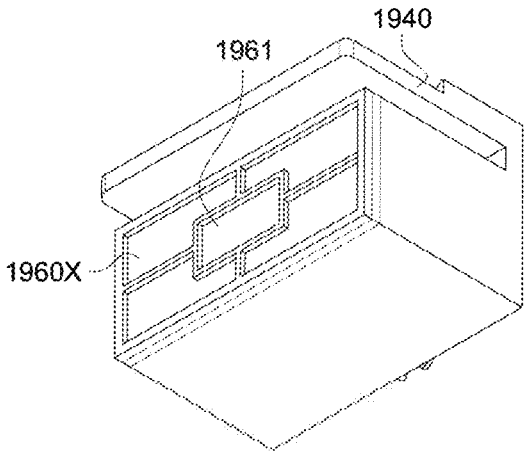
Figure 19F:
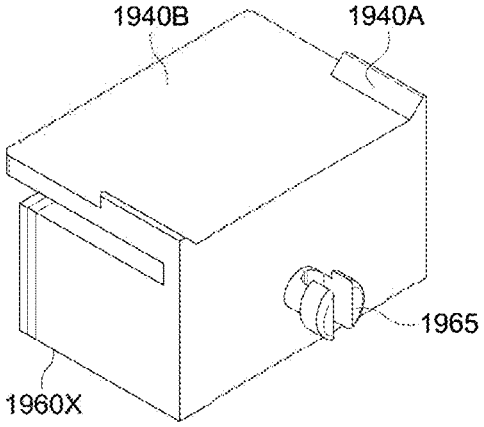
Figure 20A:
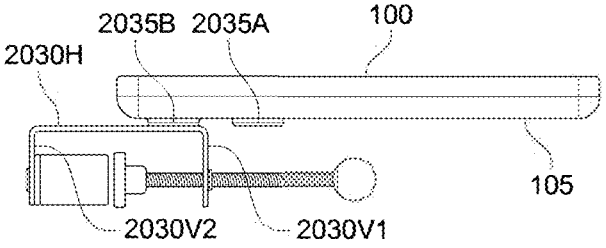
FIGS. 20A-20E illustrate aspects of a utility tray according to an embodiment of the invention.
Figure 20B:
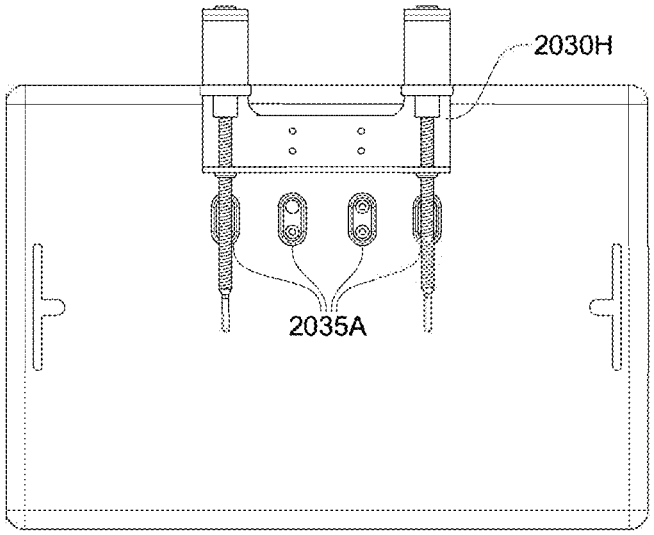
Figure 20C:
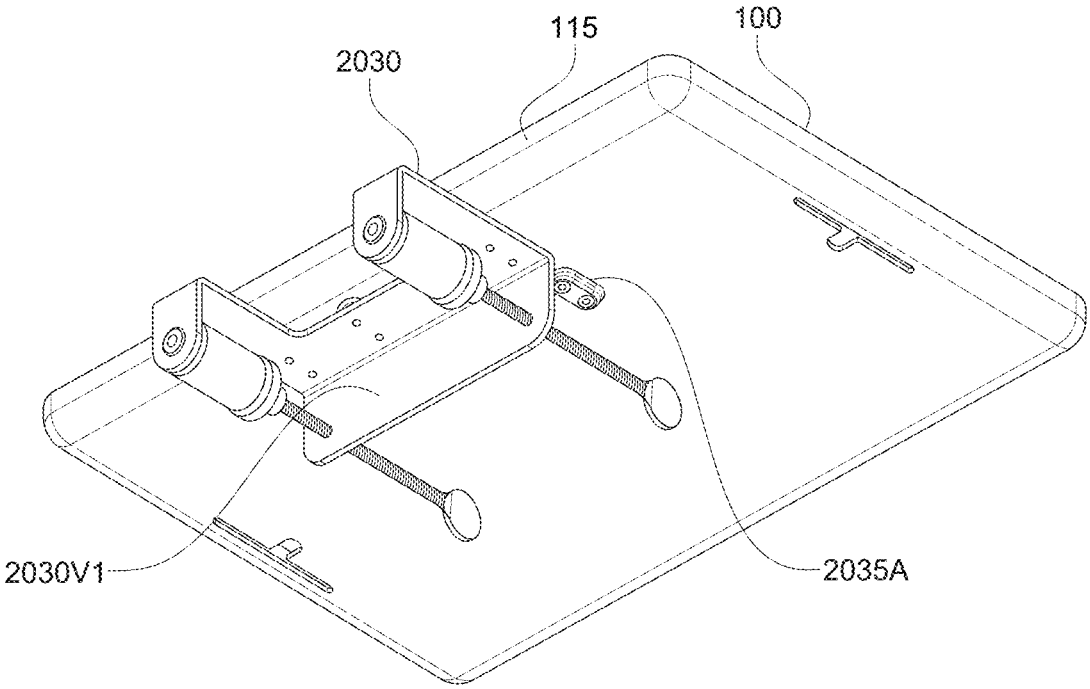
Figure 20D:
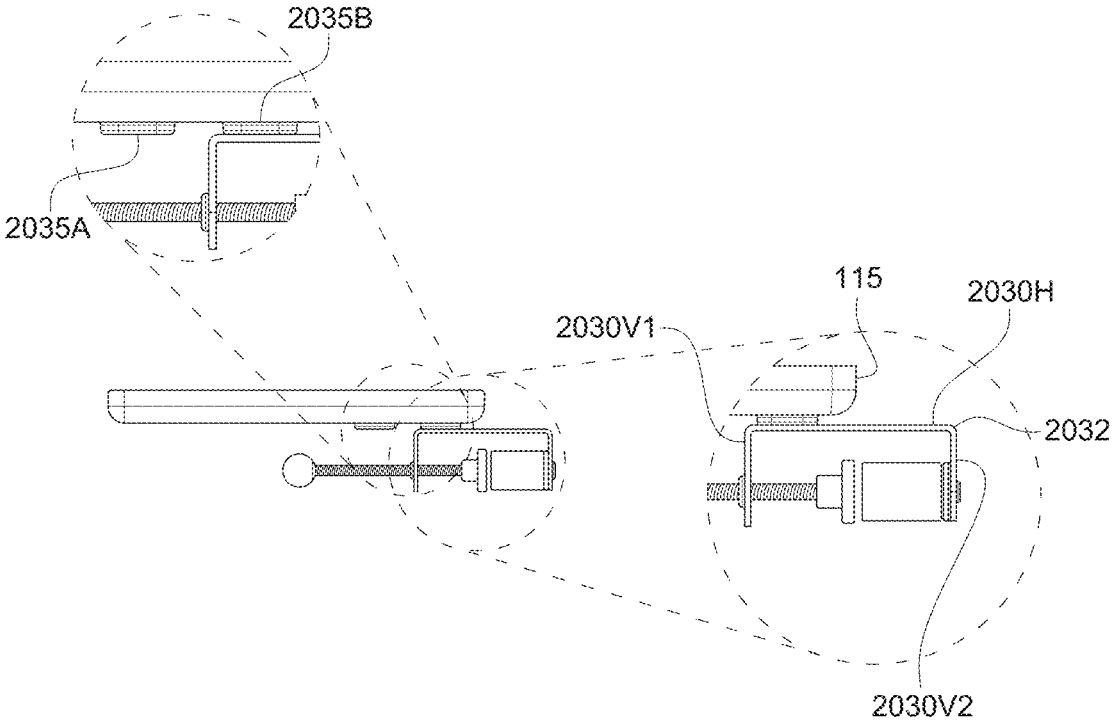
Figure 20E:
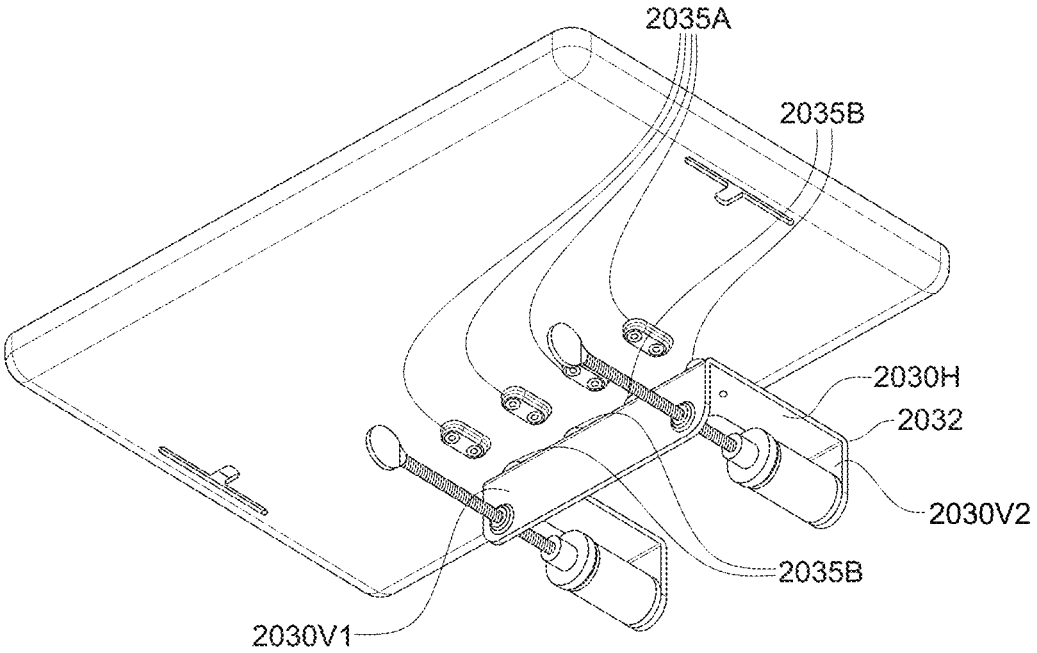

With reference to FIGS. 19A-19F, one embodiment combines one or more components from the embodiments described with respect to FIGS. 6A-6F, 7A-7F, 17A-17H and 18A-18I. In this embodiment, it is contemplated that support structure 1740 may be a right-angle support structure that has a horizontally oriented side 1741 and a vertically oriented side 1742 that extends downward from the horizontally oriented side 1741. In such a situation, a right-angle bracket 1910 of tray 100 comprises a protruding member in the form of block 1960 coupled to and extending from vertically oriented side 1925 of right-angle bracket 1910 of tray 100 in a substantially horizontal direction under at least a portion of the horizontally oriented side 1741 of right-angle support structure 1740. The coupling, for example, is accomplished with a peg 1965 as illustrated in FIGS. 19D and 19F on block 1960 inserted through a hole or slot of vertically oriented side 1925 of right-angle bracket 1910 of tray 100 (not shown). Once the tray with right-angle bracket 1910 is positioned on support structure 1740, the top surface of block 1960 is positioned underneath the bottom surface of horizontally oriented side 1741 of right-angle support structure 1740 such that when downward or upward pressure is applied to tray 100, the block 1960 contacts the bottom surface of horizontally oriented side 1741 of right-angle support structure 1740 and prevents right-angle bracket 1910 from rotating about or slipping on right-angle support structure 1740, thereby preventing tray 100 from declining or inclining from its substantially horizontal orientation when downward or upward force is applied to tray 100.

Additionally, one or more horizontally extending members 1960X1-1960Xn may be snapped into place to horizontally lengthen the block 1960 so that the block contacts vertically oriented side 1742 of right-angle support structure 1740 when the tray is positioned on support structure 1740. For example, FIGS. 19A and 19C-19F illustrate multiple horizontally extending members 1960X snapped into place essentially to horizontally extend, or lengthen, block 1960 such that the block contacts vertically oriented side 1742 of right-angle support structure 1740 when the tray is positioned on support structure 1740. Just like block 1860 and the horizontally extending members 1860X1-1860Xn described with reference to FIGS. 18A-18I, each horizontally extending member 1960X has a recessed or frame portion 1961. Each horizontally extending member 1960X further includes a corresponding protruding portion that snaps into the recessed or framed portion of an adjacent block 1960 or other horizontally extending member 1960X.

The embodiments illustrated in FIGS. 17A-17H, 18A-18I and 19A-19F contemplate use of a right-angle bracket. However, it is appreciated that these embodiments may be adapted to use a vertical bracket, such as described in the embodiment of the invention illustrated in FIGS. 6A-6F, which uses only a vertical bracket 610, that is, a bracket that extends downward in a vertical direction from edge 115 of tray 100. Additionally, component 1940 provides a vertical spacer to provide a similar function as the vertical spacers (640, 740) described with reference to FIGS. 6A-6F and 7A-7F. The vertical spacer 1940 is coupled to the block 1960 and abuts the bottom surface of base 105 next to edge 115 of the tray 100 to provide a vertical distance between the bottom surface of the base and a top surface of the support structure. Such spacing may be needed depending on other components coupled to the support structure. For example, as illustrated in FIGS. 4A and 4B, bed springs 436 are coupled at locations 437 to support structure 440 with sufficient horizontal clearance between the locations 437 and edge 115 of tray 100. However, if such horizontal clearance is not possible, then providing for vertical clearance with the use of vertical spacers such as spacer 1940 allows tray 100 to be firmly mounted to support structure 430 without contacting springs 436.

With reference to FIGS. 20A-20E, the tray 100 has one or more brackets or channels 2030 with a horizontally oriented portion 2030H coupled to a bottom surface of the base 105 and a first vertically oriented portion 2030V1 extending downward in the direction substantially normal to the base. The bracket 2030 may be mounted to the bottom surface of base 105 at different locations. For example, as illustrated FIGS. 20A-20E, a bracket 2030 may be mounted along a line comprising a plurality of mounting locations 2035A, or along a line comprising a second plurality of mounting locations 2035B. Additionally, according to an embodiment, bracket 2030 can include a second vertically oriented portion 2030V2 that functions in the same manner as, for example, bracket 110 illustrated, for example, in FIGS. 1A-1F, so that a single component 2030 comprising two brackets 2030V1 and 2030V2 can be mounted at different locations at the bottom surface of base 105 with sufficient horizontal distance between the brackets 2030V1 and 2030V2 to form a channel in which to receive a support structure, such as support structure 340 or 440 illustrated in FIGS. 3B and 4B. In this embodiment, for example, it is possible to couple component 2030 to the line of mounts illustrated at 2035A, in which case bracket 2030V2 extends downward in a vertical direction from edge 115 of tray 100. Alternatively, it is possible to couple component 2030 to the line of mounts illustrated at 2035B, in which case the vertical bracket 2030V2 is offset from edge 115 of tray 100 where it extends downward in a vertical direction, in the same manner as illustrated with the right-angle bracket 110 illustrated in FIGS. 1A-1F, where the vertical portion 125 of right-angle bracket 110 extends downward in a vertical direction. The horizontally oriented portion 2030H extends in a direction parallel to a plane of the base, and then vertically oriented bracket 2030V2 extends from the horizontally oriented portion at a common corner 2032 and extends downward.

Figure 21A:
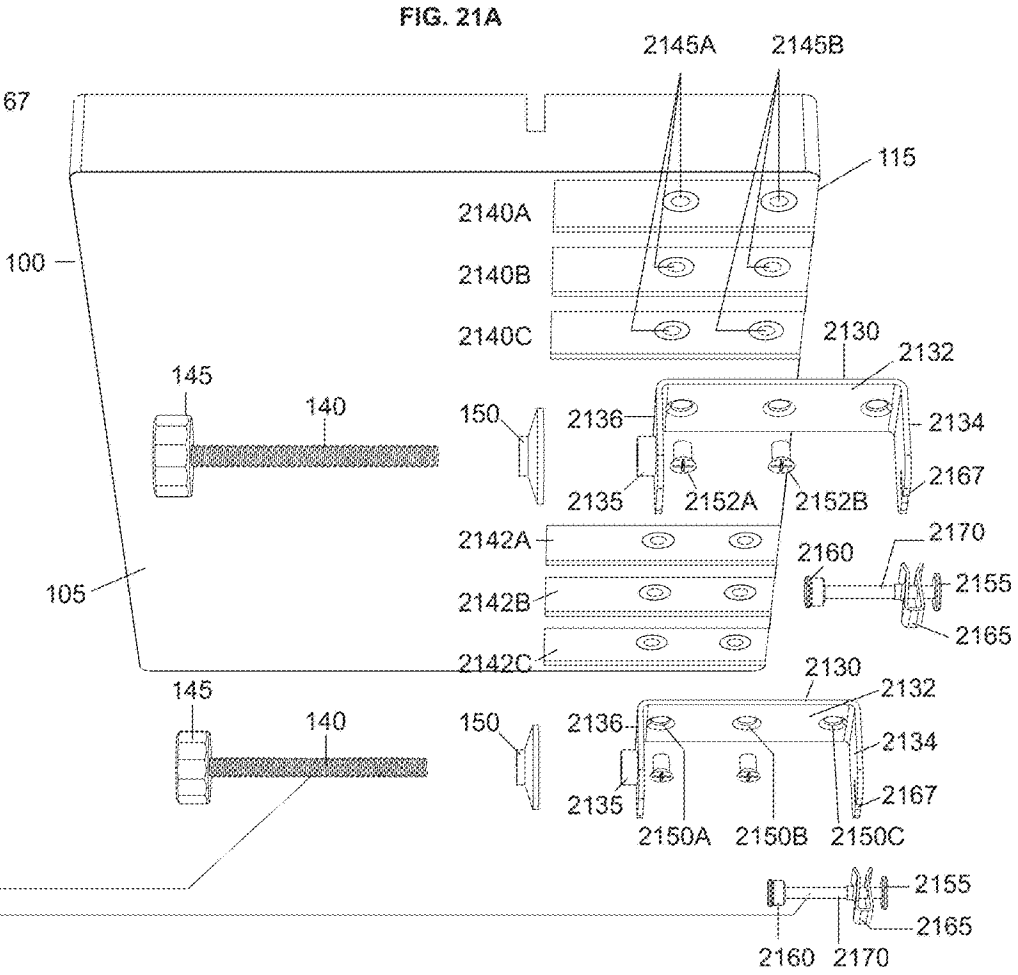
FIGS. 21A-21AJ illustrate alternative embodiments of the utility tray.
Figure 21B:
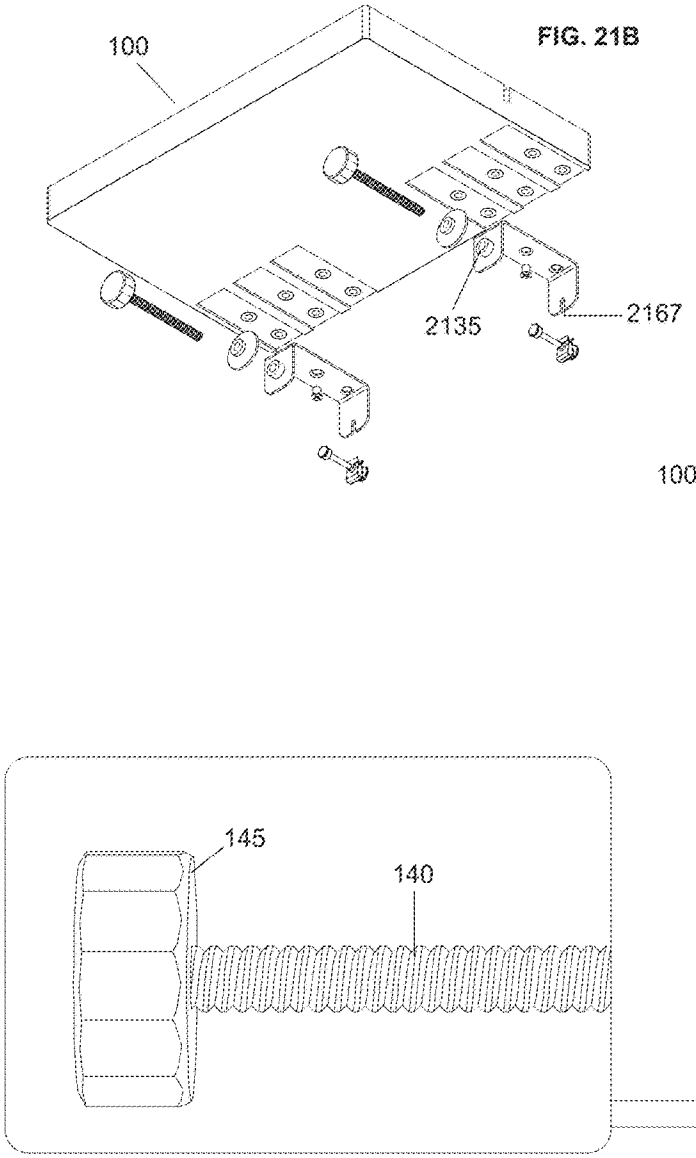
Figure 21C:
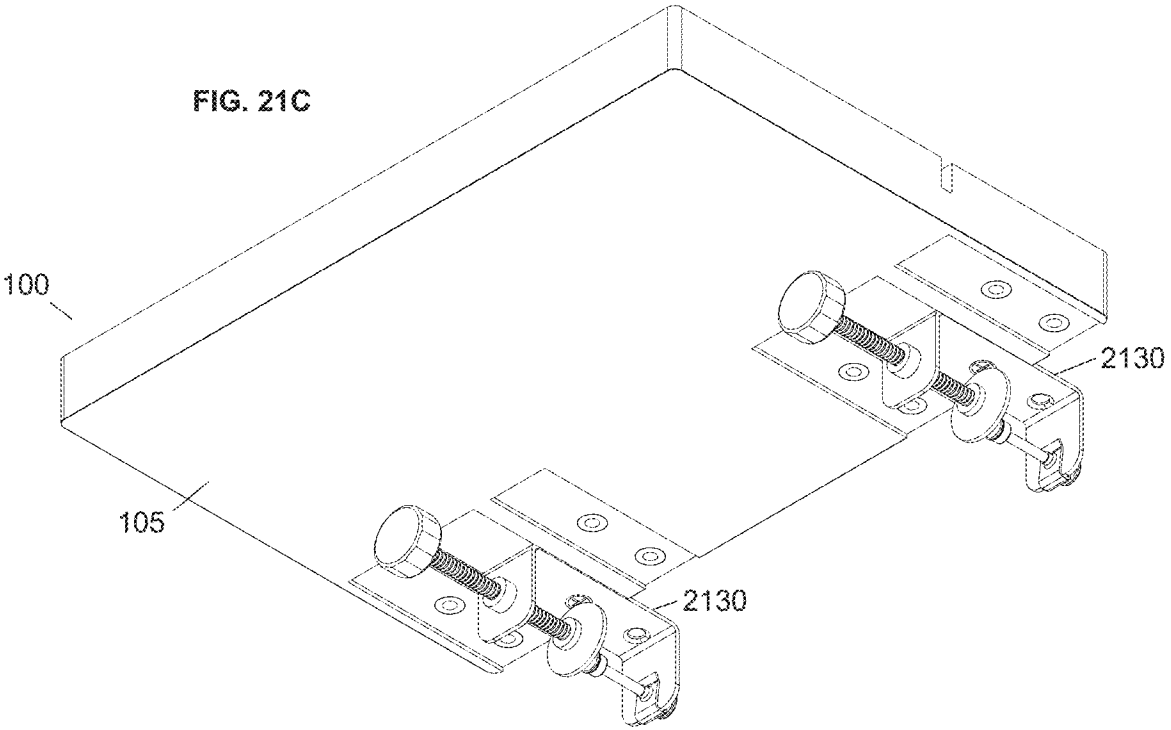
Figure 21D:
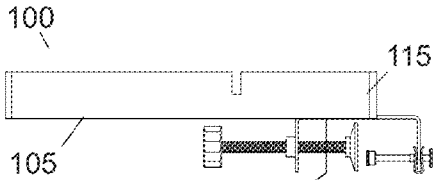
Figure 21E:
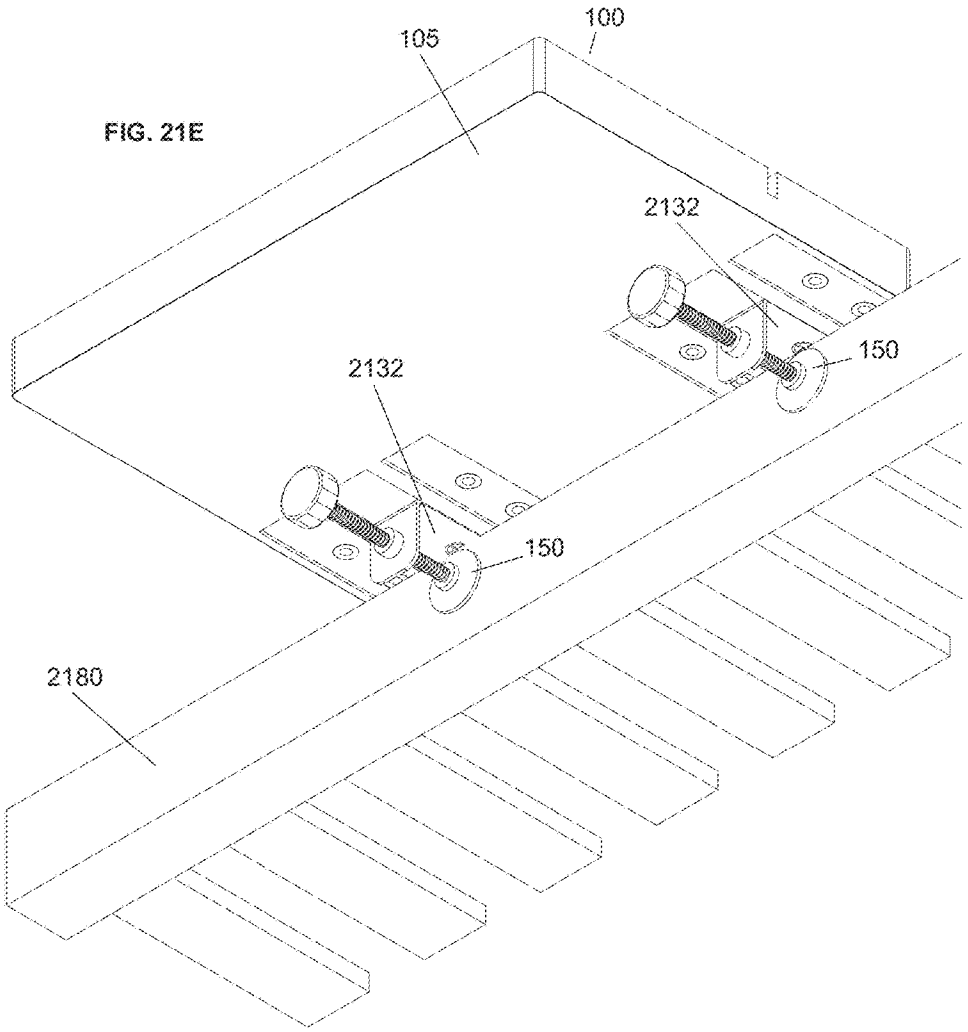
Figure 21F:
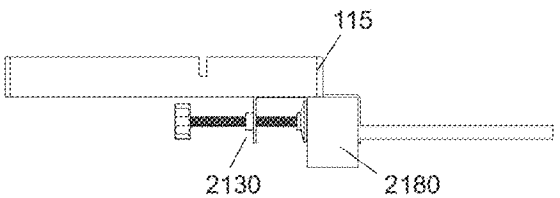
Figure 21G:
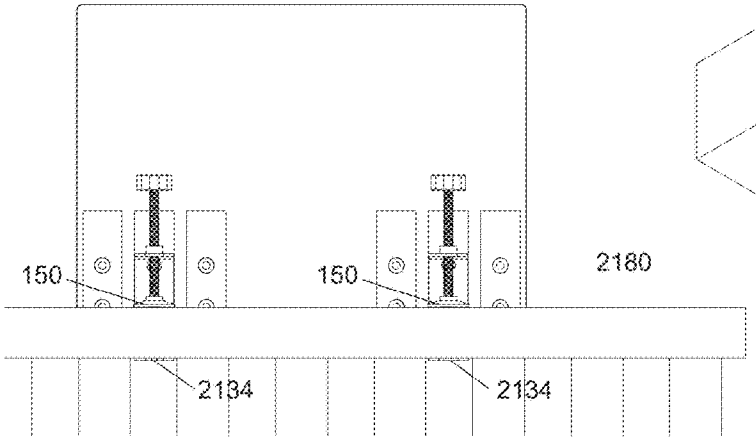

Alternative embodiments of tray 100 are illustrated in FIGS. 21A-21AI. The tray's planar base 105 extends in a horizontal plane and has an edge 115 that is positioned parallel to a support structure 2180 when installed. A C-clamp 2130 is coupled to the bottom surface of base 105. The C-clamp 2130 includes a horizontally oriented side 2132 at least a portion of which is coupled to the bottom surface of the planar base 105. In the embodiment, the horizontal side 2132 is oriented substantially normal to and adjacent the edge 115 of base 105. C-clamp 2130 further includes a first vertically oriented side 2134 meeting the horizontally oriented side 2132 at a first corner of the C-clamp 2130 and extending downward. The C-clamp further includes a second vertically oriented side 2136 meeting the horizontally oriented side 2132 at a second corner of the C-clamp 2130 and extending downward. The second vertically oriented side includes a threaded hole 2135.

The C-clamp 2130 includes a screw 140 comprising a threaded shaft, a handle 145 at a first end of the screw, and a shoe 150 at a second end of the screw. The second end of the screw passes through the threaded hole 2135 of the second vertically oriented side 2136 of the C-clamp 2130 and extends horizontally toward the first vertically oriented side 2134 of the C-clamp 2130. Moving, e.g., twisting, the handle 145 causes the second end of the screw to further extend or move horizontally toward the first vertically oriented side 2134 of the C-clamp 1230 such that the shoe 150 and the first vertically oriented side 2134 of the C-clamp 2130 frictionally engage the support structure 2180 when the support structure 2180 is positioned between the first and second vertically oriented sides 2134, 2136 of the C-clamp 2130.

According to embodiments, one or more C-clamps may be used to frictionally engage the support structure 2180. For example, FIGS. 21A-21AI illustrate a pair of C-clamps installed to frictionally engage the support structure 2180. Depending on the size of the tray, in particular, the length of the tray in the direction parallel to the support structure, and/or depending on the size of the C-clamp(s), and/or depending on the size of the support structure, three or more C-clamps may be used to frictionally engage the support structure 2180.

While the embodiment illustrated in FIGS. 21A-21AI contemplate the screw passing through the threaded hole 2135 of the second vertically oriented side 2136 of the C-clamp 2130, it is possible to essentially reverse the C-clamp so that screw passes through a threaded hole of the first vertically oriented side 2134 of the C-clamp 2130. In either case, the C-clamp forms an opening that spans the support structure, and one vertically oriented side of the C-clamp functions as a fixed jaw that contacts the support member, while the other vertically oriented side has a threaded fixing that passes through a threaded hole, such as a threaded bolt with a shoe, which functions as a movable jaw that contacts and frictionally engages the other, opposite, side of the support structure when the handle is turned.

Figure 21H:
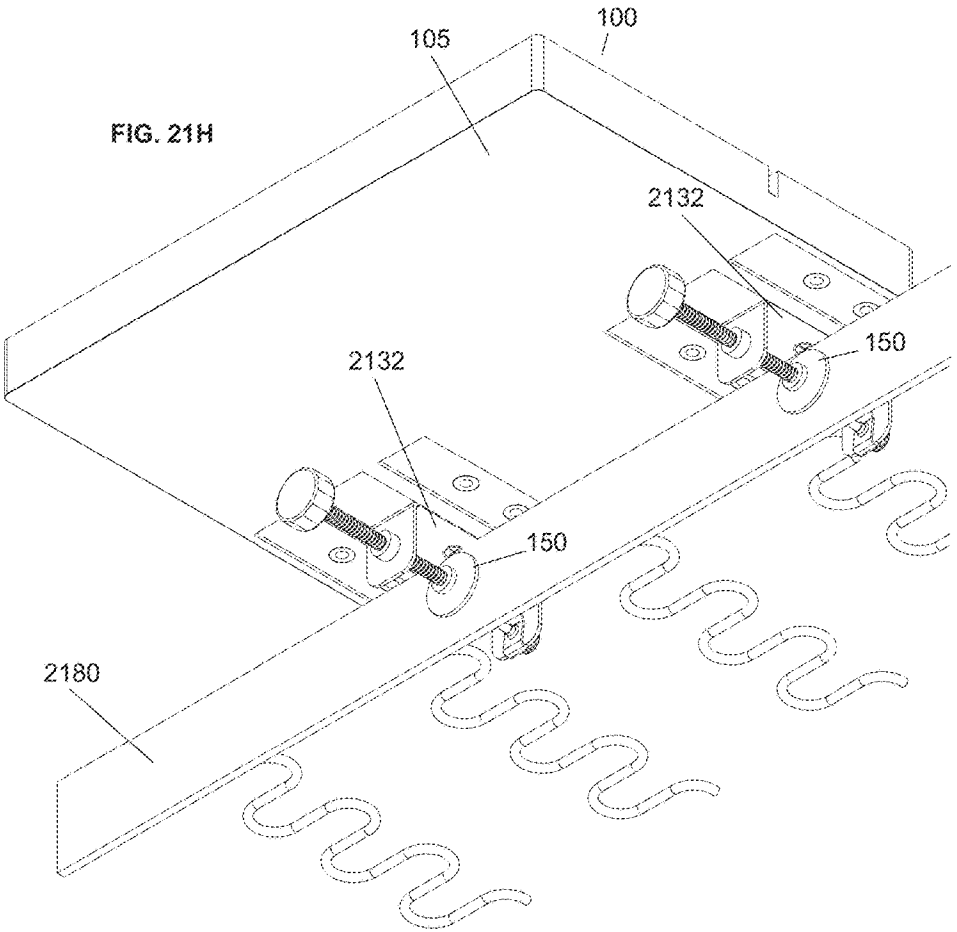
Figure 21I:
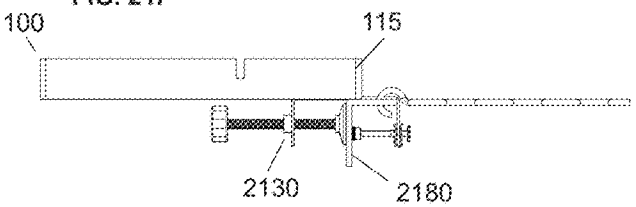
Figure 21J:
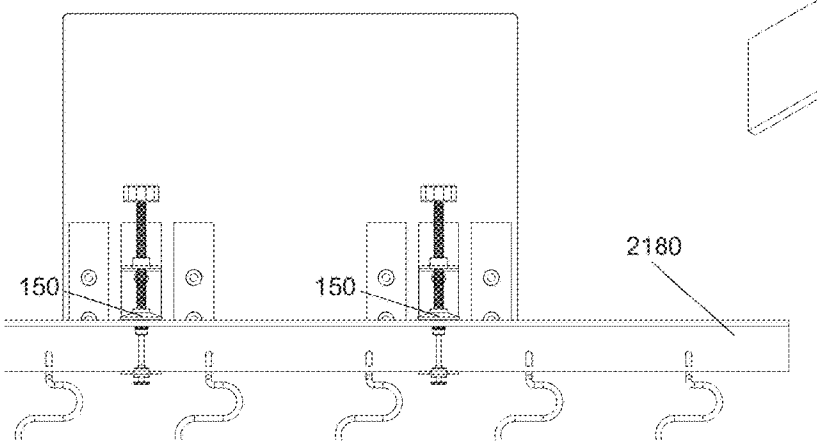
Figure 21K:
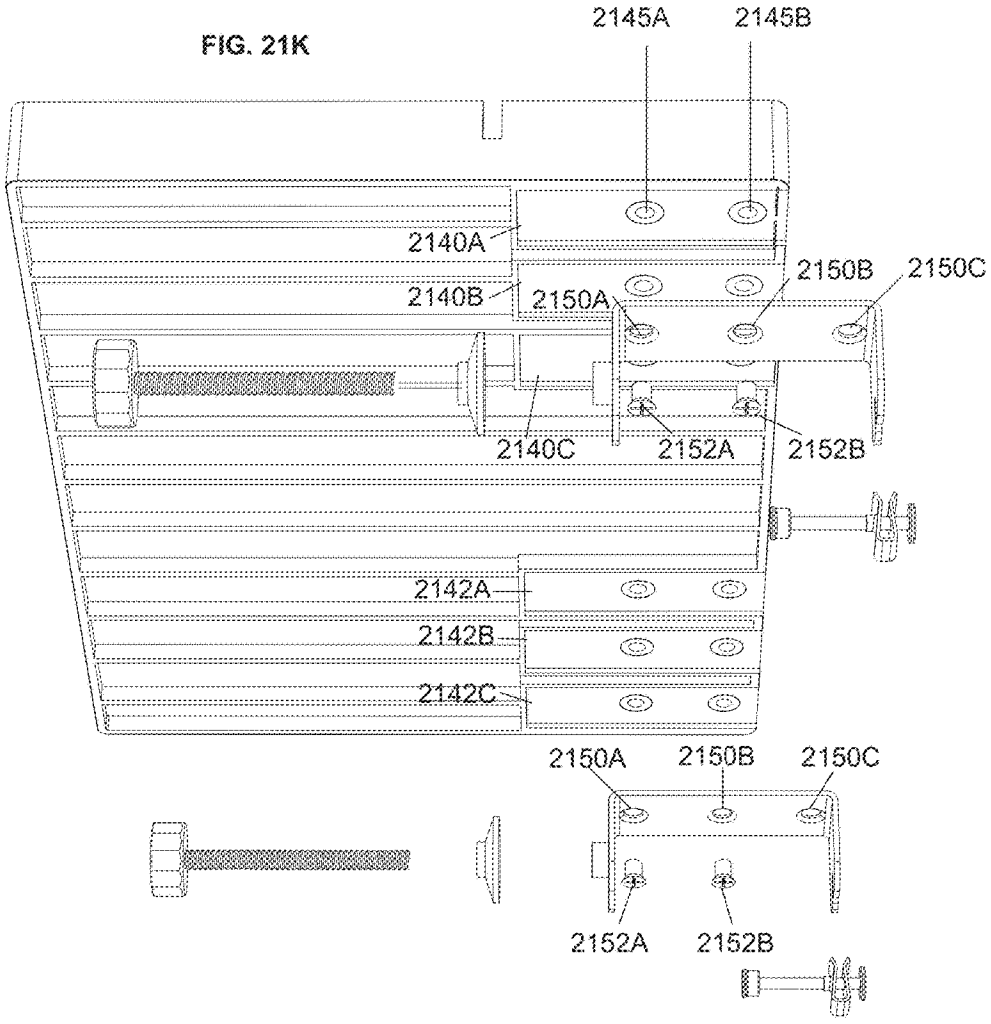
Figure 21L:
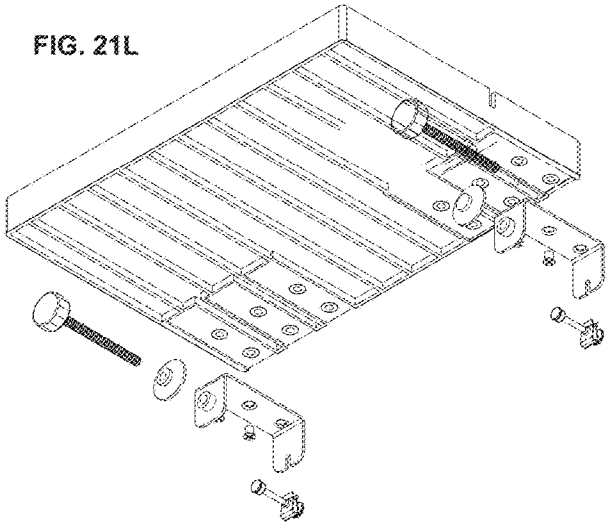
Figure 21M:
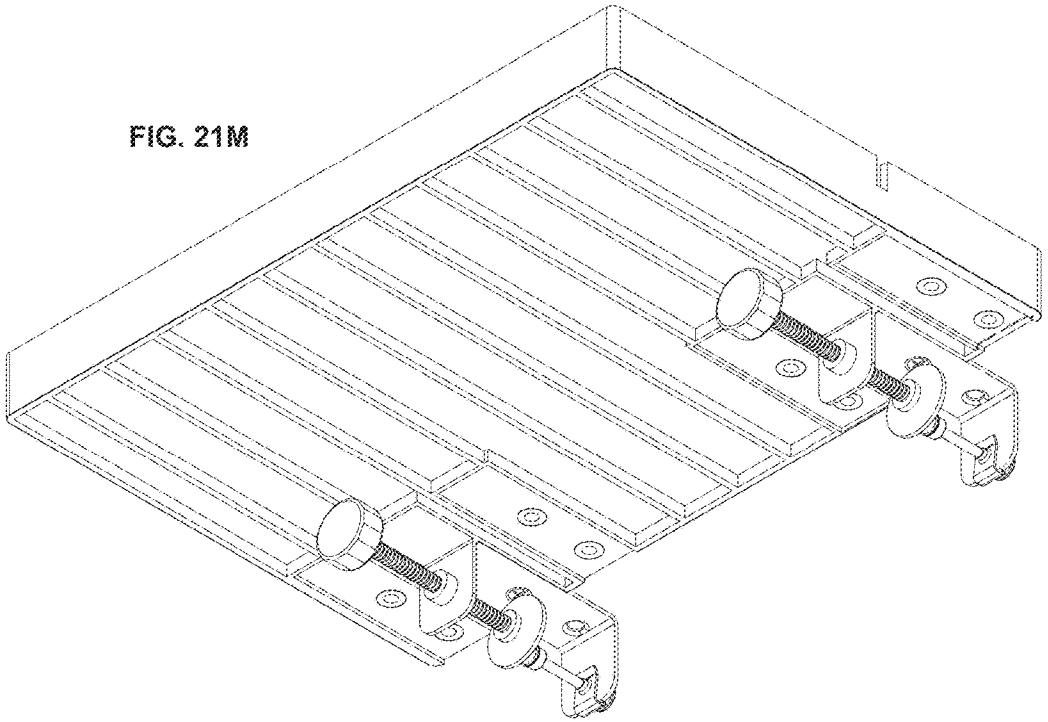
Figure 21N:
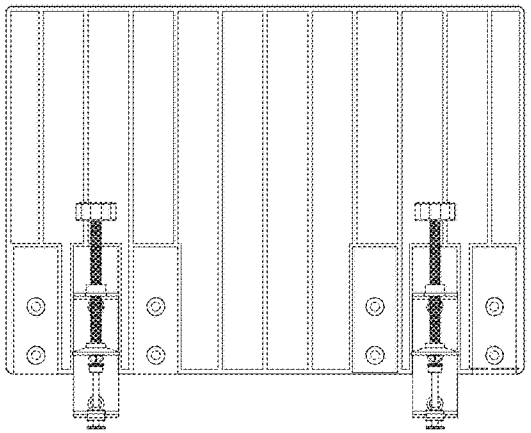
Figure 21O:
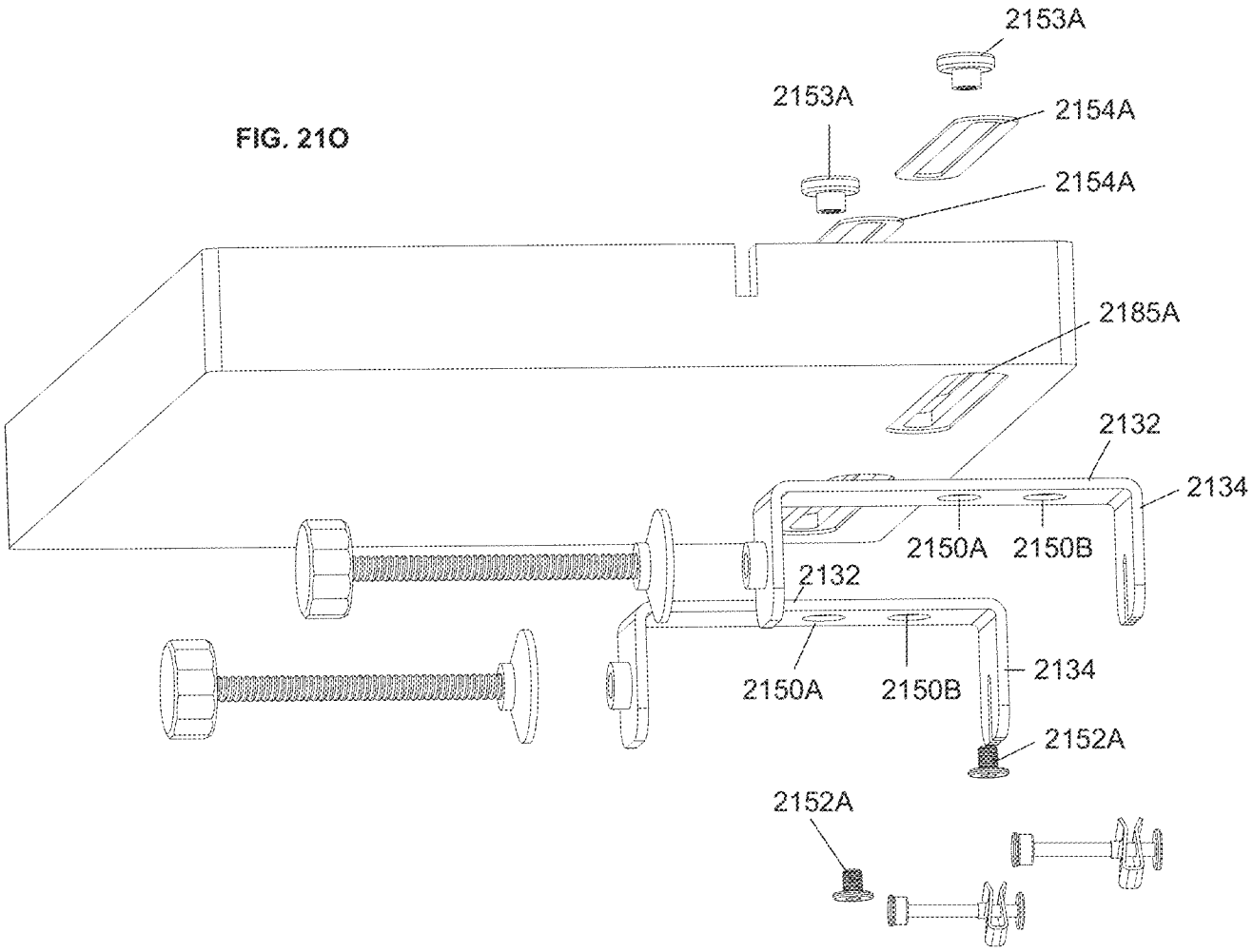
Figure 21P:
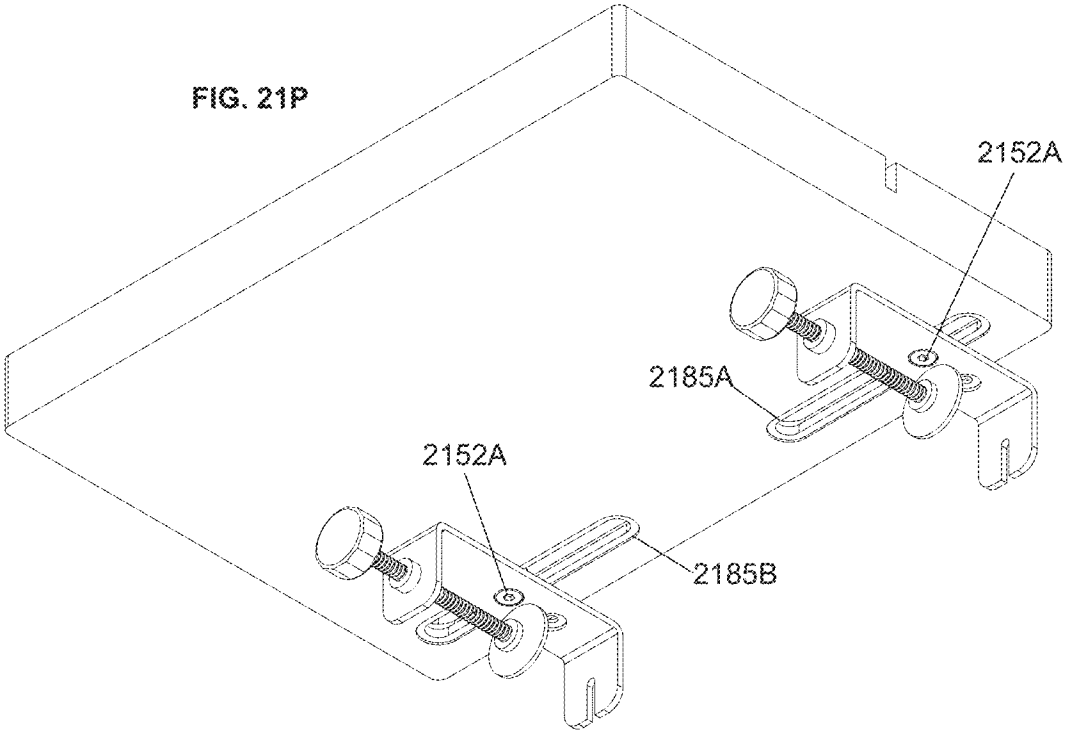
Figure 21Q:
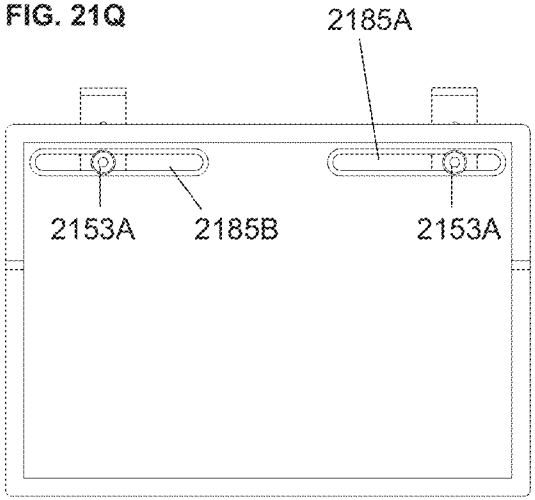

According to another embodiment, the C-clamp may include two movable jaws each of which contacts and frictionally engages a respective side of the support structure to secure the tray to the support structure. For example, as depicted in at least FIGS. 21A, 21O and 21AJ, the first vertically oriented side 2134 of the C-clamp 2130 also includes a threaded hole, for example, the threaded hole created by the combination of slot 2167 and clip 2165, and a second bolt or screw 2170 comprising a threaded shaft, a handle or head 2155 at a first end of the second screw, and a shoe or pad 2160 at a second end of the second screw. The second end of the second screw passes through the threaded hole, for example, the threaded hole created by slot 2167 and clip 2165 slidably engaged with the slot. According to one embodiment, clip 2165 includes a punched in portion 2168 on one side of the clip that acts as a spring that biases against, or presses on, a surface of the first vertically oriented side 2134 so that the clip, or at least the punched in portion of the clip, presses against, and frictionally engages, the surface of the first vertically oriented slide of slot 2167 when the clip is slipped into place over the slot. In one embodiment, a pair of horizontally aligned openings, one in each of the respective sides of the clip, act like an internal female threaded hole and engage external threads of the screw, so that the screw can be inserted in the first vertically oriented side 2134 of the C-clamp 2130 and extended horizontally toward the second vertically oriented side 2136 of the C-clamp 2130. In another embodiment, clip 2165 comprises an internally threaded flange 2166 on one (as illustrated in FIG. 21O) or both sides (not illustrated) of the clip, in which case, the external threads of the second screw pass through the internally threaded flange(s) of the slot. The flange(s) comprise a protruded ridge, lip or rim, and while shown in FIG. 21O as an externally protruded ridge, lip, or rim, either or both flanges could be internally protruded. In essence the flange(s) guide the movement of the second screw through the clip and accompanying slot. Movement of the handle 2155 of the second screw causes the second end of the second screw to further extend or move horizontally toward the second vertically oriented side 2136 of the C-clamp 2130 such that the shoes 150 and 2160 of the respective first and second screws frictionally engage the support structure 2180 when the support structure is positioned between the first and second vertically oriented sides of the C-clamp. In one embodiment, the support structure 2180 may be a right-angle structure, as illustrated in FIGS. 21H, 21I and 21J, such as a piece of angle iron. While the second screw is smaller than the first screw in the illustrations, it is appreciated that the screws may be substantially the same size, or the first screw may be smaller than the second screw.

According to an embodiment, the tray further comprises a threaded fixing, e.g., a bolt or screw 2152A, positioned along a length of the horizontally oriented side 2132 of the C-clamp 2130, via which to couple at least a portion of the horizontally oriented side 2132 of the C-clamp 2130 to the bottom surface of the planar base 105. According to this embodiment, the horizontally oriented side 2132 of the C-clamp comprises a corresponding hole 2150A positioned along the length of the horizontally oriented side 2132 of the C-clamp 2130 through which the threaded fixing, e.g., bolt or screw 2152A, passes to couple at least the portion of the horizontally oriented side 2132 of the C-clamp 2130 to the bottom surface of the planar base 105.

According on one embodiment, the threaded fixing comprises a bolt or screw 2152A with external male threads that passes through the hole, e.g., hole 2150A positioned along the length of the horizontally oriented side 2132 of the C-clamp 2130 to mate with a nut with internal female threads embedded at the bottom surface of the planar base, e.g., nut 2145A, to couple at least the portion of the horizontally oriented side 2132 of the C-clamp 2130 to the bottom surface of the planar base 105.

While the above-described embodiment mentions a single threaded fixing to couple at least the portion of the horizontally oriented side 2132 of the C-clamp 2130 to the bottom surface of the planar base, such as illustrated in FIGS. 21O-21AI, it is contemplated that a plurality of threaded fixings may be used to do so. In such an embodiment, the horizontally oriented side 2132 of the C-clamp 2130 may comprise a plurality of holes, e.g., two holes 2150A and 2150B, or two holes 2150B and 2150C, or three holes 2150A, 2150B and 2150C, positioned along the length of the horizontally oriented side 2132 of the C-clamp 2130. A threaded fixing, e.g., screw 2152A, can be inserted through any one of the plurality of holes 2150A, 2150B and 2150C of the horizontally oriented side 2132 of the C-clamp 2130 to couple at least the portion of the horizontally oriented side of the C-clamp to the bottom surface of the planar base 105. Alternatively, two threaded fixings, e.g., screws 2152A and 2152B, can be inserted through any two of the plurality of holes 2150A, 2150B and 2150C to couple at least the portion of the horizontally oriented side of the C-clamp to the bottom surface of the planar base. For example, FIG. 21K illustrates screws 2152A and 2152B being inserted through respective holes 2150A and 2150B and then respectively mating with embedded nuts 2145A and 2145B. Alternatively, the screws 2152A and 2152B could be inserted through holes 2150B and 2150C and then respectively mating with embedded nuts 2145A and 2145B.

In the embodiments illustrated in FIGS. 21O-21AI, a single threaded fixing, e.g., screw 2152A, is used to couple at least the portion of the horizontally oriented side of the C-clamp to the bottom surface of the planar base 105. A choice can be made at the time of installation of the tray onto the support structure as to which of the plurality of holes 2150A or 2150B the single threaded fixing is inserted. For example, inserting screw 2152A through hole 2150B causes the C-clamp can be installed so that the vertically oriented side 2134 is essentially flush with the edge 115 of the tray 100, in which case the screw 2152A couples the entire length of the horizontally oriented side of the C-clamp to the bottom surface of the planar base 105. This is illustrated, for example, in FIGS. 21AB-21AI, and is the typical installation configuration when installing the tray at a support structure that is square or rectangular in dimension. Alternatively, inserting screw 2152A through hole 2150A causes the C-clamp can be installed so that the vertically oriented side 2134 is extended horizontally from edge 115 of the tray 100, in which case, the screw 2152A couples just a portion of the horizontally oriented side of the C-clamp to the bottom surface of the planar base 105. This is illustrated, for example, in FIGS. 21D, 21F, 21I, 21X-21AA, and is the typical installation configuration when installing the tray at or on a support structure that is a right-angle in dimension.

According to embodiments, there are multiple locations on the bottom surface of the planar base to which a C-clamp may be coupled. To guide the process of choosing a location during installation, an embodiment comprises a plurality of channels or slots, e.g., slots 2140A, 2140B and 2140C, or slots 2142A, 2142B and 2142C, from which to choose or select to position a C-clamp to be coupled to the bottom surface of the planar base. In one embodiment, the channels or slots are each oriented substantially normal to and adjacent the edge 115 of the tray 100 and sized to receive the horizontally oriented side 2132 of the C-clamp where it is coupled to the bottom surface of the planar base. In one embodiment, the slots are recessed into the bottom surface of the planar base, such as illustrated in FIG. 21A. In another embodiment, the channels or slots may be defined by raised ribs, spaced apart to accommodate the C-clamp therebetween, as illustrated, for example, in FIG. 21K. Thus, it is possible to select from a plurality of fixed locations at the time of installation where to position a C-clamp to be coupled to the bottom surface of the planar base.

Even more flexibility is provided at the time of installation as to where to position a C-clamp 2130 to be coupled to the bottom surface of the planar base 105 in the embodiments illustrated in FIGS. 21O-21AI. As illustrated, the planar base 105 comprises a cut-out, in the shape of an elongated aperture 2185A, or a plurality of such apertures, e.g., apertures 2185A and 2185B. The number of apertures correspond to at least the number of C-clamp(s) to be coupled to the bottom surface of the planar base. These elongated apertures run parallel to and offset from (inside of) the edge 115, and normal to the horizontally oriented side 2132 of at least the portion of the C-clamp 2130 coupled to the bottom surface of the planar base 105 (which as described above is positioned substantially normal to and adjacent the edge).

As illustrated in FIG. 21O, a threaded fixing, e.g., screw 2152A, is positioned along a length of the horizontally oriented side 2132 of the C-clamp 2130 and passes through any position along the elongated aperture, according to where the C-clamp 2130 is positioned, via which at least a portion of the horizontally oriented side 2132 of the C-clamp 2130 is coupled to the bottom surface of the planar base.

In the illustrated embodiment, the threaded fixing includes not only an external male threaded screw 2152A, but also a corresponding internal threaded nut 2153A to which the screw 2152A is mated. Depending on the type of material used in the planar base, an elongated washer 2154A may also be installed to prevent damage to the material when the screw 2152A is mated and tightened down with the corresponding nut 2153A.

While the illustrated embodiment contemplates the screw 2152A inserted from below the tray and the nut 2153A mated to the screw from above the tray, the components may be reversed, so that the screw is inserted from above and the nut mated to the screw from below the tray.

Figure 21R:
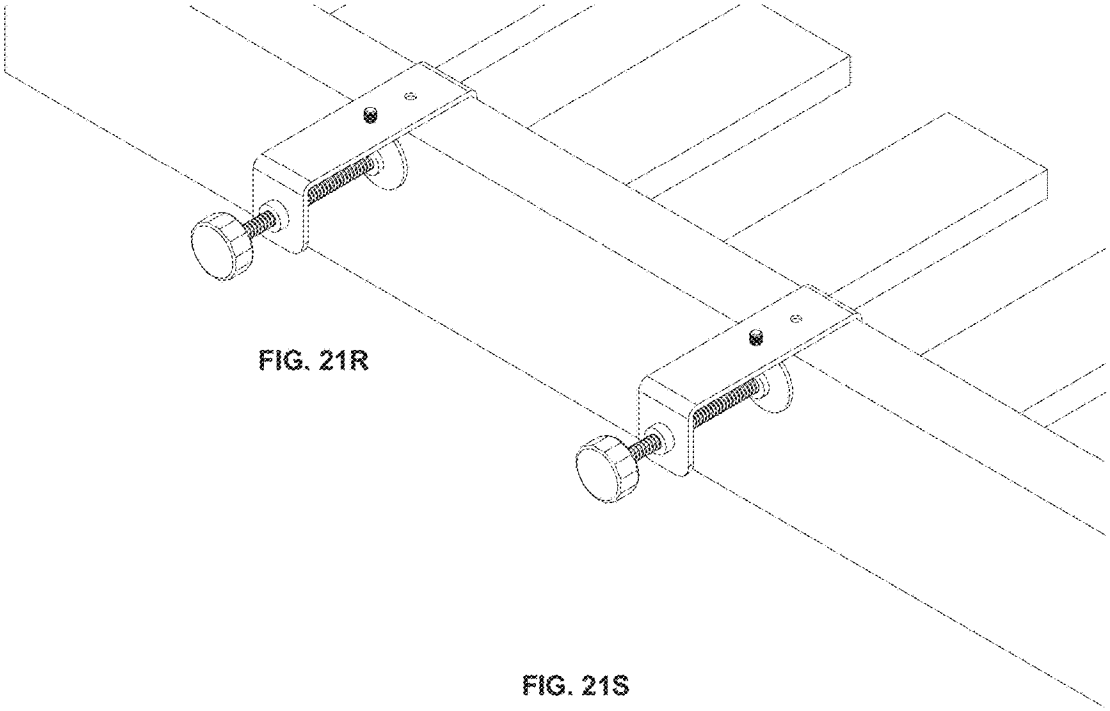
Figure 21S:
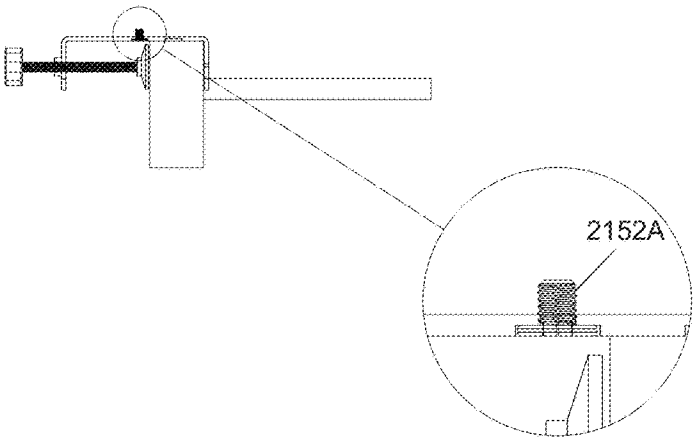

In another embodiment, screw 2152A may be integrated with the horizontally oriented side of the C-clamp at the time of manufacture so that it already protrudes above the horizontally oriented side of the C-clamp and can help guide positioning of the C-clamp where it intersects with the elongated aperture 2185A, as illustrated, for example, in FIGS. 21R and 21S.

Figures 21T, 21U:
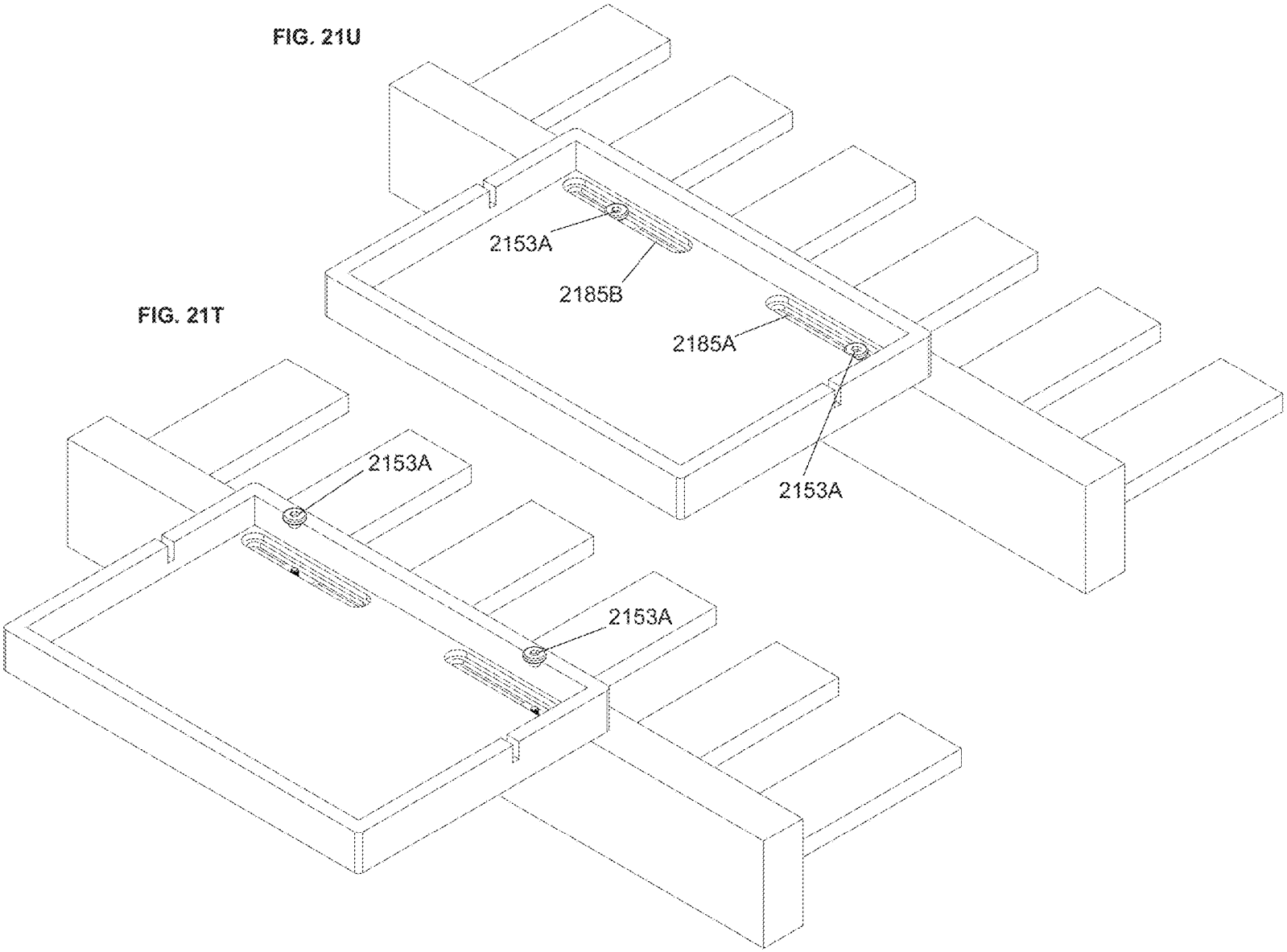
Figure 21X:
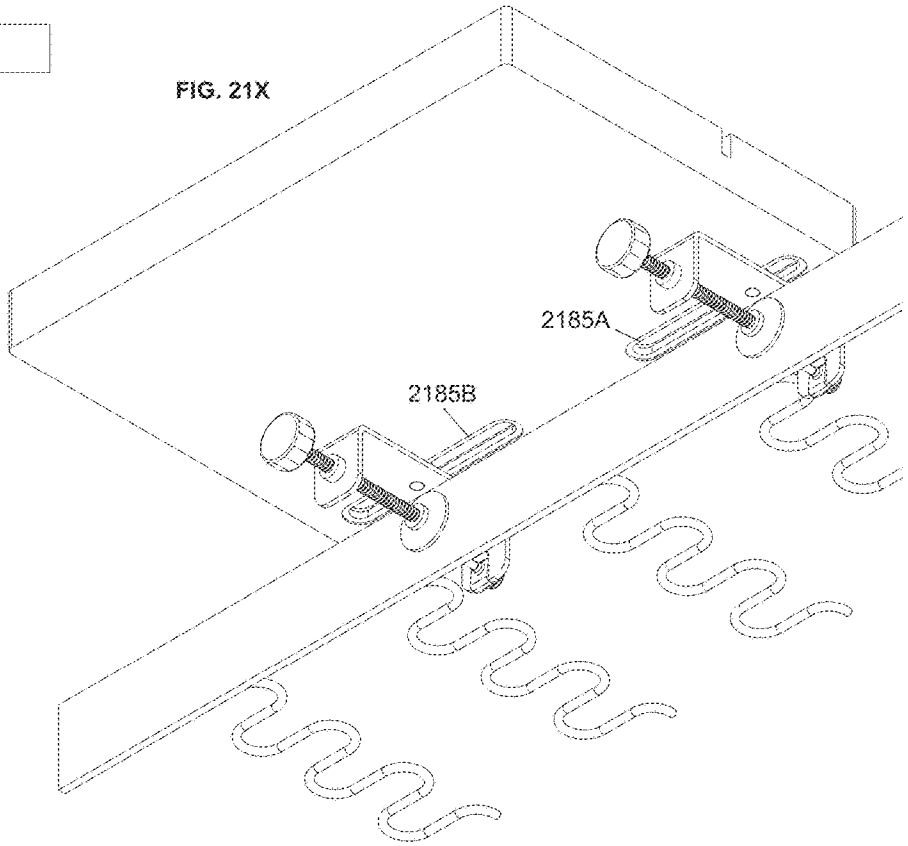
Figure 21A:
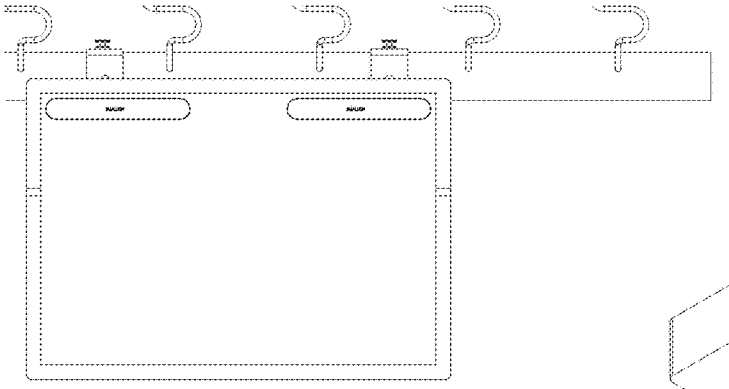
Figure 21Y:
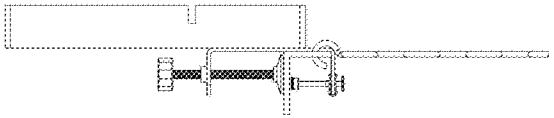
Figure 21Z:
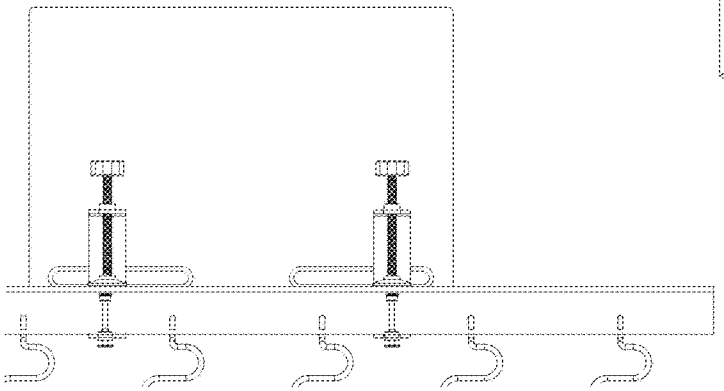
Figure 21A:
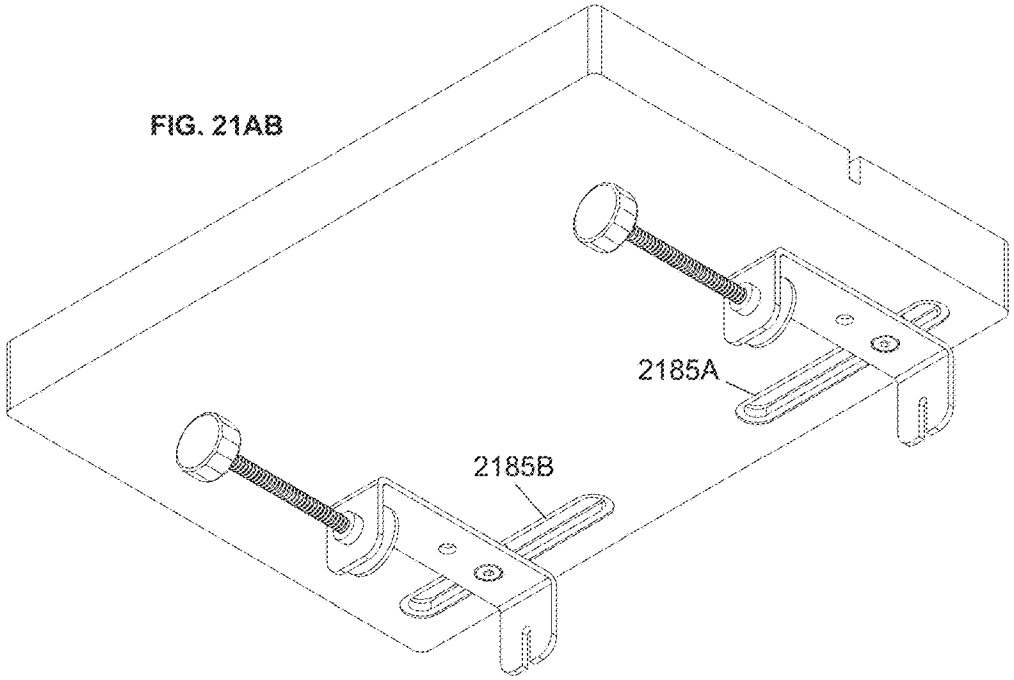
Figure 21A:
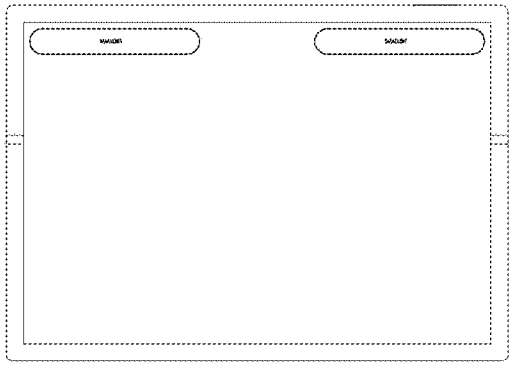
Figure 21A:
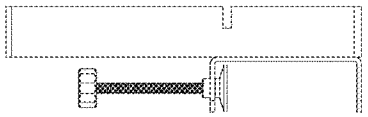
Figure 21A:
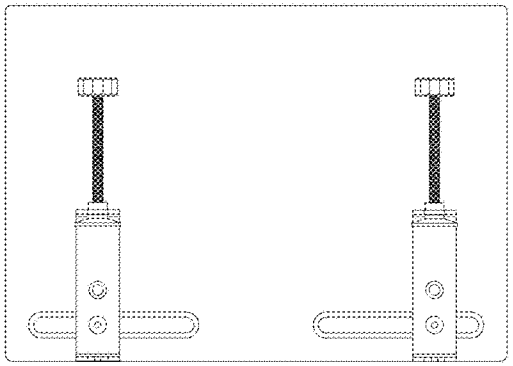
Figure 21A:
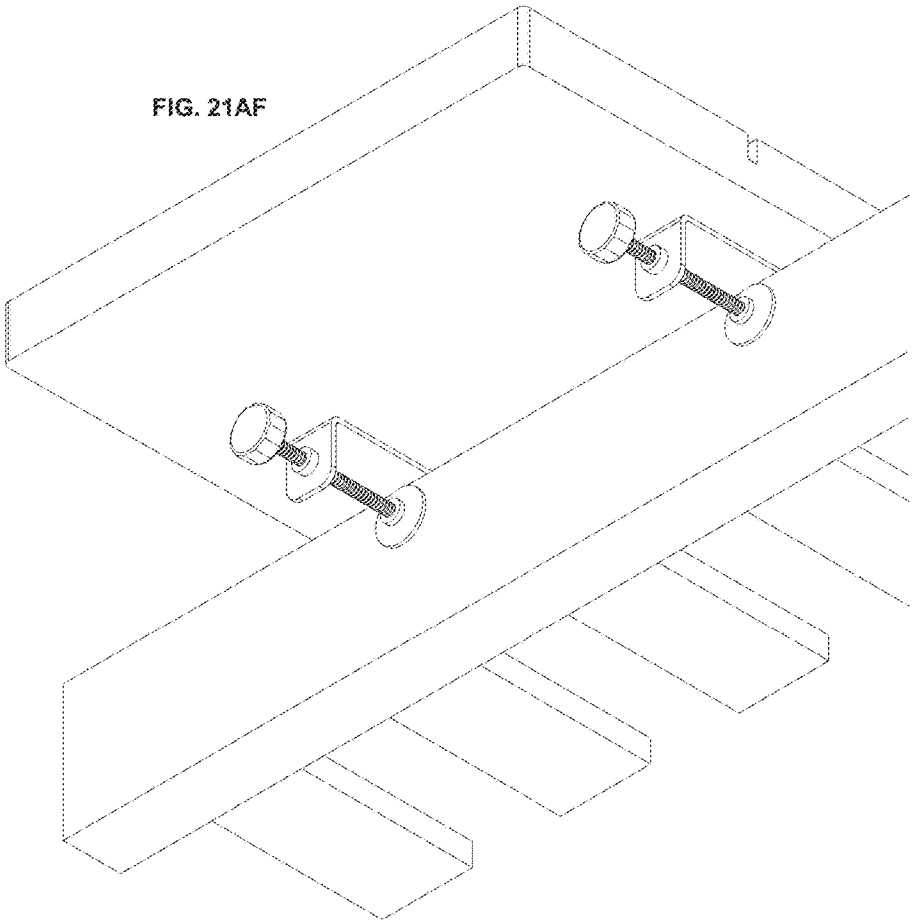
Figure 21A:
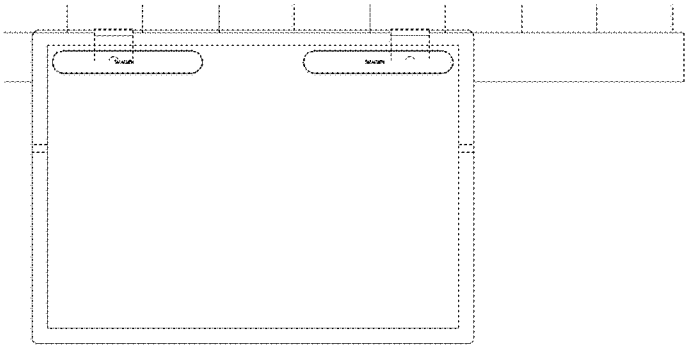
Figure 21A:
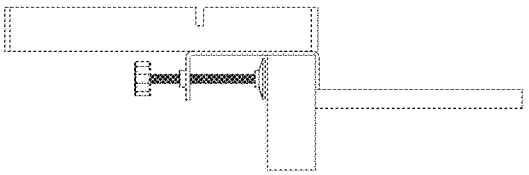
Figure 21A:
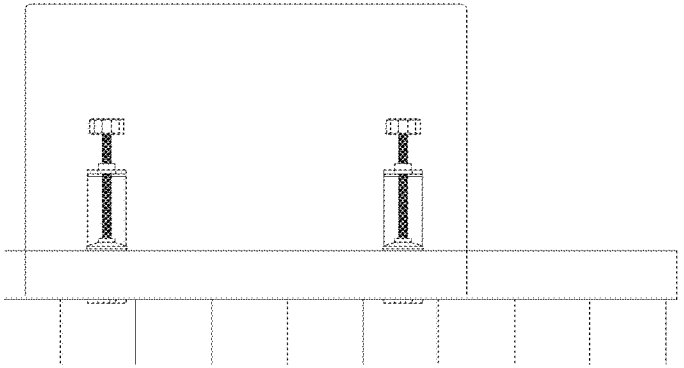
Figure 21A:
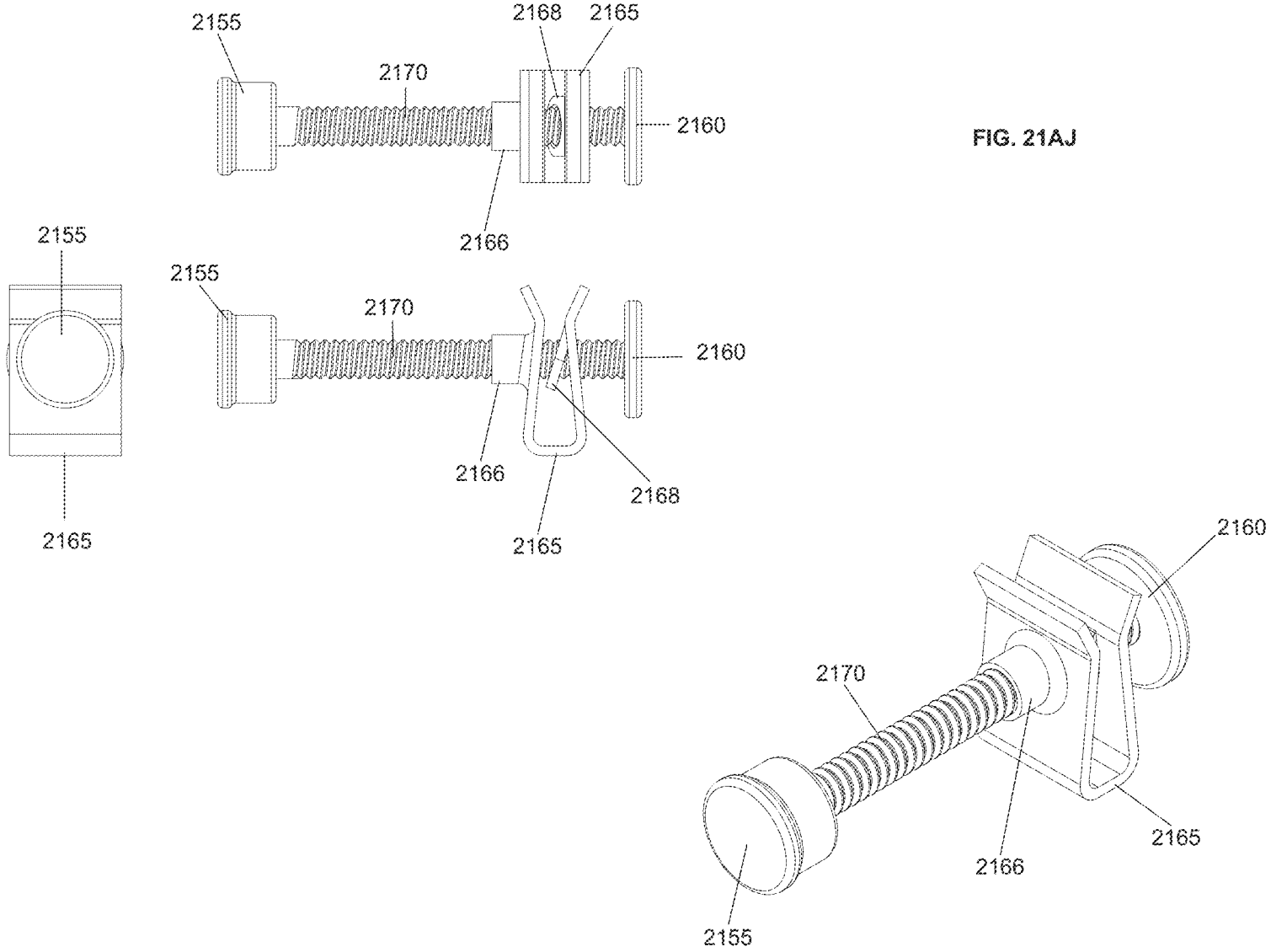

In an embodiment, the top of nut 2153A is flush or below the top surface of planar base 105 once the C-clamp is installed, allowing for a plastic cap or the like to be placed in the elongated aperture, rendering a smooth, unbroken, top surface of the planar base, as illustrated, for example, in FIGS. 21T, 21U, 21AA, 21AE and 21AI.

Figure 22A:
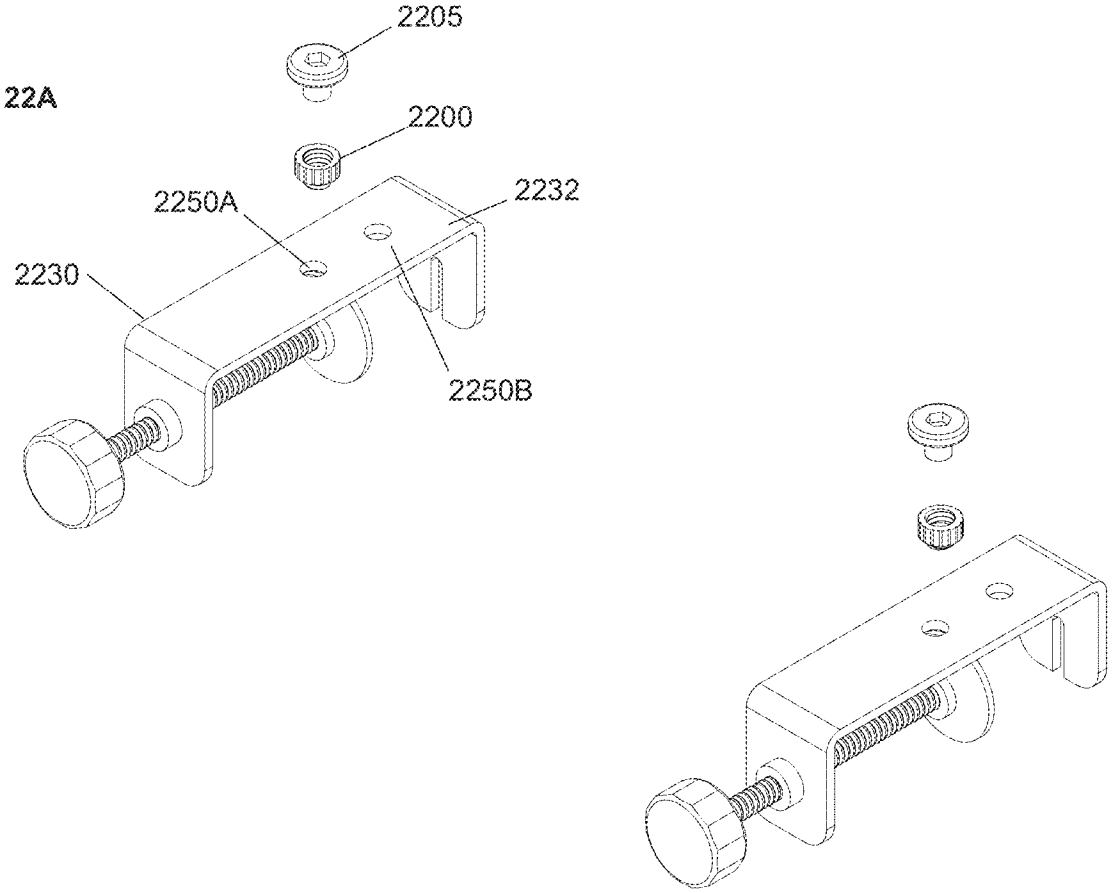
FIGS. 22A-22D illustrate an embodiment of a threaded fixing in accordance with an embodiment of the invention.
Figure 22B:
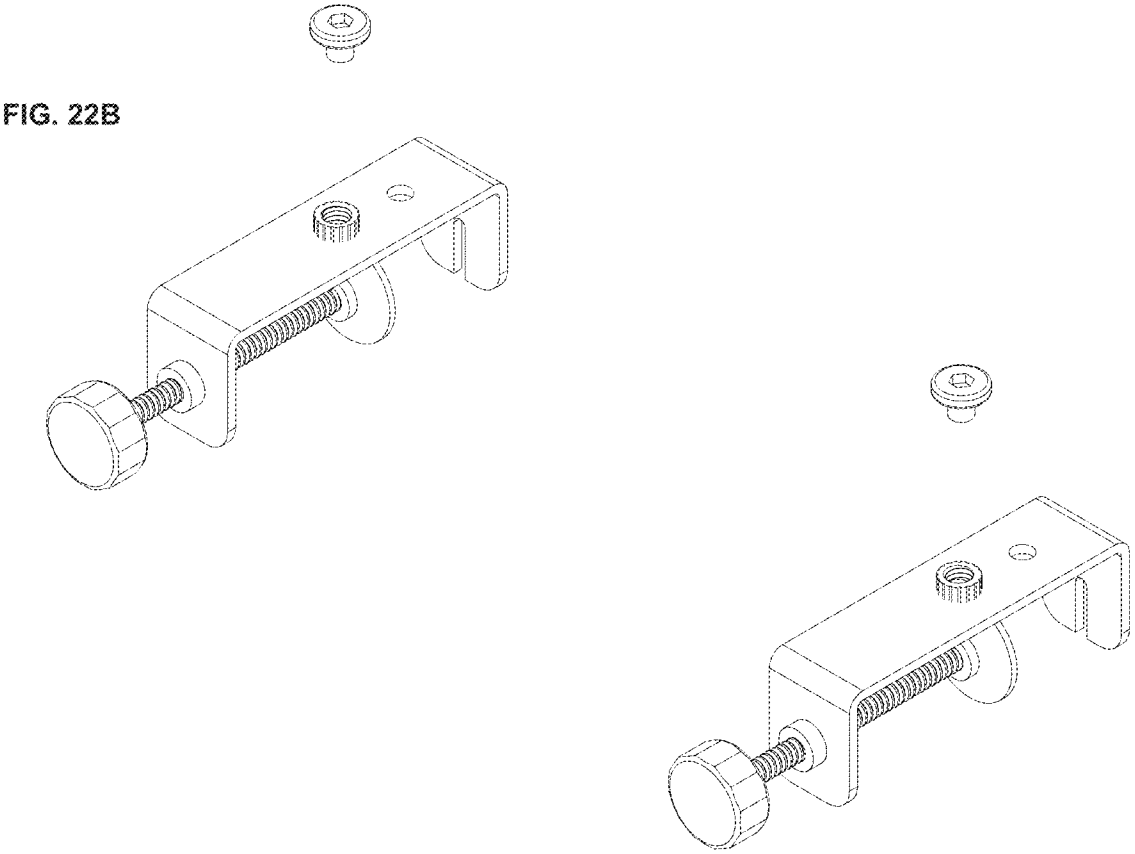
Figure 22C:
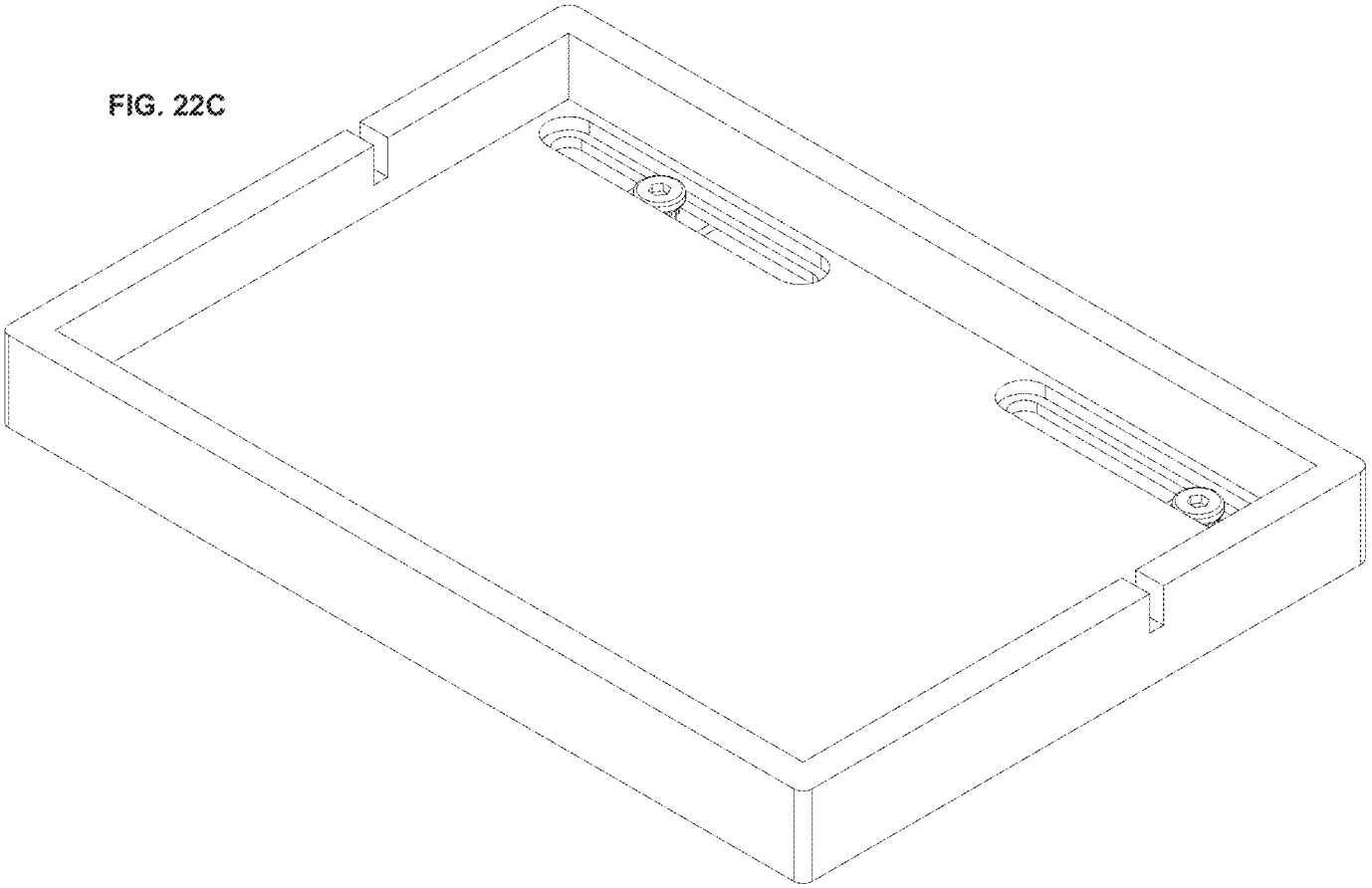
Figure 22D:
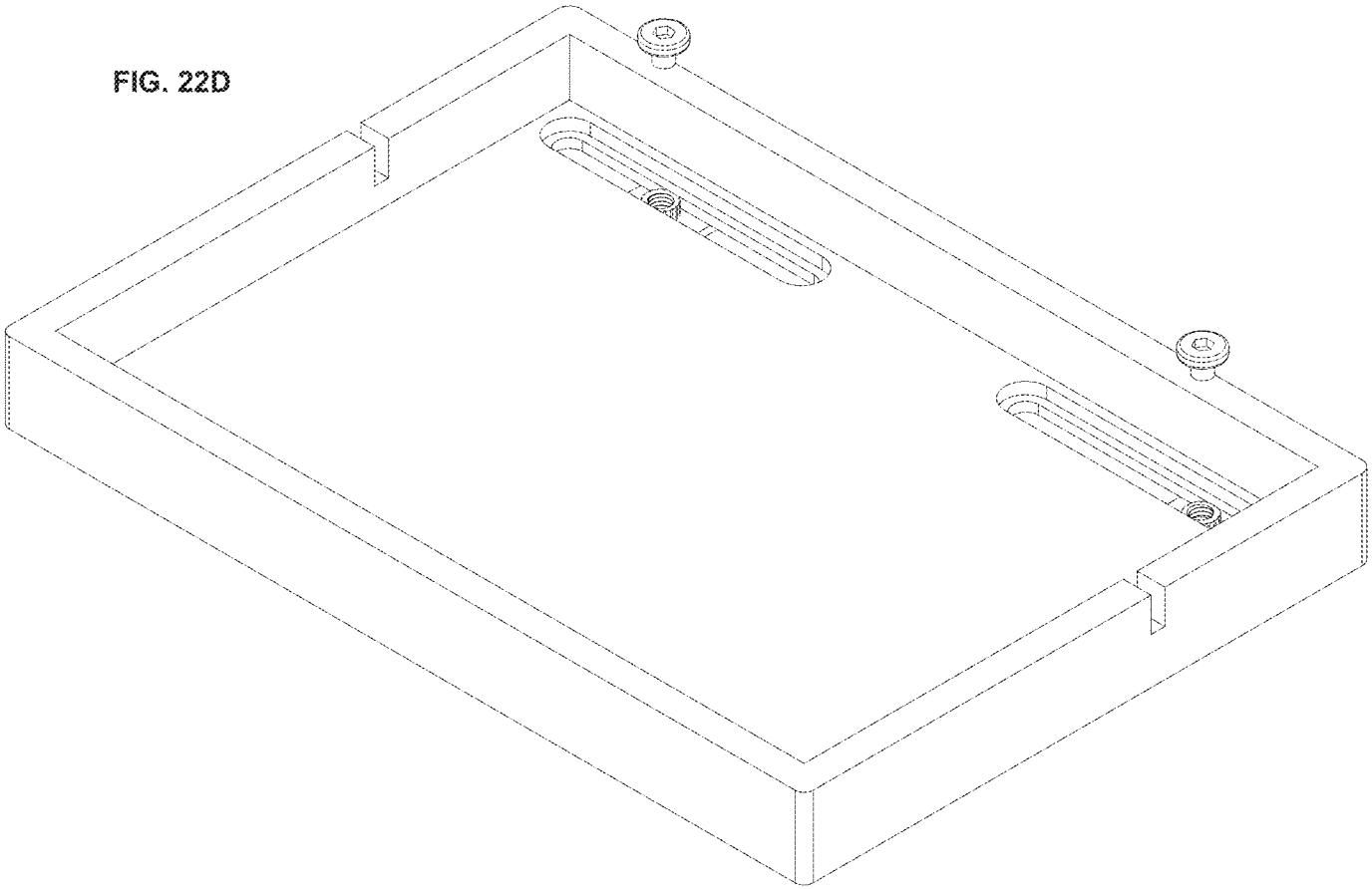

FIGS. 22A-22D illustrate a threaded fixing in accordance with an embodiment of the invention. The threaded fixing comprises a first post 2200 with a lower portion that has external male threads that can mate with internal female threads into one of a plurality of threaded holes 2250A and 2250B of horizontally oriented side 2232 of C-clamp 2230 (FIGS. 22A, 22B). A second post 2205 with external male threads can mate with an upper portion of first post 2200 that has internal female threads and thereby couple the C-clamp to the tray. (FIGS. 22B, 22C, 22D).

Figure 23A:
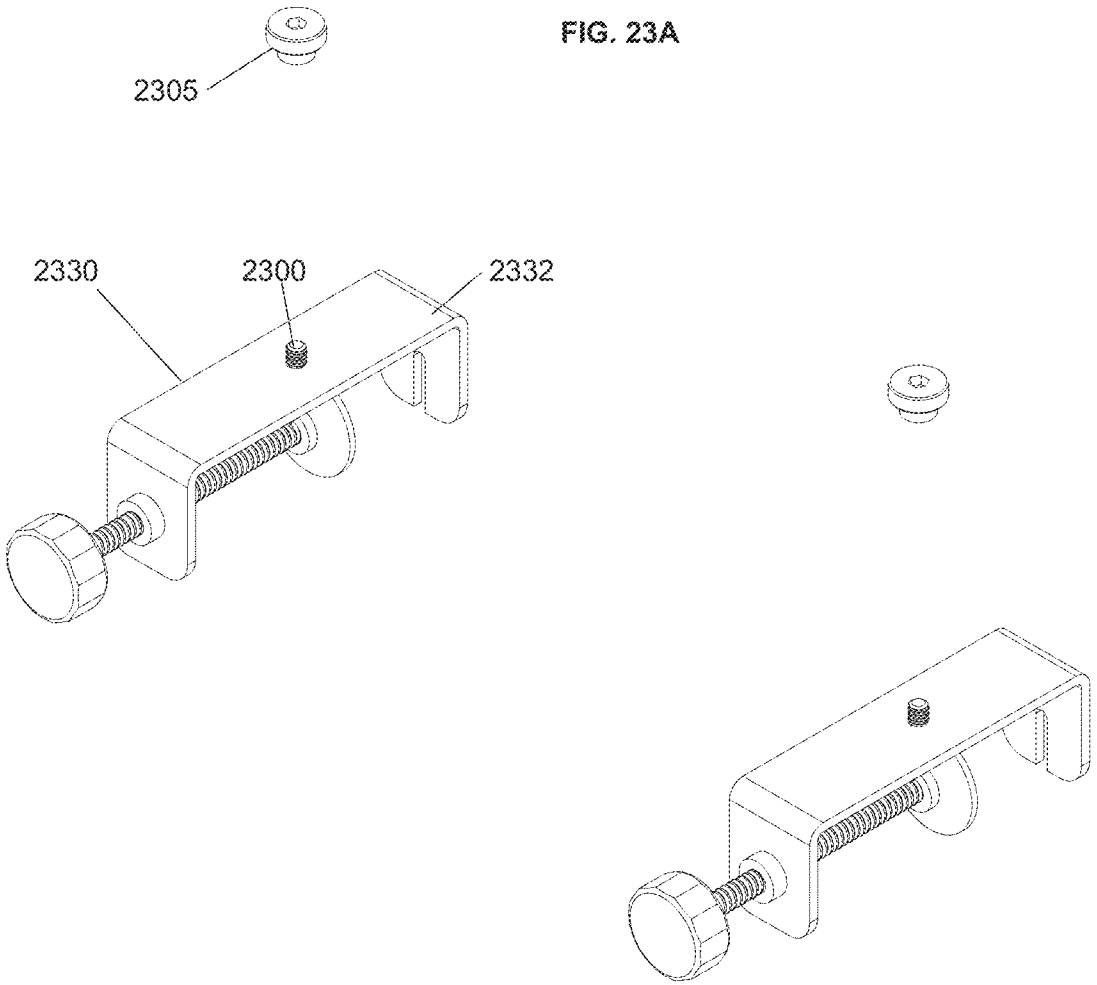
FIGS. 23A, 23B and 23C illustrate an embodiment of a threaded fixing in accordance with an embodiment of the invention.
Figure 23B:
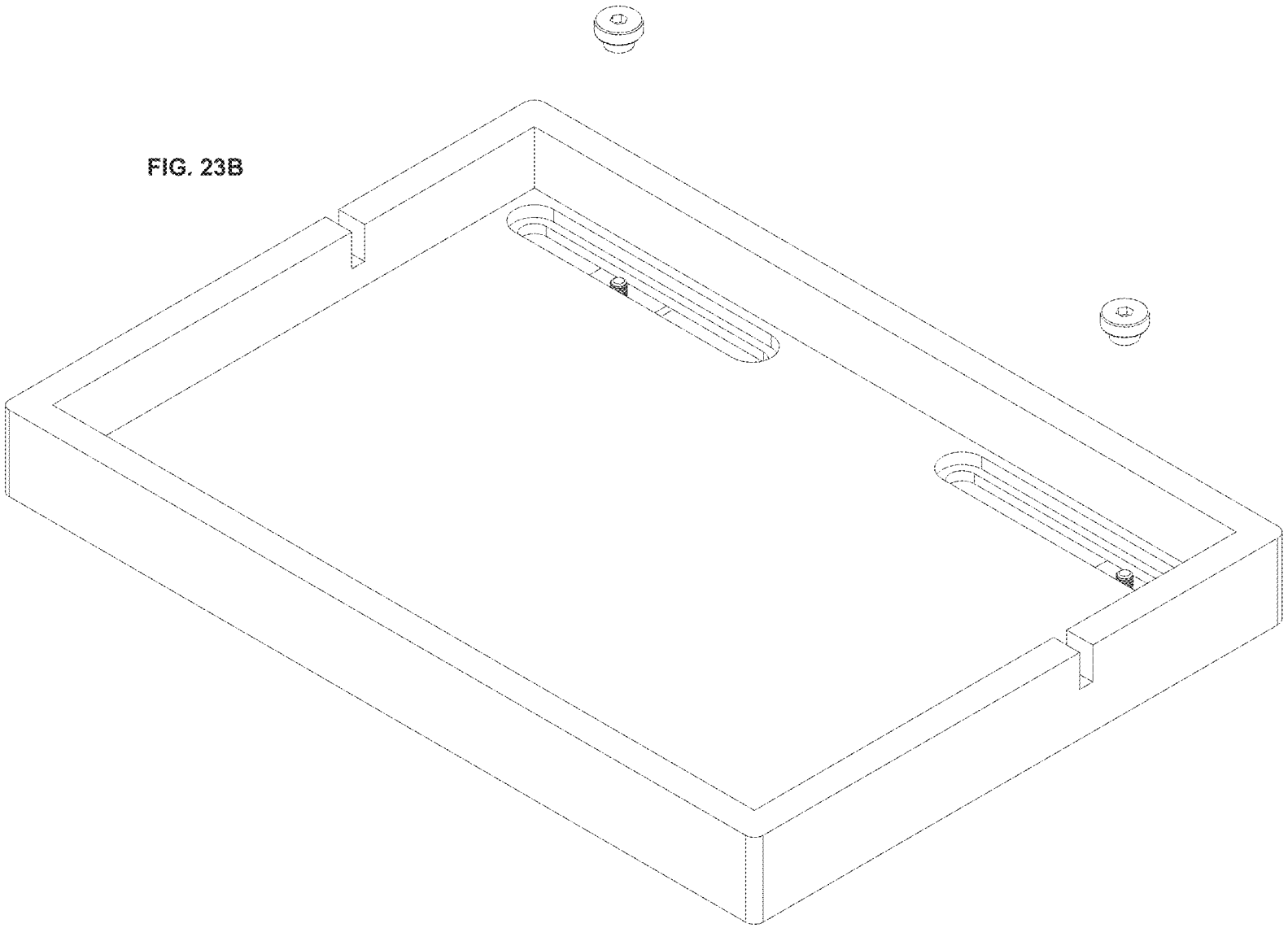
Figure 23C:
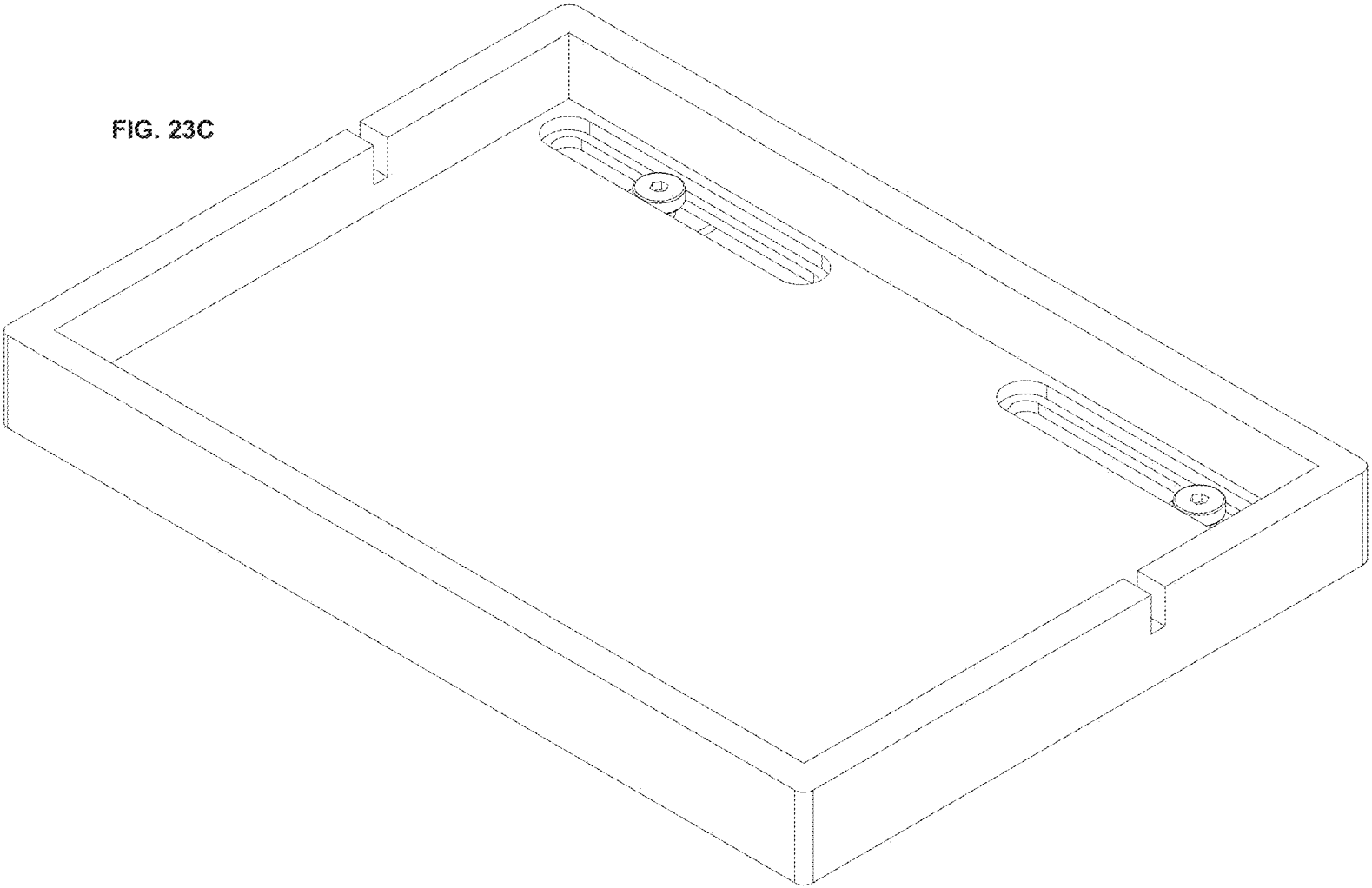

FIGS. 23A-23C illustrate a threaded fixing in accordance with an embodiment of the invention. The threaded fixing comprises a post 2300 that has external male threads that can mate with internal female threads in a single threaded hole of horizontally oriented side 2332 of C-clamp 2330 (FIG. 23A). A nut 2305 with internal female threads can mate with the post 2300 and thereby couple the C-clamp to the tray. (FIGS. 23B, 23C).

FIGS. 24A-24D illustrate a threaded fixing in accordance with an embodiment of the invention like the embodiment illustrated in FIGS. 21O-21AI. A C-clamp 2430 can be coupled to the bottom surface of the planar base 105. As illustrated, the planar base 105 comprises a cut-out, in the shape of an elongated aperture 2485A, or a plurality of such apertures, e.g., apertures 2485A and 2485B. The number of apertures correspond to at least the number of C-clamp(s) to be coupled to the bottom surface of the planar base. These elongated apertures run parallel to and offset from (inside of) the edge 115, and normal to the horizontally oriented side 2432 of at least the portion of the C-clamp 2430 coupled to the bottom surface of the planar base 105 (which as described above is positioned substantially normal to and adjacent the edge). As further illustrated, the planar base 105 further comprises a recessed portion, in the shape of an elongated recessed portion 2490A, or a plurality of such elongated recessions, e.g., recessions 2490A and 2490B. The number of recessions correspond to at least the number of C-clamp(s) to be coupled to the bottom surface of the planar base. These elongated recessions run parallel to and further offset from the edge 115 than the elongated apertures 2485A and 2485B, and normal to the horizontally oriented side 2432 of at least the portion of the C-clamp 2430 coupled to the bottom surface of the planar base 105 (which as described above is positioned substantially normal to and adjacent the edge).

Figure 24A:
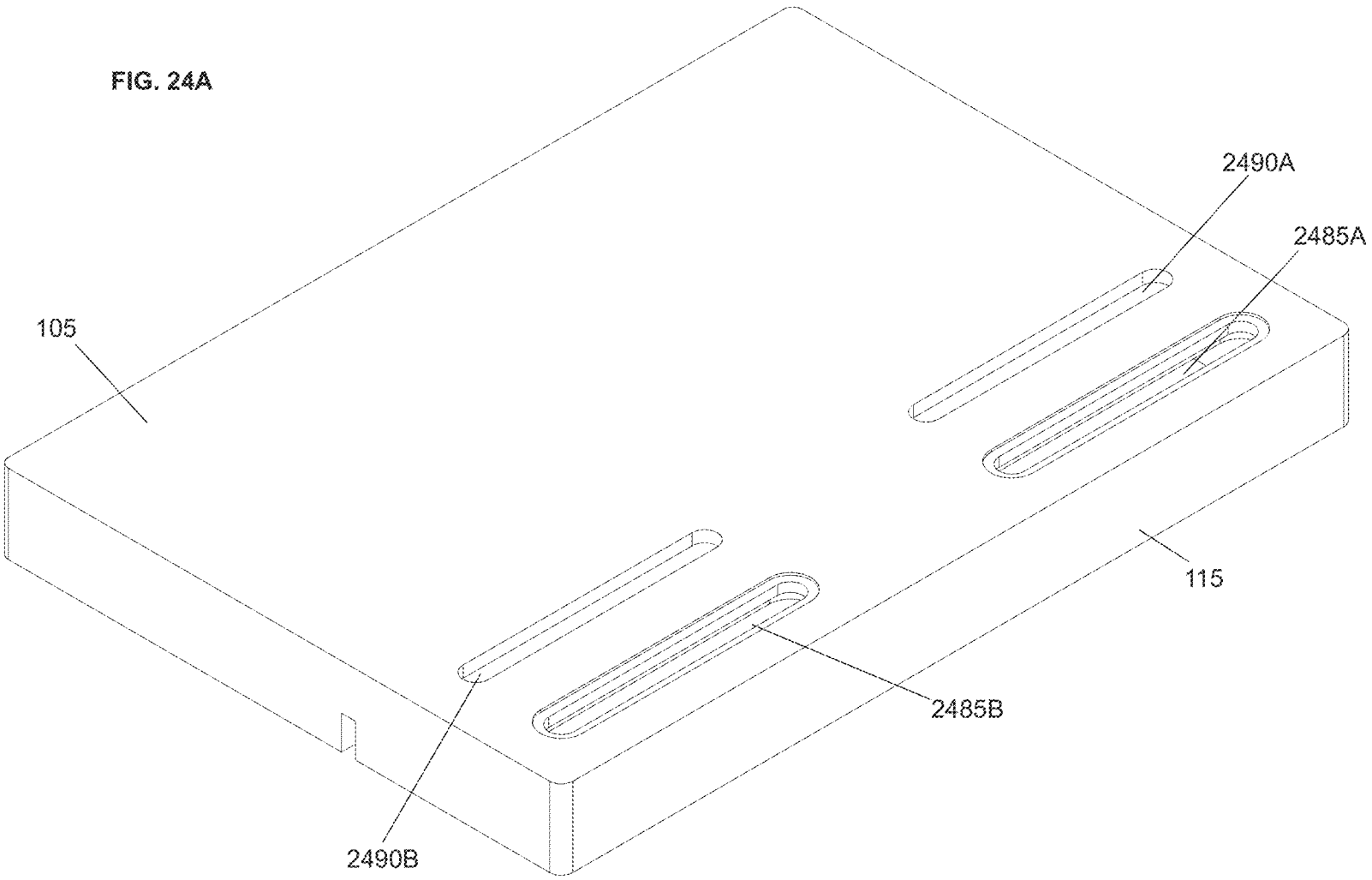
FIGS. 24A-24D illustrate an embodiment of a threaded fixing in accordance with an embodiment of the invention.
Figure 24B:
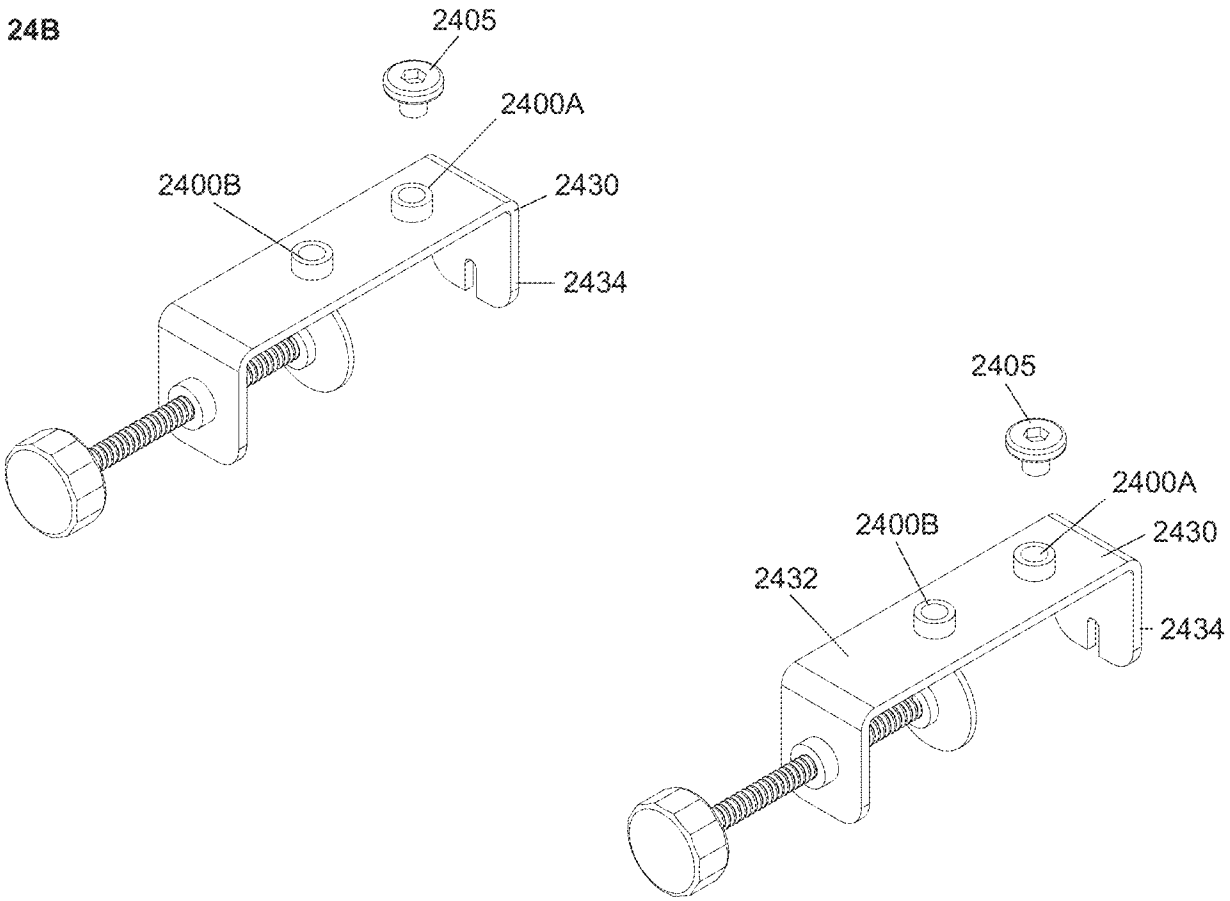
Figure 24C:
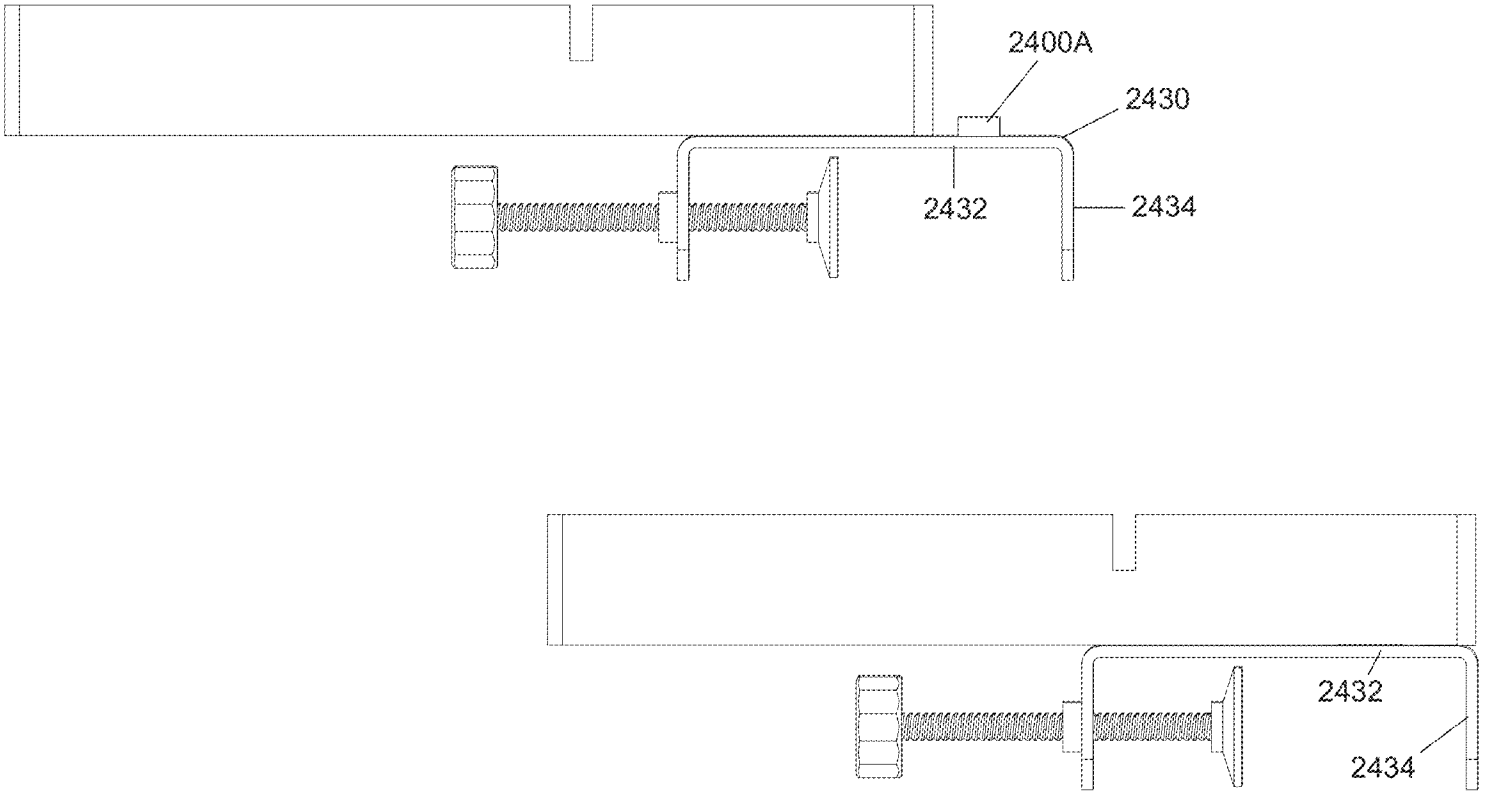
Figure 24D:
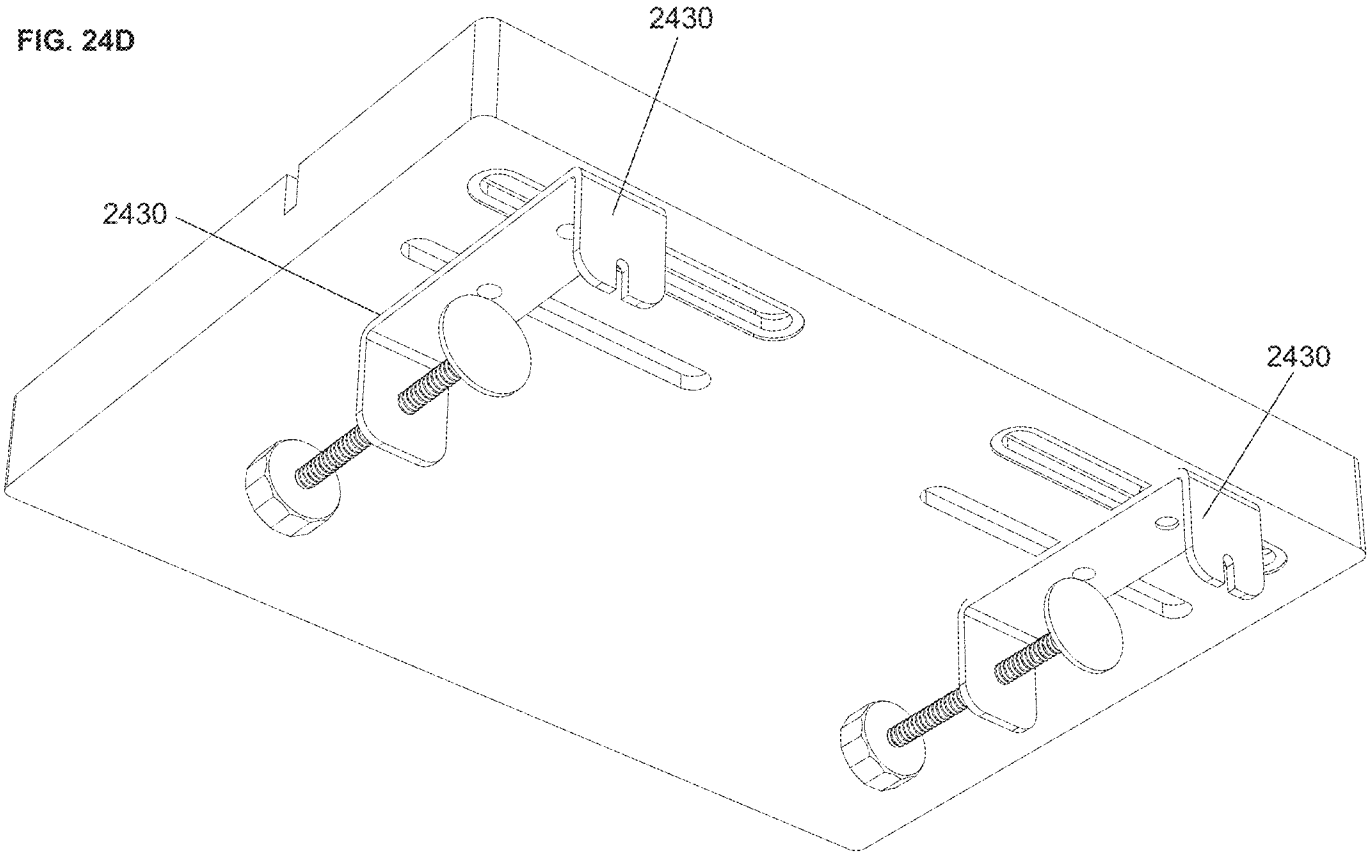

As illustrated in FIG. 24B, a threaded fixing in accordance with an embodiment of the invention, comprises a post 2400A and a post 2400B both of which have external male threads that can mate with internal female threads in a threaded hole of horizontally oriented side 2432 of C-clamp 2430 (FIG. 24B). A nut 2405 with internal female threads can mate with the post 2400A or 2400B and thereby couple the C-clamp to the tray. (FIGS. 24B, 24C). When the nut 2405 is mated with post 2400A, the C-clamp is coupled to tray such that vertically oriented side 2434 of the C-clamp is flush with edge 115 of tray 100, and post 2400B is situated within recession 2490A or 2490B depending on the location of the C-clamp. When nut 2405 is mated to post 2400B, the C-clamp is coupled to the tray such that vertically oriented side 2434 is extended horizontally from edge 115 of tray 100. Thus, the threaded fixing, e.g., post 2400A or 2400B, is positioned along a length of the horizontally oriented side 2432 of the C-clamp 2430 and passes through any position along the elongated aperture 2485A or 2485B, according to where the C-clamp 2430 is positioned, via which at least a portion of the horizontally oriented side 2432 of the C-clamp 2430 is coupled to the bottom surface of the planar base.

In an embodiment, the top of nut 2405 is flush or below the top surface of planar base 105 once the C-clamp is installed, allowing for a plastic cap or the like to be placed in the elongated aperture, rendering a smooth, unbroken, top surface of the planar base.

Figure 25A:
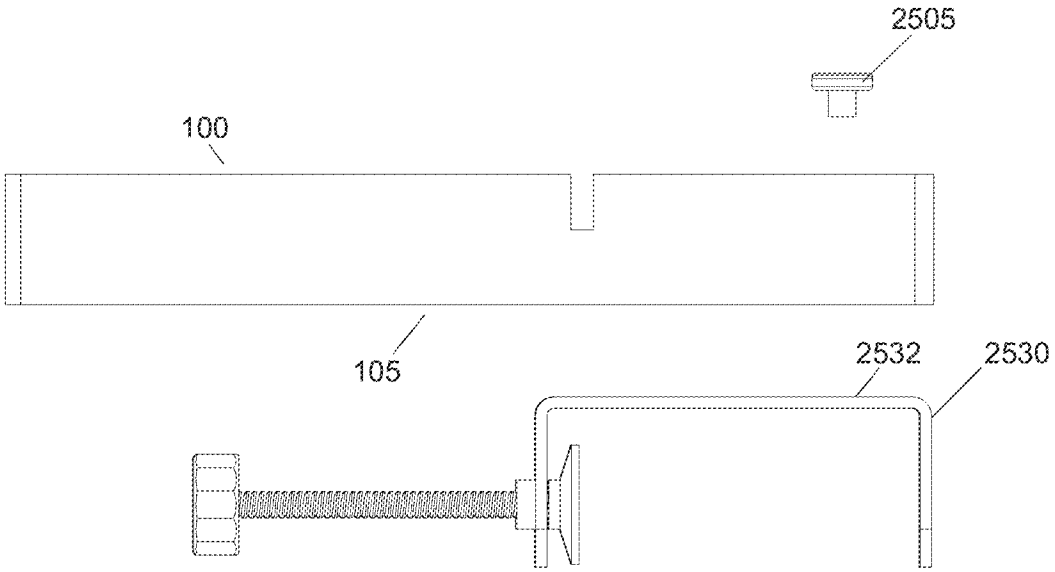
FIGS. 25A, 25B and 25C illustrate an embodiment of a threaded fixing in accordance with an embodiment of the invention.
Figure 25B:
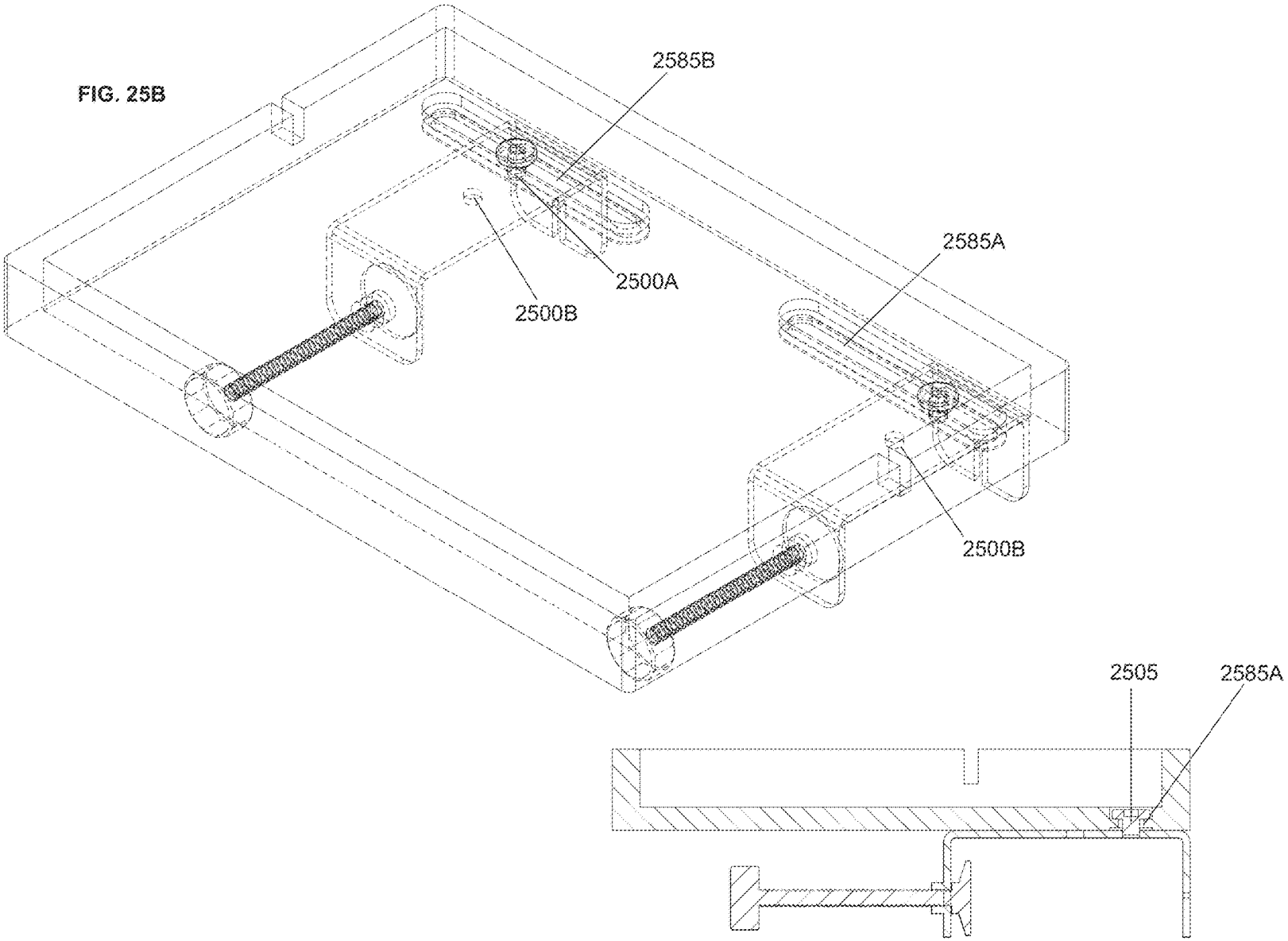
Figure 25C:
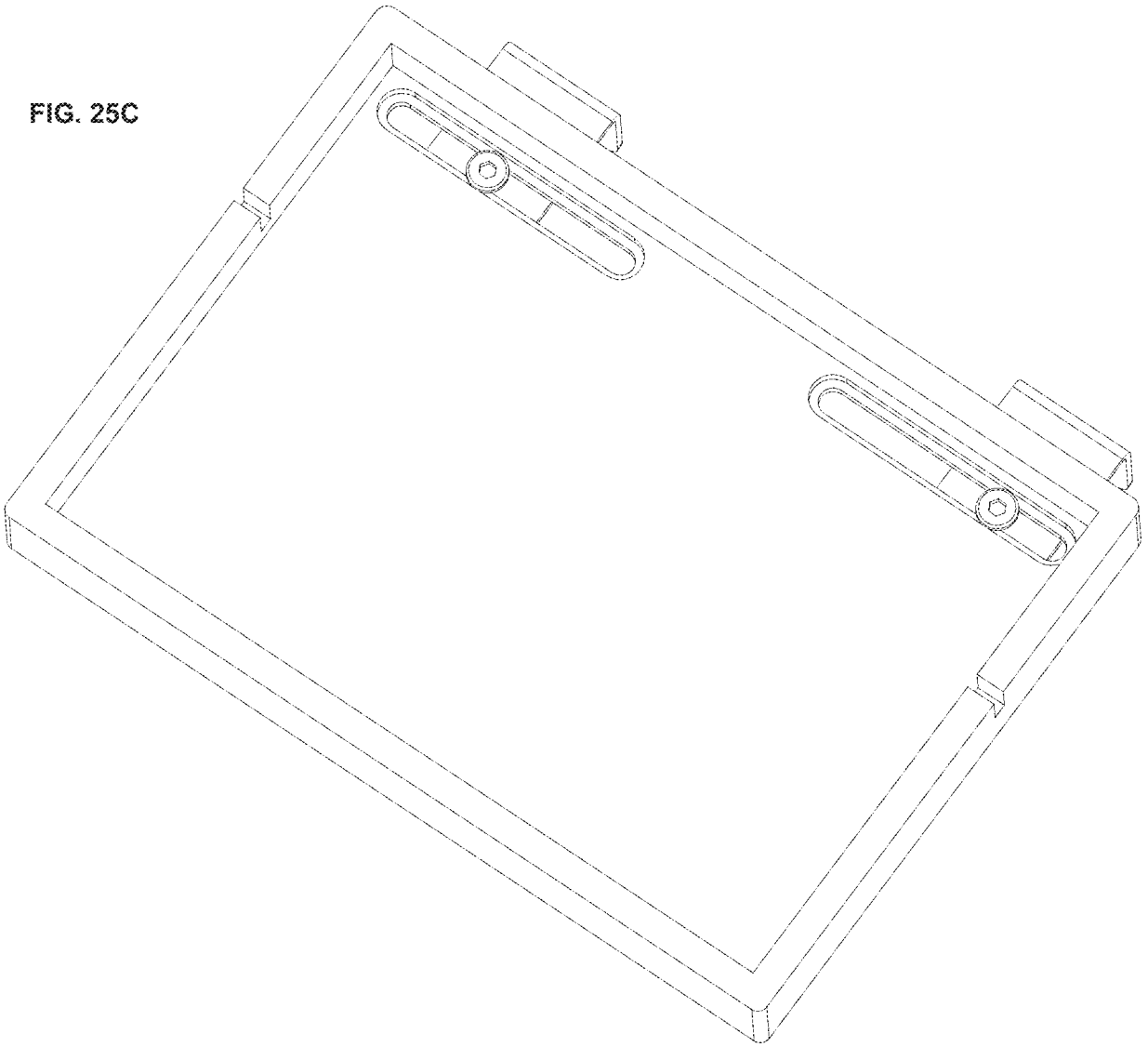

FIGS. 25A-25C illustrate a threaded fixing in accordance with an embodiment of the invention which is like the embodiment illustrated in FIGS. 24A-24D except that the threaded fixing is a single external male threaded bolt 2505 that is inserted from above the tray 100, through elongated aperture 2585A and/or 2585B to mate with an internal female threaded hole 2500A or 2500B in the horizontally oriented side 2532 of C-clamp 2530, thereby coupling C-clamp 2530 to the bottom surface of the planar base 105 of tray 100.

Figure 26A:
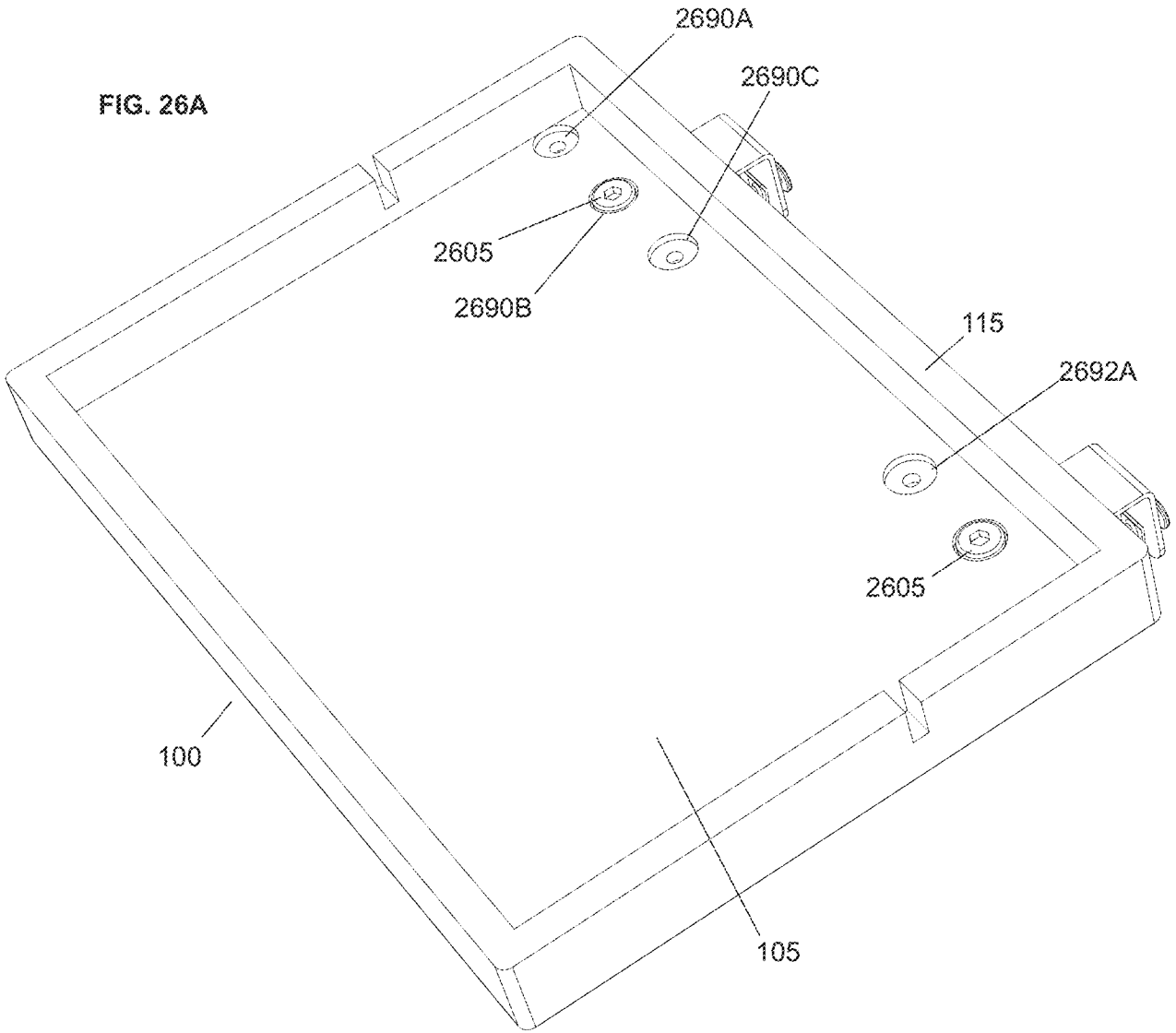
FIGS. 26A, 26B and 26C illustrate an embodiment of a threaded fixing in accordance with an embodiment of the invention.
Figure 26B:
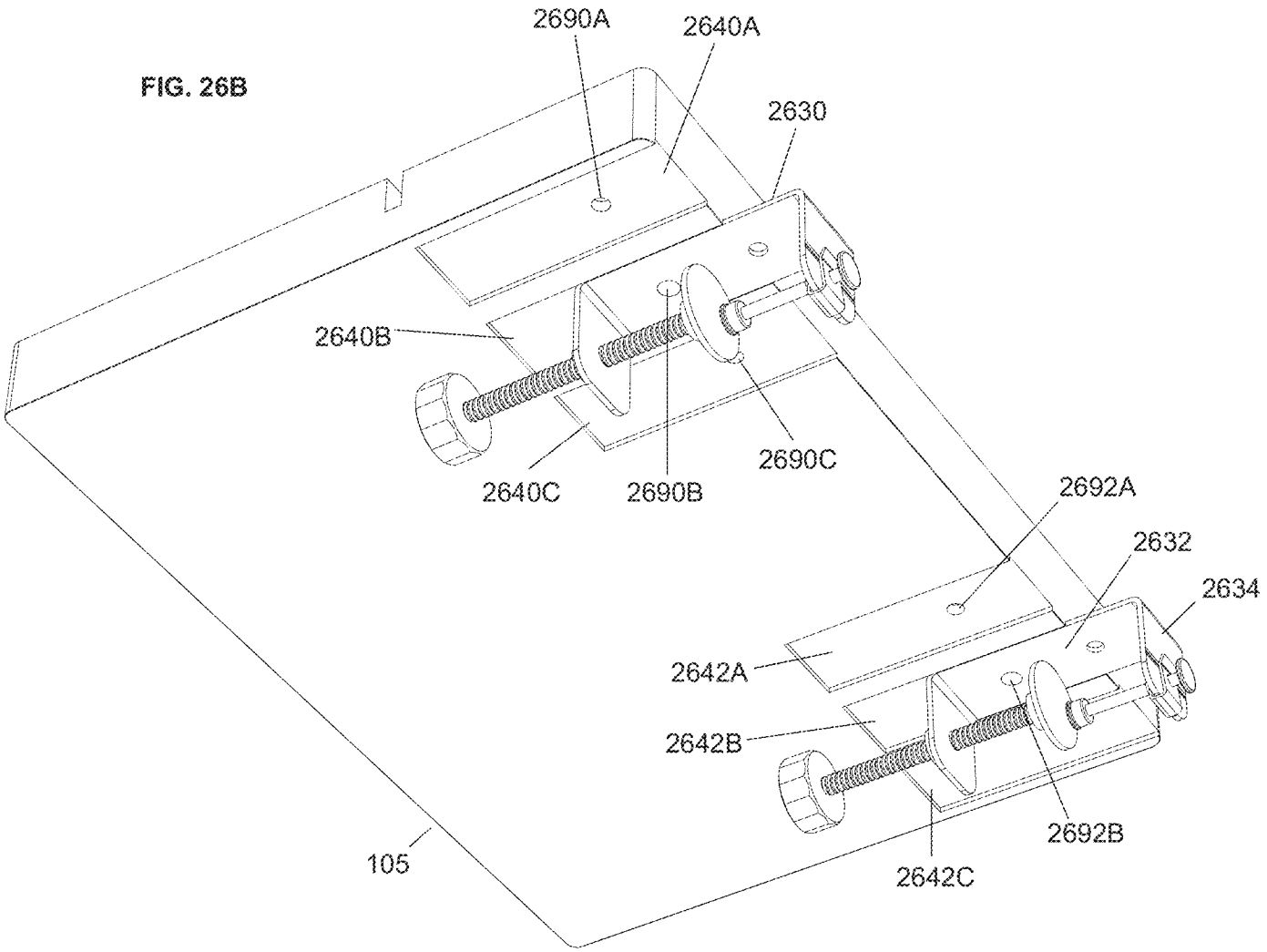
Figure 26C:
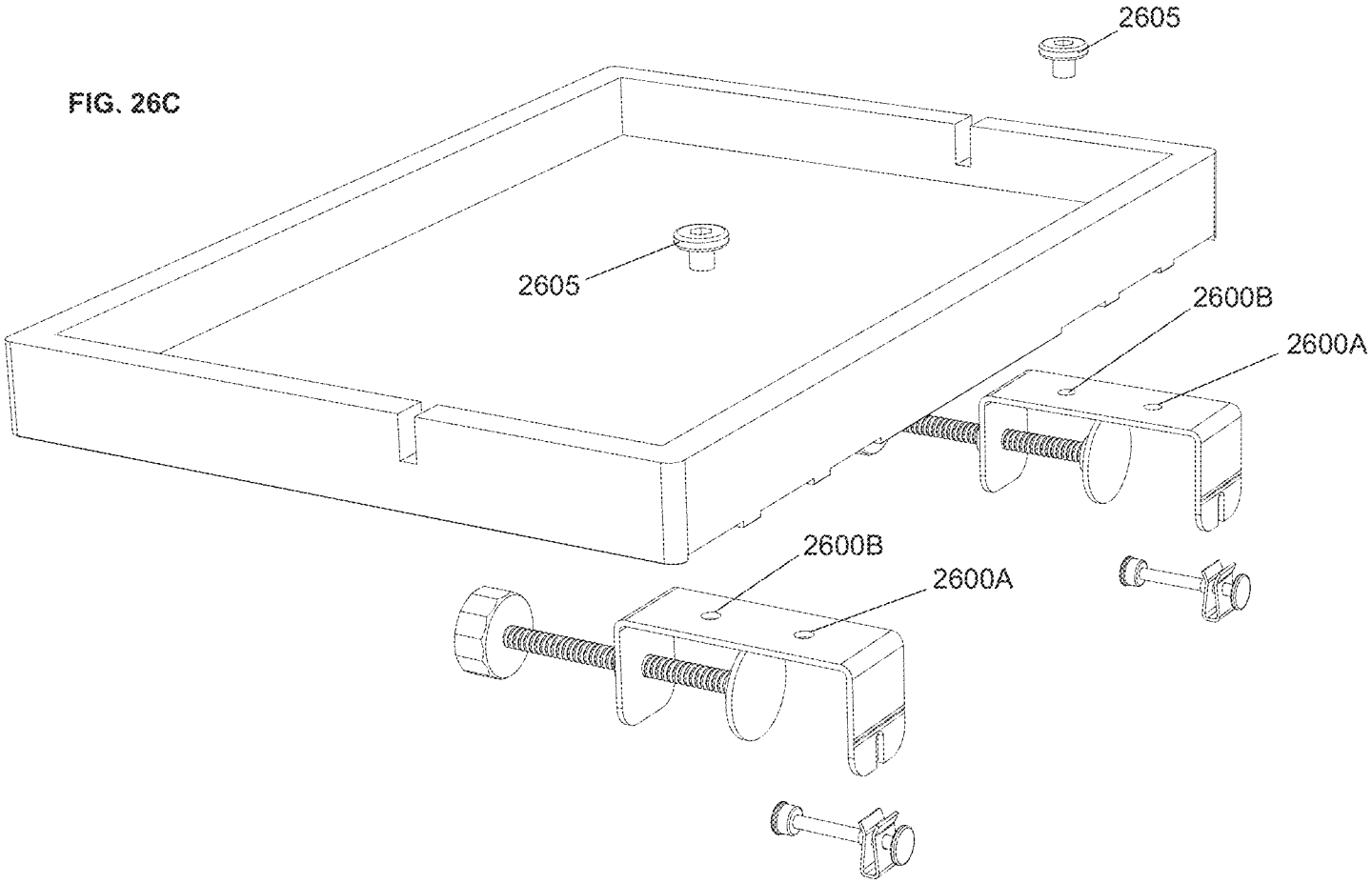

FIGS. 26A-26C illustrate a threaded fixing in accordance with an embodiment of the invention like the embodiment illustrated in FIGS. 24A-24D but without the elongated apertures in planar base 105. Rather, a threaded fixing may be inserted through a series of holes 2690A, 2690B and 2690C, or 2692A, 2692B and 2692C to couple the bottom surface of planar base 105 to a C-clamp 2630. As illustrated, the planar base 105 comprises a plurality of holes 2690A, 2690B and 2690C and another plurality of holes 2692A, 2692B and 2692C. The number of plurality of holes correspond to at least the number of C-clamp(s) to be coupled to the bottom surface of the planar base. Each plurality of holes, e.g., whether 2690A, 2690B and 2690C, or 2692A, 2692B and 2692C, run parallel to and offset from (inside of) the edge 115, and normal to the horizontally oriented side 2632 of at least the portion of the C-clamp 2630 coupled to the bottom surface of the planar base 105 (which as described above is positioned substantially normal to and adjacent the edge).

As illustrated in FIGS. 26A and 26C, a threaded fixing in accordance with an embodiment of the invention, comprises a nut 2605 which has external male threads that can mate with internal female threads in a threaded hole, or in one of a plurality of threaded holes, of horizontally oriented side 2632 of C-clamp 2630 and thereby couple the C-clamp to the tray. For example, when the nut 2605 is mated with hole 2600A, the C-clamp is coupled to tray such that vertically oriented side 2634 of the C-clamp is flush with edge 115 of tray 100. When nut 2605 is mated to hole 2600B, the C-clamp is coupled to the tray such that vertically oriented side 2634 is extended horizontally from edge 115 of tray 100. Thus, the threaded fixing, whether inserted into hole 2600A or 2600B, is positioned along a length of the horizontally oriented side 2632 of the C-clamp 2630 and passes through one of 2690A, 2690B and 2690C, or 2692A, 2692B and 2692C, according to where the C-clamp 2630 is positioned, via which at least a portion of the horizontally oriented side 2632 of the C-clamp 2630 is coupled to the bottom surface of the planar base.

Although the invention has been described and illustrated in the foregoing illustrative embodiments, it is understood that the present disclosure has been made only by way of example, and that numerous changes in the details of implementation of the invention can be made without departing from the spirit and scope of the invention, which is only limited by the claims that follow. Features of the disclosed embodiments can be combined and rearranged in various ways.

What is claimed is:

1. A tray, capable of being frictionally engaged to a support structure, the tray comprising:

a planar base extending in a horizontal plane and having an edge parallel to the support structure;

a C-clamp coupled to a bottom surface of the planar base, comprising:

a horizontally oriented side, a first portion of which abuts a bottom surface of the planar base, a second portion of which extends further in the horizontal plane from the edge of the base;

a first vertically oriented side meeting the second portion of horizontally oriented side at a first corner of the C-clamp and extending downward; and a second vertically oriented side meeting, under the bottom surface of the planar base, the first portion of the horizontally oriented side at a second corner of the C-clamp and extending downward, the second vertically oriented side positioned a horizontal distance from the edge of the base and opposite the first vertically oriented side sufficient to receive the support structure positioned therebetween, the second vertically oriented side comprising a threaded hole; and a screw comprising a handle at a first end of the screw and a shoe at a second end of the screw, the second end of the screw passing through the threaded hole of the second vertically oriented side of the C-clamp and extending horizontally toward the first vertically oriented side of the C-clamp, wherein movement of the handle causes the second end of the screw to further extend horizontally toward the first vertically oriented side of the C-clamp such that the shoe and the first vertically oriented side of the C-clamp frictionally engage the support structure when the support structure is positioned between the first and second vertically oriented sides of the C-clamp.

2. The tray of claim 1, wherein the tray further comprises a threaded fixing positioned along the first portion of the horizontally oriented side of the C-clamp via which to couple the C-clamp to the bottom surface of the planar base.

3. The tray of claim 2, wherein the horizontally oriented side of the C-clamp comprises a hole positioned along the first portion of the horizontally oriented side of the C-clamp through which the threaded fixing passes to couple the C-clamp to the bottom surface of the planar base.

4. The tray of claim 3, wherein the threaded fixing comprises a bolt with external male threads that passes through the hole positioned along the first portion of the horizontally oriented side of the C-clamp to mate with a nut with internal female threads embedded at the bottom surface of the planar base to couple the C-clamp to the bottom surface of the planar base.

5. The tray of claim 2, wherein the horizontally oriented side of the C-clamp comprises a plurality of holes positioned along the first portion of the horizontally oriented side of the C-clamp, wherein the threaded fixing passes through any one of the plurality of holes of the horizontally oriented side of the C-clamp to couple the C-clamp to the bottom surface of the planar base.

6. The tray of claim 1, wherein the bottom surface of the planar base comprises a plurality of channels each oriented normal to and adjacent the edge and sized to receive at least the first portion of the horizontally oriented side of the C-clamp where it abuts to the bottom surface of the planar base.

7. The tray of claim 1, wherein the planar base comprises an elongated aperture, parallel to and offset from the edge, and normal to the horizontally oriented side of at least the portion of the C-clamp coupled to the bottom surface of the planar base, normal to and adjacent the edge; and wherein the tray further comprises a threaded fixing positioned along a length of the horizontally oriented side of the C-clamp and passing through any position along the elongated aperture via which at least the portion of the horizontally oriented side of the C-clamp is coupled to the bottom surface of the planar base.

8. The tray of claim 1, wherein the first vertically oriented side of the C-clamp comprises a threaded hole, the tray further comprising a second screw comprising a handle at a first end of the second screw and a shoe at a second end of the second screw, the second end of the second screw passing through the threaded hole of the first vertically oriented side of the C-clamp and extending horizontally toward the second vertically oriented side of the C-clamp, wherein movement of the handle of the second screw causes the second end of the second screw to further extend horizontally toward the second vertically oriented side of the C-clamp such that the shoe of the screw and the shoe of the second screw frictionally engage the support structure when the support structure is positioned between the first and second vertically oriented sides of the C-clamp.

9. The tray of claim 8, wherein the threaded hole in the first vertically oriented side of the C-clamp comprises a slot and a clip slidably engaged with the slot, wherein the second screw passing through the threaded hole of the first vertically oriented side of the C-clamp comprises the second screw passing through the slot.

10. The tray of claim 9, wherein the second screw comprises an externally threaded second screw, and wherein the clip comprises an internally threaded flange, wherein the second screw passing through the threaded hole of the first vertically oriented side of the C-clamp comprises the externally threaded second screw passing through the internally threaded flange of the slot.

* * * * *